US008969798B2

(12) United States Patent
Park

(10) Patent No.: US 8,969,798 B2
(45) **Date of Patent: *Mar. 3, 2015**

(54) ABRIDGED ION TRAP-TIME OF FLIGHT MASS SPECTROMETER

(75) Inventor: Melvin Andrew Park, Billerica, MA (US)

(73) Assignee: Bruker Daltonics, Inc., Billerica, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/249,709

(22) Filed: Sep. 30, 2011

(65) Prior Publication Data

US 2013/0009051 A1 Jan. 10, 2013

Related U.S. Application Data

(63) Continuation-in-part of application No. 13/177,780, filed on Jul. 7, 2011.

(51) Int. Cl.
*H01J 49/40* (2006.01)
*H01J 49/06* (2006.01)
*H01J 49/42* (2006.01)

(52) U.S. Cl.
CPC ..... *H01J 49/40* (2013.01); *H01J 49/063* (2013.01); *H01J 49/421* (2013.01)
USPC ..... 250/287; 250/396 R; 250/290; 250/282; 250/292

(58) Field of Classification Search
CPC ..... H01J 49/403; H01J 49/063; H01J 49/421; H01J 49/4225
USPC ..... 250/288, 287, 290–292, 294, 281, 282, 250/396 R
See application file for complete search history.

(56) References Cited

U.S. PATENT DOCUMENTS

| | | | | | |
|---|---|---|---|---|---|
| 3,648,046 | A | * | 3/1972 | Denison et al. | 250/281 |
| 4,556,823 | A | * | 12/1985 | Keller et al. | 315/111.81 |
| 4,962,309 | A | * | 10/1990 | White et al. | 250/396 R |
| 4,963,736 | A | | 10/1990 | Douglas | |
| 5,283,436 | A | | 2/1994 | Wang | |
| 5,652,427 | A | * | 7/1997 | Whitehouse et al. | 250/288 |
| 5,726,448 | A | * | 3/1998 | Smith et al. | 250/290 |
| 5,763,878 | A | | 6/1998 | Franzen | |
| 5,847,386 | A | | 12/1998 | Thomson | |
| 5,965,884 | A | | 10/1999 | Laiko | |
| 5,969,348 | A | * | 10/1999 | Franzen | 250/282 |

(Continued)

OTHER PUBLICATIONS

Torgerson, D.F., Skowronski, R.P. and Macfarlane, R. D., "New Approach to the Mass Spectroscopy of Non-volatile Compounds", Biochemical and Biophysical Research Communications, v. 60, n. 2, pp. 616-621 (1974).

(Continued)

*Primary Examiner* — Nicole Ippolito
*Assistant Examiner* — Wyatt Stoffa
(74) *Attorney, Agent, or Firm* — O'Shea Getz P.C.

(57) ABSTRACT

An improved trap-TOF mass spectrometer has a set of electrodes arranged to produce both a quadrupolar RF confining field and a substantially homogeneous dipole field. In operation, ions are first confined by the RF field and then, at a selected time, the RF confining field is discontinued and the dipole field is used to accelerate the ions so as to initiate a TOF MS analysis. The apparatus of the present invention may be used alone or in conjunction with other analyzers to produce mass spectra from analyte ions.

27 Claims, 36 Drawing Sheets

(56) References Cited

U.S. PATENT DOCUMENTS

| | | | | |
|---|---|---|---|---|
| 6,051,838 | A * | 4/2000 | Frosien et al. | 250/396 R |
| 6,157,031 | A * | 12/2000 | Prestage | 250/292 |
| 6,465,792 | B1 * | 10/2002 | Baptist | 250/396 R |
| 6,576,895 | B1 * | 6/2003 | Park | 250/287 |
| 6,756,599 | B2 * | 6/2004 | Kienzle | 250/492.2 |
| 6,787,760 | B2 | 9/2004 | Belov | |
| 6,911,650 | B1 | 6/2005 | Park | |
| 6,956,202 | B2 | 10/2005 | Sabczynski et al. | |
| 7,034,293 | B2 | 4/2006 | Wells | |
| 7,227,138 | B2 | 6/2007 | Lee | |
| 7,550,717 | B1 * | 6/2009 | Belford et al. | 250/281 |
| 7,723,679 | B2 | 5/2010 | Tolley | |
| 7,829,849 | B2 * | 11/2010 | Giles | 250/290 |
| 7,858,934 | B2 * | 12/2010 | Belford et al. | 250/293 |
| 7,872,228 | B1 * | 1/2011 | Kim et al. | 250/292 |
| 8,008,618 | B2 * | 8/2011 | Londry | 250/283 |
| 8,067,747 | B2 * | 11/2011 | Wollnik | 250/396 R |
| 2001/0035498 | A1 * | 11/2001 | Li et al. | 250/398 |
| 2002/0190205 | A1 | 12/2002 | Park | |
| 2004/0135080 | A1 * | 7/2004 | Ouyang et al. | 250/292 |
| 2005/0098719 | A1 * | 5/2005 | Thomson | 250/288 |
| 2006/0016981 | A1 | 1/2006 | Park | |
| 2006/0038121 | A1 * | 2/2006 | Guevremont | 250/290 |
| 2008/0017794 | A1 * | 1/2008 | Verbeck | 250/292 |
| 2008/0210859 | A1 * | 9/2008 | Tolley et al. | 250/282 |
| 2008/0265154 | A1 * | 10/2008 | Cousins et al. | 250/288 |
| 2009/0159796 | A1 * | 6/2009 | Belford et al. | 250/294 |
| 2009/0206250 | A1 * | 8/2009 | Wollnik | 250/290 |
| 2010/0044558 | A1 * | 2/2010 | Sudakov | 250/281 |
| 2011/0042563 | A1 | 2/2011 | Giles | |
| 2011/0049360 | A1 * | 3/2011 | Schoen | 250/290 |
| 2011/0133079 | A1 * | 6/2011 | Cousins et al. | 250/294 |
| 2012/0305759 | A1 * | 12/2012 | Park | 250/282 |

OTHER PUBLICATIONS

Vanbreeman, R.B., Snow, M. and Cotter, R.J., "Time Resolved Laser Desorption Mass Spectrometry.—I Desorption of Preformed Ions", International Journal of Mass Spectrometry and Ion Physics, v. 49, pp. 35-50 (1983), Elsevier Scientific Publishing Company, Amsterdam, Netherlands.

Tabet, J.C. and Cotter, R.J., "Laser Desorption Time-of-Flight Mass Spectrometry of High Mass Molecules", Analytical Chemistry, v. 56, pp. 1662-1667 (1984).

Olthoff, J.K., Lys, I., Demirev, P. and Cotter, R.J., "Modification of Wiley-McLaren TOF Analyzers for Laser Desorption", Analytical Instrumentation, v. 16, n. 1, pp. 93-115 (1987).

Tanaka, K., Waki, H., Ido, Y., Akita, S., Yoshida, Y. And Yoshica, T., "Protein and Polymer Analyses up to m/z 100 000 by Laser Ionization Time-of-flight Mass Spectrometry", Rapid Communications in Mass Spectrometry, v. 2, n. 8, pp. 151-153 (1988).

Karas, M. and Hillenkamp, F., "Laser Desorption Ionization of Proteins with Molecular Masses Exceeding 10 000 Daltons", Analytical Chemistry, v. 60, pp. 2299-2301 (1988).

Dole, M., Mack, L.L., Hines, R.L., Mobley, R.C., Ferguson, L.D. and Alice, M.B., "Molecular Beams of Macroions", The Journal of Chemical Physics, v. 49, n. 5, pp. 2240-2249 (1968).

Chernushevich, I.V., Ens, W. and Standing, K.C., "Orthogonal Injection TOFMS for Analyzing Biomolecules", Analyical Chemistry News and Features, v. 71, n. 13, pp. 452A-461A (1999).

Olivares, J. A., Nguyen, N. T., Yonker, C.R. and Smith, R.D., "On-line Mass Spectrometric Detection for Capillary Zone Electrophoresis", Analytical Chemistry, v. 59, pp. 1230-1232 (1987).

Smith, R.D., Olivares, J.A., Nguyen, N.T. and Udseth, H.R., "Capillary Zone Electrophoresis—Mass Spectrometry Using an Electrospray Ionization Interface", Analytical Chemistry, v. 60, pp. 436-441 (1988).

Morris, H. R., Paxton, T., Dell, A., Langhorne, J., Berg, M. Bordoli, R.S., Noyes, J. and Bateman, R.H., "High Sensitivity Collisionally-activated Decomposition Tandem Mass Spectrometry on a Novel Quadrupole/Orthogonal-acceleration Time-of-flight Mass Spectrometer", Rapid Communications in Mass Spectrometry, v. 10, pp. 889-896 (1996).

Sakudo, N. and Hayashi, T., "Quadrupole Electrodes with Flat Faces", Review of Scientific Instruments, v. 46, n. 8, pp. 1060-1062 (1975).

Wilhelm, U., Weickhardt, C. and Grotemeyer, J., "Ion Trajectory Calculations for a Quadrupole-ion-trap Reflectron-time-of-flight Hybrid Instrument: Effects of the Initial RF-Phase and the Trapping Time on an Ion Bunch Produced from a Molecular Beam", Rapid Communications in Mass Spectrometry, v. 10, pp. 473-477 (1996).

Qian, M G. and Lubman, D.M., "Procedures for Tandem Mass Spectrometry on an Ion Trap Storage/Reflectron Time-of-flight Mass Spectrometer" Rapid Communications in Mass Spectrometry, v. 10, pp. 1911-1920 (1996).

He, L. and Lubman, D.M., "Simulation of External Ion Injection, Cooling and Extraction Processes with Simion 6.0 for the Ion Trap/Reflectron Time-of-flight Mass Spectrometer", Rapid Communications in Mass Spectrometry, v. 11, pp. 1467-1477 (1997).

Tanaka, K., Kawatoh, E., Ding, L., Smith, A. and Kumashiro, S., "A Maldi-Quadrupole Ion Trap-TOF Mass Spectrometer", American Society for Mass Spectrometry, Poster TP086, ASMS1999, Dallas Texas, Jun. 1999.

Korean Search Report and Written Opinion, dated Dec. 10, 2012.

Jiang, G., Li, X., Luo, C., Ding C., and Ding L., "PCB Ion Trap Mass Spectrometer (PCBITMS) Coupled with ESI Source", Presentation at the Proceedings of the 57th ASMS Conference on Mass Spectrometry and Allied Topics, May 31-Jun. 4, 2009.

Peng, Y., Zhang, Z., Hansen B., Wang, M., Hawkins, A., and Austin, D., "Design and performance of the coaxial ion trap: Transferring ions between two trapping regions in one mass analyzer", Presentation at the Proceedings of the 58th ASMS Conference on Mass Spectrometry and Allied Topics, May 31-Jun. 4, 2010.

* cited by examiner

40

84

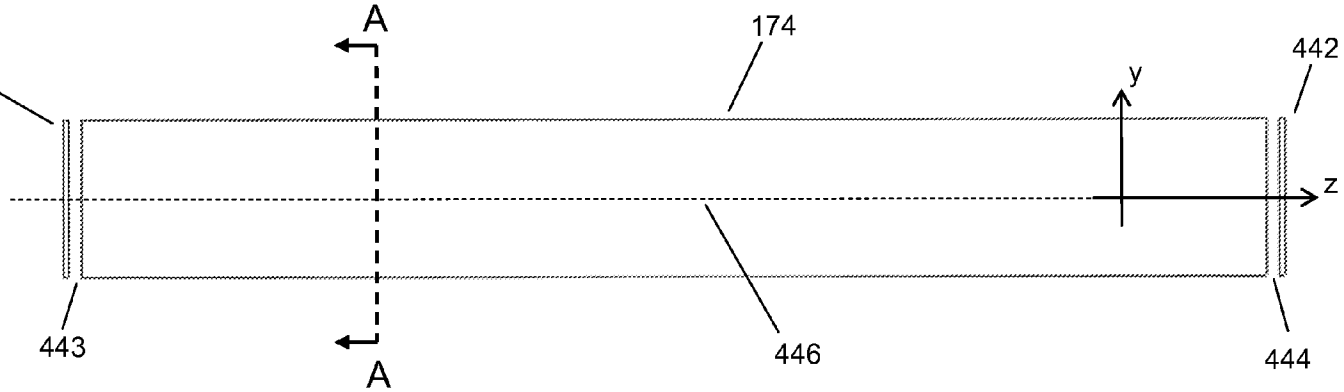
FIG. 12B
FIG. 12A
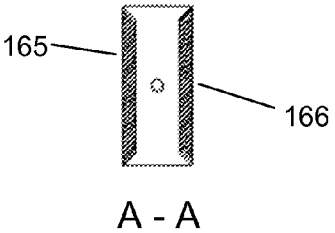
A - A
FIG. 12C

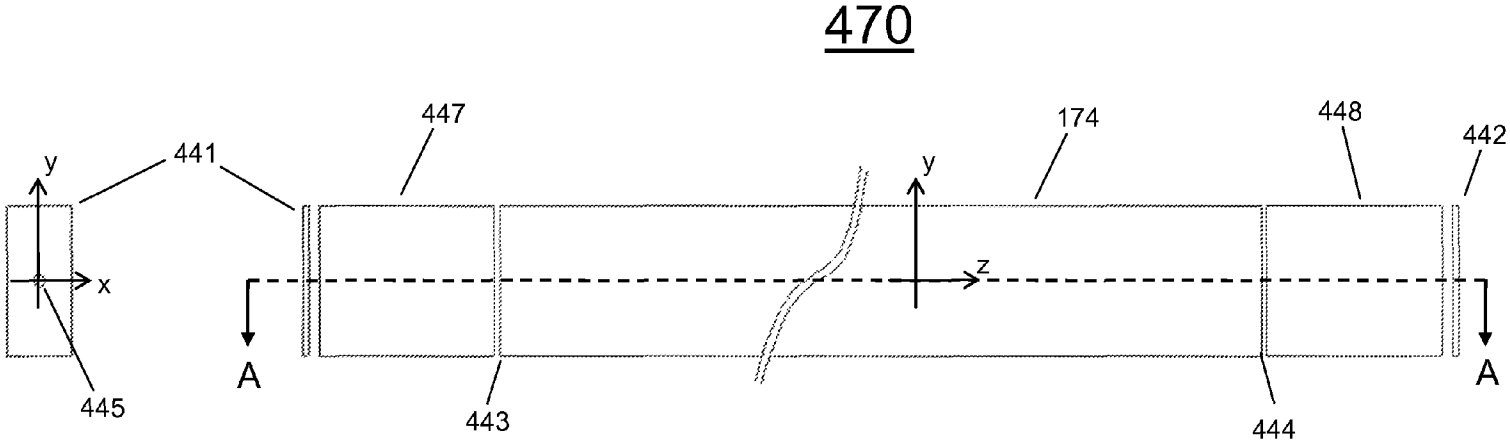
FIG. 13B
FIG. 13A
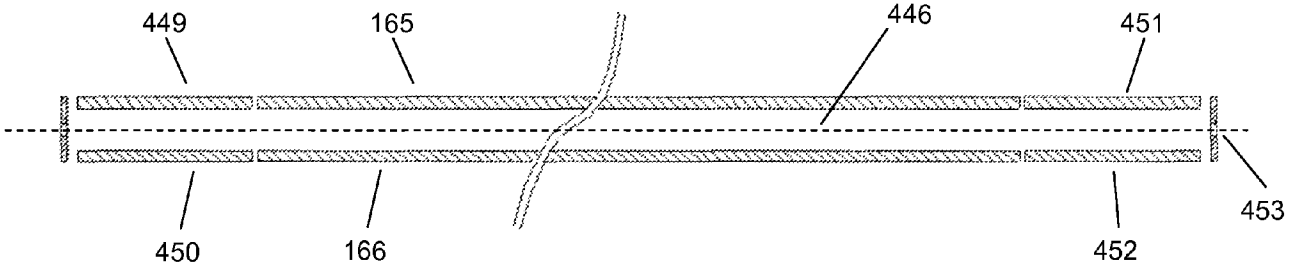
FIG. 13C

549

585

620

V
$E_x$
c
Lens Element 648
Abridged Trap 638
Front Section 640
Abridged Trap 592
Back Section 642
V, $E_x$, c
672
Z

674

ABRIDGED ION TRAP-TIME OF FLIGHT MASS SPECTROMETER

BACKGROUND

The present invention generally relates to an improved method and apparatus for the analysis of samples by mass spectrometry. The apparatus and methods for ion transport and analysis described herein are enhancements of techniques referred to in the literature relating to mass spectrometry—an important tool in the analysis of a wide range of chemical compounds. Specifically, mass spectrometers can be used to determine the molecular weight of sample compounds. The analysis of samples by mass spectrometry consists of three main steps—formation of gas phase ions from sample material, mass analysis of the ions to separate the ions from one another according to ion mass, and detection of the ions. A variety of means and methods exist in the field of mass spectrometry to perform each of these three functions. The particular combination of the means and methods used in a given mass spectrometer determine the characteristics of that instrument.

To mass analyze ions, for example, one might use magnetic (B) or electrostatic (E) analysis, wherein ions passing through a magnetic or electrostatic field will follow a curved path. In a magnetic field, the curvature of the path will be indicative of the momentum-to-charge ratio of the ion. In an electrostatic field, the curvature of the path will be indicative of the kinetic energy-to-charge ratio of the ion. If magnetic and electrostatic analyzers are used consecutively, then both the momentum-to-charge and kinetic energy-to-charge ratios of the ions will be known and the mass of the ion will thereby be determined. Other mass analyzers are the quadrupole (Q), the ion cyclotron resonance (ICR), the time-of-flight (TOF), the orbitrap, and the quadrupole ion trap analyzers. The analyzer used in conjunction with the method described here may be any of these.

Before mass analysis can begin, gas phase ions must be formed from a sample material. If the sample material is sufficiently volatile, ions may be formed by electron ionization (EI) or chemical ionization (CI) of the gas phase sample molecules. Alternatively, for solid samples (e.g., semiconductors, or crystallized materials), ions can be formed by desorption and ionization of sample molecules by bombardment with high energy particles. Further, Secondary Ion Mass Spectrometry (SIMS), for example, uses keV ions to desorb and ionize sample material. In the SIMS process a large amount of energy is deposited in the analyte molecules, resulting in the fragmentation of fragile molecules. This fragmentation is undesirable in that information regarding the original composition of the sample (e.g., the molecular weight of sample molecules) will be lost.

For more labile, fragile molecules, other ionization methods now exist. The plasma desorption (PD) technique was introduced by Macfarlane et al. (D. F. Torgerson, R. P. Skowronski, and R. D. Macfarlane, *Biochem. Biophys. Res Commoun.* 60 (1974) 616)("McFarlane"). Macfarlane discovered that the impact of high energy (MeV) ions on a surface, like SIMS would cause desorption and ionization of small analyte molecules. However, unlike SIMS, the PD process also results in the desorption of larger, more labile species (e.g., insulin and other protein molecules).

Additionally, lasers have been used in a similar manner to induce desorption of biological or other labile molecules. See, for example, Cotter et al. (R. B. VanBreeman, M. Snow, R. J. Cotter, *Int. J. Mass Spectrom. Ion Phys.* 49 (1983) 35; Tabet, J. C.; Cotter, R. J., Tabet, J. C., *Anal. Chem.* 56 (1984) 1662; or R. J. Cotter et al., *Anal. Instrument.* 16 (1987) 93). Cotter modified a CVC 2000 time-of-flight mass spectrometer for infrared laser desorption of non-volatile biomolecules, using a Tachisto (Needham, Mass.) model 215G pulsed carbon dioxide laser. The plasma or laser desorption and ionization of labile molecules relies on the deposition of little or no energy in the analyte molecules of interest.

The use of lasers to desorb and ionize labile molecules intact was enhanced by the introduction of matrix assisted laser desorption ionization (MALDI) (K. Tanaka, H. Waki, Y. Ido, S. Akita, Y. Yoshida, T. Yoshica, *Rapid Commun. Mass Spectrom.* 2 (1988) 151 and M. Karas, F. Hillenkamp, *Anal. Chem.* 60 (1988) 2299). In the MALDI process, an analyte is dissolved in a solid, organic matrix. Laser light of a wavelength that is absorbed by the solid matrix but not by the analyte is used to excite the sample. Thus, the matrix is excited directly by the laser, and the excited matrix sublimes into the gas phase carrying with it the analyte molecules. The analyte molecules are then ionized by proton, electron, or cation transfer from the matrix molecules to the analyte molecules. This process (i.e., MALDI) is typically used in conjunction with time-of-flight mass spectrometry (TOFMS) and can be used to measure the molecular weights of proteins in excess of 100,000 Daltons.

Further, Atmospheric Pressure Ionization (API) includes a number of ion production means and methods. Typically, analyte ions are produced from liquid solution at atmospheric pressure. One of the more widely used methods, known as electrospray ionization (ESI), was first suggested by Dole et al. (M. Dole, L. L. Mack, R. L. Hines, R. C. Mobley, L. D. Ferguson, M. B. Alice, *J. Chem. Phys.* 49, 2240, 1968). In the electrospray technique, analyte is dissolved in a liquid solution and sprayed from a needle. The spray is induced by the application of a potential difference between the needle and a counter electrode. The spray results in the formation of fine, charged droplets of solution containing analyte molecules. In the gas phase, the solvent evaporates leaving behind charged, gas phase, analyte ions. This method allows for very large ions to be formed. Ions as large as 1 MDa have been detected by ESI in conjunction with mass spectrometry (ESMS).

In addition to ESI, many other ion production methods might be used at atmospheric or elevated pressure. For example, MALDI has recently been adapted by Laiko et al. to work at atmospheric pressure (Victor Laiko and Alma Burlingame, "Atmospheric Pressure Matrix Assisted Laser Desorption", U.S. Pat. No. 5,965,884, and Atmospheric Pressure Matrix Assisted Laser Desorption Ionization, poster #1121, $4^{th}$ International Symposium on Mass Spectrometry in the Health and Life Sciences, San Francisco, Aug. 25-29, 1998) and by Standing et al. at elevated pressures (Time of Flight Mass Spectrometry of Biomolecules with Orthogonal Injection+Collisional Cooling, poster #1272, $4^{th}$ International Symposium on Mass Spectrometry in the Health and Life Sciences, San Francisco, Aug. 25-29, 1998; and Orthogonal Injection TOFMS *Anal. Chem.* 71(13), 452A (1999)). The benefit of adapting ion sources in this manner is that the ion optics (i.e., the electrode structure and operation) in the mass analyzer and mass spectral results obtained are largely independent of the ion production method used.

A mass spectrometer which uses an elevated pressure ion source like ESI always has an ion production region (wherein ions are produced) and an ion transfer region (wherein ions are transferred through differential pumping stages and into the mass analyzer). The ion production region is at an elevated pressure—most often atmospheric pressure—with respect to the analyzer. The ion production region will often include an ionization "chamber". In an ESI source, for example, liquid samples are "sprayed" into the "chamber" to form ions.

Once the ions are produced, they must be transported to the vacuum for mass analysis. Generally, mass spectrometers (MS) operate in a vacuum between $10^{-4}$ and $10^{-10}$ torr depending on the type of mass analyzer used. In order for the gas phase ions to enter the mass analyzer, they must be separated from the background gas carrying the ions and transported through the single or multiple vacuum stages.

The use of RF multipole ion guides—including quadrupole ion guides—has been shown to be an effective means of transporting ions through a vacuum system. An RF multipole ion guide is usually configured as a set of (typically 4, 6, or 8) electrically conducting rods spaced symmetrically about a central axis with the axis of each rod parallel to the central axis. The ion guide has an entrance end and an exit end. Ions are generally intended to travel from the entrance to the exit end of the ion guide along the above mentioned central axis. An RF potential is applied between the rods of the ion guide so as to confine the ions radially with the ion guide. Through a combination of the ions' initial kinetic energy on entering the ion guide, a flow of gas moving along the ion guide axis, Coulombic repulsion from other ions in the ion guide, and diffusion of ions along the axis, the ions move along the central axis from the entrance end to the exit end.

Publications by Olivers et al. (Anal. Chem, Vol. 59, p. 1230-1232, 1987), Smith et al. (Anal. Chem. Vol. 60, p. 436-441, 1988) and Douglas et al. U.S. Pat. No. 4,963,736 (incorporated herein by reference) have reported the use of RF-only quadrupole ion guides (i.e. having four rods) to transportions from an API source to a mass analyzer. Moreover, a quadrupole ion guide capable of being operated in RF only mode configured to transportions is also described by Douglas.

Such multipole ion guides may be configured as collision cells capable of being operated in RF only mode with a variable DC offset potential applied to all rods. Thomson et al., U.S. Pat. No. 5,847,386 (incorporated herein by reference) also describes a quadrupole ion guide. The ion guide of Thomson is configured to create a DC axial field along its axis to move ions axially through a collision cell, inter alia, or to promote dissociation of ions (i.e., by Collision Induced Dissociation (CID)).

Other schemes are available utilizing both RF and DC potentials in order to facilitate the transmission of ions of a certain range of m/z values. For example, in H. R. Morris et al., High Sensitivity Collisionally Activated Decomposition Tandem Mass Spectrometry on a Novel Quadrupole/Orthogonal Acceleration Time-of-Flight Mass Spectrometer, *Rapid Commun. Mass Spectrom.* 10, 889 (1996)(Morris), uses a series of multipoles in their design, one of which is a quadrupole which is capable of being operated in a "wide bandpass" mode or a "narrow bandpass" mode. In the wide bandpass mode, an RF-only potential is applied to the quadrupole and ions of a relatively broad range of m/z values are transmitted. In narrow bandpass mode both RF and DC potentials are applied between the rods of the quadrupole such that ions of only a narrow range of m/z values are selected for transmission through the quadrupole. In subsequent multipoles the selected ions may be activated towards dissociation. In this way the instrument of Morris is able to perform MS/MS with the first mass analysis and subsequent fragmentation occurring in what would otherwise be simply a set of multipole ion guides.

Further, mass spectrometers similar to that of Whitehouse et al. U.S. Pat. No. 5,652,427, entitled "Multipole Ion Guide for Mass Spectrometry", (incorporated herein by reference) use multipole RF ion guides to transfer ions from one pressure region to another in a differentially pumped system. In the source of Whitehouse, ions are produced by ESI or APCI at substantially atmospheric pressure. These ions are transferred from atmospheric pressure to a first differential pumping region by the gas flow through a glass capillary. Ions are transferred from this first pumping region to a second pumping region through a "skimmer" by an electric field between these regions as well as gas flow. A multipole in the second differentially pumped region accepts ions of a selected mass/charge (m/z) ratio and guides them through a restriction and into a third differentially pumped region. This is accomplished by applying AC and DC voltages to the individual poles.

However, the above multipole ion guides all require that the rods of which they are constructed not be electrically connected to adjacent rods. In order to avoid discharges between adjacent rods, electrically insulating holders are frequently used to hold the rods in their proper places within the assembly. To further avoid arcing between adjacent rods along the surface of the insulating holder, the holder typically has a slot, groove, or similar cutout in the holder between adjacent rods. The insulating holder must not be exposed to the ion beam that is passing through the multipole because ions which fall onto the insulator will leave a charge on the surface of the holder. As the surface of the holder charges up, from the ions depositing charge there, an electrical potential will build up on the holder surface and project a field into the interior of the assembly. The field from a charged holder surface may disturb or prevent the progress of ions through the ion guide.

In the above multipole according to Whitehouse, the insulating holder and mounting brackets act also as the pumping restriction, however, the requirement to isolate adjacent rods from one another and to avoid exposing the holder surface to the ion beam means that the inner diameter of the holder must be substantially larger than the inscribed diameter of the multipole. As a result, the gas conductance is relatively high as compared to an aperture having the same diameter as the inscribed diameter of the multipole.

Park discloses a multiple frequency multipole ion guide in U.S. Pat. No. 6,911,650 (incorporated herein by reference). According to Park, the multiple frequency multipole ion guide " . . . can guide ions of a broad range of m/z through a pumping region to an analyzer. To accomplish this, a multitude of electrodes is used to . . . [construct] the ion guide. The ion guide is "driven" by a complex RF potential consisting of at least two frequency components. The potential is applied between the electrodes of the multipole in such a way that a low frequency RF field appears only near the boundaries of the multipole whereas a higher frequency field appears throughout the device. The high frequency field forces low m/z ions towards the center of the guide whereas the low frequency component of the field reflects high m/z ions toward the guide's interior, at the boundary of the ion guide." The ion guide according to Park has a mass transmission range of a factor of about 3,000—i.e. about 30 times that of a hexapole ion guide.

Importantly, the ion guide according to Park does not confine ions solely by the action of the RF fields. Rather, a set of DC electrodes is required in order to reflect ions at the gap between "virtual poles". This complicates the construction and operation of the multipole.

Many different types of analyzers have been used to mass analyze sample ions. One important type of mass analyzer is the quadrupole mass analyzer. There are also several types of quadrupole analyzers. Among them are the quadrupole filter, the quadrupole trap—a.k.a. the Paul trap—the cylindrical ion trap, linear ion trap, and the rectilinear ion trap.

The conventional quadrupole filter consists of four rods equally spaced at a predetermined radius around a central axis. A radio frequency (RF)—e.g. a 1 MHz sine wave-potential is applied between the rods. The potential on adjacent rods is 180° out of phase. Rods on opposite sides of the quadrupole axis are electrically connected—i.e. the quadrupole is formed as two pairs of rods. The quadrupole has an entrance end and an exit end. Ions to be filtered are injected into the entrance end of the quadrupole. These ions travel along the axis of the quadrupole to the exit end. The RF potential applied between the rods will tend to confine the ions radially. The quadrupole may be used as an ion guide when only the RF potential is applied. Ions of a broad m/z range may thereby be transmitted from the entrance to the exit end along the central axis. However, applying a DC as well as an RF potential between the pairs of rods will cause ions of only a limited mass range to be transmitted through the quadrupole. Ions outside this mass range will be filtered away and will not reach the exit end.

In a quadrupole mass spectrometer, ions transmitted through the quadrupole may be detected as ion signals via, for example, a channeltron detector. To produce a mass spectrum the quadrupole parameters are "scanned" and the ion signals are recorded as a function of the scan parameters. In the so-called "mass-selective stability" mode of operation the amplitudes of RF and DC voltages applied to the quadrupole rods are ramped at a constant RF/DC ratio. At each point in the ramp, ions of nominally a single m/z have a stable trajectory and are transmitted. Recording the ion signal as a function of the ramp thus yields a mass spectrum.

While in a quadrupole, ions will oscillate about the central axis with a resonant secular frequency. The resonant frequency of motion is dependent on the m/z of the ion and the amplitude and frequency of the RF waveform applied between the rods. As a result, ions of a selected m/z may be excited—that is the amplitude of the ion's oscillation about the central axis may be increased—by applying an additional AC waveform between the rods at the resonant frequency of the selected ions. If the amplitude of the ions' oscillations is increased enough, they will be ejected from the quadrupole.

A method taking advantage of this method of exciting ions' oscillations is described by Belov et al. in U.S. Pat. No. 6,787,760 (incorporated herein by reference). According to an example of the method disclosed by Belov, "non-selective ion trapping in [an] accumulation quadrupole occurs for a short period. Signal acquisition is performed using both an Odyssey data station and a 12-bit ADC coupled to a PC running ICR-2LS software available at the Pacific Northwest National Laboratory. Mass spectra acquired with the PC are converted to secular frequency spectra of ion oscillation in the selection quadrupole and a superposition of the sine auxiliary RF waveforms is applied to the selection quadrupole rods. Selective ion trapping in the accumulation quadrupole occurs for a period longer than that used in the non-selective accumulation. During the selective accumulation the most abundant ion species determined from the previous spectrum are ejected from the selection quadrupole prior to external accumulation. The combined information from the two mass spectra provides information over a much wider dynamic range than would be afforded by either spectrum alone."

However, the electric field used to excite the ions in prior art quadrupoles is heterogeneous. That is, ions at different locations in the quadrupole will experience a different excitation electric field strength. While this has a limited impact on the method described by Belov, it nonetheless may have an impact in the more general case. In general it is desirable to have a homogeneous excitation field wherein all ions of a given m/z are excited in the same way regardless of their position in the quadrupole.

As stated by Sakudo and Hayashi (N Sakudo and T. Hayashi, *Rev. Sci. Instrum.* 46(8), p. 1060 (1975).) "Quadrupole electrodes in mass filters and strong focusing lenses have usually been constructed in the form of circular rods or split circular concaves because of the difficulty of making ideal hyperbolic electrodes and aligning them in correct positions. Compared with these, quadrupole electrodes with flat faces are very easy to assemble in precisely symmetric positions due to the mechanical simplicity of spacing insulators." Rectangular cross section rods being easier to manufacture and assemble, are advantageous especially when constructing miniature quadrupole filters. Such miniature quadrupole filters are useful when filtering or mass analyzing ions at elevated pressures—i.e. at pressures greater than about $10^4$ mbar—or as part of portable instruments.

However, these so called "rectilinear" quadrupoles have the disadvantage that the electrodynamic fields in such devices deviate substantially from the ideal quadrupole field. As a result, the mass resolving power of such devices is much lower than that of other comparable prior art quadrupole filters.

The Paul ion trap (a.k.a. a quadrupole ion trap) is based on a similar principle and construction as the quadrupole filter, however, as the name implies, ions are trapped in the Paul trap before they are mass analyzed. Also unlike the quadrupole filter, the Paul trap is cylindrically symmetric. The Paul trap is constructed using three rotationally symmetric hyperbolic electrodes. Two "end cap" electrodes are placed one on either side of a central "ring electrode". Applying an RF potential between the ring electrode and the end caps forms a quadrupolar pseudopotential well in the interior volume of the trap. In a typical analysis ions enter the trap through apertures in one of the end caps, lose kinetic energy via collisions with gas in the trap and thereby become trapped in the pseudopotential well.

The quadrupole ion trap is typically operated in one of two modes—the mass selective instability mode or the resonance ejection mode. The mass selective instability mode differs from the mass selective stability mode described above in that ions are detected when their trajectories become unstable. Initially, a group of analyte ions is trapped near the center of the quadrupole ion trap. The ions will oscillate about the center of the trap with a frequency related to the m/z of the ion. When performing a mass selective instability scan, the amplitude of the RF potential applied to the ring electrode is ramped to higher values. At each point in the RF ramp, ions below a given m/z have unstable trajectory and are ejected from the trap. The given "cutoff" m/z is a linear function of the RF amplitude. Thus, recording the ion signal as a function of the ramp yields a mass spectrum.

A similar principle is applied when operating in the resonance ejection mode. However, in resonance ejection mode, an additional AC potential is applied between the end cap electrodes. The ions are excited not only by the RF as in selected ion instability mode but also by the supplemental AC. Therefore the ions are ejected more quickly from the trap—i.e. earlier in the ramp. Because ions are ejected from the trap at lower RF amplitudes, experiments using resonance ejection can be used to analyze higher m/z ions than can be achieved in mass selective instability experiments.

Many additional methods of manipulating ions in traps are known from the prior art including ion trapping, precursor isolation, CID, tandem mass spectrometry, ion-ion reactions, etc. Such methods may be applied, not only to the Paul trap as described above, but also to the other prior art trapping devices described below and to the present invention.

The cylindrical ion trap (CIT) is a simplified form of the Paul trap described above. The cylindrical ion trap is formed by a central cylinder instead of a hyperbolic ring electrode, and two flat plates instead of hyperbolic end caps. Because of its simplified construction—i.e. flat end caps and cylindrical ring electrode instead of hyperbolic surfaces—the CIT can more readily be miniaturized. However, the simplified geometry of the electrodes of the CIT also results in a lower mass resolving power than is possible with conventional Paul traps of similar inner diameter.

Yet another type of ion trap is the "linear ion trap". In principle, any type of multipole in which ions are trapped may be considered a linear ion trap, however, the device now commonly referred to as a linear ion trap can be used not only to trap ions but also to analyze them. As described by Schwartz et al. (J. C. Schwartz, M. W. Senko, and J. E. P. Syka, *J. Am. Soc. Mass Spectrom.* 13, 659(2002)) a linear ion trap includes two pairs of electrodes or rods, which contain ions by utilizing an RF quadrupole trapping field in two dimensions, while a non-quadrupole DC trapping field is used in the third dimension. Simple plate lenses at the ends of a quadrupole structure can provide the DC trapping field. This approach, however, allows ions which enter the region close to the plate lenses to be exposed to substantial fringe fields due to the ending of the RF quadrupole field. These non-linear fringe fields can cause radial or axial excitation which can result in loss of ions. In addition, the fringe fields can cause shifting of the ions' frequency of motion in both the radial and axial dimensions.

An improved electrode structure of a linear quadrupole ion trap which is known from the prior art includes two pairs of opposing electrodes or rods, the rods having a hyperbolic profile to substantially match the equipotential contours of the quadrupole RF fields desired within the structure. Each of the rods is cut into a main or central section and front and back sections. The two end sections differ in DC potential from the central section to form a "potential well" in the center to constrain ions axially. An aperture or slot allows trapped ions to be selectively resonantly ejected in a direction orthogonal to the axis in response to AC dipolar or quadrupolar electric fields applied to the rod pair containing the slotted electrode.

In prior art according to Song et al. (Y. Song, G. Wu, Q. Song, R. G. Cooks and Z. Ouyang, J. Am. Soc Mass Spectrom. 17, 631(2006) and U.S. Pat. No. 6,838,666 which is incorporated herein by reference), the hyperbolic rods of the conventional 2D linear ion trap were replaced by rectangular electrodes. This design is now known as a rectilinear ion trap (RIT). According to Song et al. the trapping volume is defined by x and y pairs of spaced flat or plate RF electrodes in the zx and zy planes. Ions are trapped in the z direction by DC voltages applied to spaced flat or plate end electrodes in the xy plane disposed at the ends of the volume defined by the x, y pair of plates, or by DC voltages applied together with RF in front and back sections, each comprising pairs of flat or plate electrodes. In addition to the RF sections flat or plate end electrodes can be added. The ions are trapped in the x, y direction by the quadrupolar RF fields generated by the RF voltages applied to the plates. Ions can be ejected along the z axis through apertures formed in the end electrodes or along the x or y axis through apertures formed in the x or y electrodes. The ion trap is generally operated with the assistance of a buffer gas. Thus, when ions are injected into the ion trap they lose kinetic energy by collision with the buffer gas and are trapped by the DC potential well. While the ions are trapped by the application of RF trapping voltages, AC and other waveforms can be applied to the electrodes to facilitate isolation or excitation of ions in a mass selective fashion. To perform an axial ejection scan, the RF amplitude is scanned while an AC voltage is applied to the end plates. Axial ejection depends on the same principles that control axial ejection from a linear trap with round rod electrodes (U.S. Pat. No. 6,177,668). In order to perform an orthogonal ion ejection scan, the RF amplitude is scanned and the AC voltage is applied on the set of electrodes which include an aperture. The AC amplitude can be scanned to facilitate ejection. Circuits for applying and controlling the RF, AC and DC voltages are well known.

The addition of the front and back RF sections to the RIT also helps to generate a uniform RF field for the center section. The DC voltages applied on the three sections establish the DC trapping potential and the ions are trapped in the center section, where various processes are performed on the ions.

The most significant advantage of the RIT over the LIT is that of fabrication. The electrodes composing the RIT, being flat surfaces, are much easier to produce, with precision, than the hyperbolic surfaces of the LIT. As a result, the RIT can be more readily miniaturized than the LIT and can be more readily incorporated into portable instruments. However, because the electrodes comprising the RIT are rectilinear, they form a non-ideal field. As a result, the performance—namely mass resolving power—of the RIT is poor compared to other prior art linear ion traps.

As described above, many types of analyzers, each with their own advantages and limitations may be used to mass analyze sample ions. Time-of-flight (TOF) mass analyzers have the particular advantage of speed—i.e. speed of analysis. There are several variations of prior art TOF mass analyzer. Among these are axial TOF, orthogonal TOF, and trap-TOF analyzers. These three types of TOF analyzers differ in the way the ions are introduced into the acceleration region and how the ions are accelerated.

Many techniques and ion optics well known in the prior art can be used with any of these analyzers. Among these are delayed extraction (aka space velocity correlated focusing), space focusing, energy focusing, reflectrons, multipass analyzer design, lenses, collision cells, deflectors, etc. Delayed extraction has been described extensively in technical and patent literature—for example by Reilly et al. in U.S. Pat. No. 5,504,326. Space and energy focusing as it relates to TOF analyzers was detailed by Wiley and McLaren (Wiley, W. C.; McLaren, I. H., Rev. Sci. Instrumen. 26 1150 (1955)). The reflectron (or ion mirror) was first described by Mamyrin (Mamyrin, B. A.; Karatajev. V. J.; Shmikk, D. V.; Zagulin, V. A., Soy. Phys., JETP 37 (1973) 45). Each of these techniques is intended to improve the mass resolution of TOF analyzers. Multipass analyzer designs have also been detailed extensively in the literature, however, as an example, Cotter et al. in U.S. Pat. No. 5,202,563 detail a dual reflection TOF analyzer. Any of the above mentioned prior art techniques and ion optics may be used in conjunction with the abridged trap-TOF according to the present invention.

In an axial TOF, ions are typically produced as a pulse of ions—e.g. by laser desorption, laser ionization, charged particle impact, etc.—directly in the acceleration region. The ions are then accelerated by a pre-existing electric field—i.e. the field is already established before the ions are produced, or an accelerating electric field is established a short time—typically less than a few hundred microseconds—after the ions are produced. Examples of prior art axial TOF analyzers are described in U.S. Pat. Nos. 5,504,326, 5,625,184, 5,760, 393, 6,541,765, 5,641,959, 5,969,348, and 5,654,545 incorporated herein by reference. Axial TOF mass spectrometers are typically used in conjunction with pulsed ion sources and have the advantage of simplicity as compared to the orthogonal TOF or trap-TOF instruments. However, axial TOF analyzers are not efficiently coupled with continuous ions sources. Furthermore, because the ions often have a substantial spatial and energy distribution, a precision mass calibration function is frequently complex.

In an orthogonal TOF, ions are typically produced in an ion source outside of the accelerator—e.g. by electrospray ionization, elevated or atmospheric pressure MALDI, or other atmospheric pressure ionization technique. Ions are injected into the accelerator in a direction orthogonal to the axis of the accelerator. During ion injection, the accelerating electrodes are held at or near ground potential. Once the accelerator is filled, the accelerating electrodes are pulsed to a high voltage thereby establishing an accelerating electric field. Ions are accelerated orthogonal to their original direction of motion—i.e. the "axial" motion the ions have during injection—however, the original axial kinetic energy of the ions is not eliminated during the acceleration. The vector sum of the original axial motion and orthogonal motion after acceleration cause the ions to follow a V shaped trajectory through the TOF analyzer. Examples of prior art orthogonal TOF analyzers are described in U.S. Pat. Nos. 5,117,107, and 6,107,625, both incorporated herein by reference and by Morris in (H. R. Morris et al., High Sensitivity Collisionally-Activated Decomposition Tandem Mass Spectrometry on a Novel Quadrupole/Orthogonal-acceleration Time-of-Flight Mass Spectrometer, Rapid Commun. Mass Spectrom. 10, 889 (1996)).

The orthogonal TOF analyzer is generally used in conjunction with ion sources that produce continuous or semi-continuous ion beams because it is much more efficient in forming and accelerating ion packets into the TOF analyzer. Furthermore, the mass calibration function of an orthogonal TOF analyzer is typically simpler than that of an axial TOF analyzer. However, the rectangular shape of the ion packets and the V trajectory the ions follow in the orthogonal TOF analyzer complicates the design and construction of these instruments in comparison to axial TOF analyzers.

Trap-TOF analyzers are distinguished from axial and orthogonal TOF analyzers in that the trap-TOF analyzers use an RF ion trap as part of the ion accelerator. The ion trap consists of electrodes between which an RF potential is applied. The shape and placement of the electrodes and the RF potential applied between them results in an electrodynamic trapping field. Ions—produced either externally or internally to the trap—are first trapped and cooled by gas collisions in the RF ion trap. Then the RF potential is turned off—i.e. set to zero or near zero volts—and an accelerating field is applied between the electrodes of the trap. This initiates the TOF analysis. The field accelerates the ions out of the trap along the TOF axis. Once out of the trap, the ions may be further accelerated.

In one prior art design, Qian et al. (M. G. Qian, and D. M. Lubman, "Procedures for Tandem Mass Spectrometry on an Ion Trap Storage/Reflectron Time-of-flight Mass Spectrometer", *Rapid Comm. In Mass Spectrom.* 10, 1911(1996)) describe a trap-TOF mass spectrometer which comprises a Paul trap and an ESI source. Furthermore, Qian describe how to perform tandem MS experiments by using the trap to isolate ions of interest and produce fragment ions from the ions of interest before TOF mass analysis. In a similar prior art design Tanaka et al. (Koichi Tanaka, Eizoh Kawatoh, Li Ding, Alan Smith and Sumio Kumashiro, "A MALDI-Quadrupole Ion Trap-TOF Mass Spectrometer", Proceedings of the 47$^{th}$ ASMS Conference on Mass Spectrometry and Allied Topics, 1999) describe a trap-TOF mass spectrometer incorporating a Paul trap and a MALDI ion source external to the trap. In U.S. Pat. No. 5,763,878, incorporated herein by reference, Franzen describes a trap-TOF mass analyzer comprised of a linear ion trap and an ESI source of ions. According to Franzen, one method "consists of first introducing the ions into a multipole rod arrangement with extended pole rods which stretches orthogonally to the flight direction of the ions in the time-of-flight spectrometer, and then outpulsing the ions by means of a rapid change of the electrical field, perpendicular to the rod direction, through the intermediate space between two rods. The multipole arrangement can take the form of an ion storage device by fitting reflectors to the ends. The multipole arrangement can be filled with the aid of another multipole arrangement which takes the form of an ion guide. Damping of the ion oscillations with the aid of a collision gas leads to a collection of ions in a very thin thread on the axis of the multipole arrangement, providing the time-of-flight spectrometer with an excellent mass resolving power due to the uniform initial energy and low energy spread of the ions." In one embodiment, the multipole ion trap takes the form of a quadrupole having an RF potential applied between its rods.

Trap-TOF analyzers have the advantage that they can be made compatible with both pulsed and continuous ion sources. Also, the ions in a trap-TOF have no "axial" kinetic energy, thus, the trap-TOF analyzer optics are simplified in comparison to that of an orthogonal TOF analyzer. However, prior art trap-TOF analyzers have the disadvantage that the trap electrodes are not able to produce both an RF trapping field and a homogeneous accelerating field. This leads to distortions in the flight time of the ions through the analyzer and therefore a loss in mass resolution. Furthermore, the strength of the accelerating field is typically significantly lower than that used in an orthogonal TOF again leading to a reduced resolution.

SUMMARY

In accordance with one embodiment of the invention, a multipole is composed of a set of electrode structures arranged rectilinearly and symmetrically about a central axis and electrically connected so as to form an abridged multipole field when a proper potential is applied between the electrodes. The electrode structures are extended parallel to the central axis, however, when the multipole is viewed in cross section, the electrode structures are each comprised of a plurality of electrodes arranged along a multitude of stacked lines, symmetrically about the central axis. An RF potential is applied between the electrodes and within a given line of electrodes, the potential applied to the electrodes is a linear function of the position of the electrode along the line. The abridged RF multipole field thus formed focuses ions toward the central axis and thereby guides ions from an entrance end of the abridged multipole to its exit end.

In alternate embodiments, the electrodes arranged along a given line are connected via a series of resistors and/or capacitors of substantially equal resistance and capacitance respectively.

In further alternate embodiments, the RF potential is applied only at the intersections of the lines of electrodes and from there is divided via the RC network among the electrodes.

In still further alternate embodiments, the electrodes and/or the resistive and/or the capacitive components are formed by the deposition of resistive and/or conductive material on insulating rectilinear rods or plates. In other alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with another embodiment of the invention, a multipole is constructed according to the embodiments set forth above so that, when the multipole is viewed in cross section, the electrodes are arranged along four lines positioned symmetrically about the central axis and form a rectangle.

In accordance with one embodiment of the invention, a method is provided whereby a homogeneous electrostatic field is generated within an abridged quadrupole wherein the DC potentials are applied only at the intersections of the lines of electrodes and from there is divided via an RC network among the electrodes. A first DC potential is applied to adjacent intersections—i.e. to opposite ends of one line of electrodes—and a second DC potential is applied to the remaining two intersections—i.e. to the opposite ends of a second line of electrodes parallel to but on the opposite side of the central axis from the first set of electrodes. The electrodes in the first line of electrodes will all have the first DC potential. The electrodes in the second line of electrodes will all have the second DC potential. The potentials on the electrodes of the remaining two lines of electrodes will be governed by the RC network connecting the electrodes to the first and second lines of electrodes. Given that the RC network comprises resistors all having the same resistance and capacitors all having the same capacitance, the potential difference between the first and second DC potentials will be divided evenly between the electrodes of the remaining two lines of electrodes and the electric field formed in the abridged quadrupole will therefore be uniform. That is, unlike prior art quadrupoles, the DC field in the abridged quadrupole can be formed homogeneously such that the force exerted on ions via the DC field is not a function of the position of the ion in the abridged quadrupole. With the application of the appropriate DC potentials at the intersections of the lines of electrodes, a uniform electrostatic field having field lines of any desired magnitude pointing in any desired direction orthogonal to the central axis can be formed.

The application of such a uniform DC field effectively shifts the axis about which ions will oscillate when passing through the abridged quadrupole. Higher m/z ions will tend to oscillate about an axis further from the central axis than lower m/z ions when the DC field is applied.

In accordance with a further embodiment of the invention, a method is provided whereby a homogeneous electrodynamic field is generated within an abridged quadrupole according to the present invention wherein AC potentials are applied only at the intersections of the lines of electrodes and from there is divided via an RC network among the electrodes. A first AC potential is applied to adjacent intersections—i.e. to opposite ends of one line of electrodes—and a second AC potential is applied to the remaining two intersections—i.e. to the opposite ends of a second line of electrodes parallel to but on the opposite side of the central axis from the first set of electrodes. The electrodes in the first line of electrodes will all have the first AC potential. The electrodes in the second line of electrodes will all have the second AC potential. The potentials on the electrodes of the remaining two lines of electrodes will be governed by the RC network connecting the electrodes to the first and second lines of electrodes. Given that the RC network comprises resistors all having the same resistance and capacitors all having the same capacitance, the potential difference between the first and second AC potentials will be divided evenly between the electrodes of the remaining two lines of electrodes and the electric field formed in the abridged quadrupole will therefore be uniform. That is, unlike prior art quadrupoles, the AC field in the abridged quadrupole can be formed homogeneously such that the force exerted on ions via the AC field is not a function of the position of the ion in the abridged quadrupole. With the application of the appropriate AC potentials at the intersections of the lines of electrodes, a uniform electrostatic field having field lines of any desired magnitude pointing in any desired direction orthogonal to the central axis can be formed. With the application of the appropriate AC potentials at the intersections of the lines of electrodes, a rotating uniform electric field having field lines of any desired magnitude rotating in a plane orthogonal to the central axis can be formed. By applying the AC potentials at a predetermined frequency or set of frequencies, the AC field may be used to resonantly excite ions of one or more selected m/z's or m/z ranges.

In accordance with a further embodiment of the invention, an apparatus and method are provided for a multipole composed of a set of electrodes arranged rectilinearly and symmetrically about a central axis and electrically connected so as to form a multiple frequency multipole field when a proper potential is applied between the electrodes. The electrodes are extended parallel to the central axis; however, when the multipole is viewed in cross section, the electrodes are arranged along four lines, symmetrically about the central axis and form a rectangle. An RF potential is applied between the electrodes. Within a given line of electrodes, the potential applied to the electrodes is a function of time and the position of the electrode along the line. This function takes the form of $$\Phi(y, t) = \sum_{i=1}^{j} g_i(y) h_i(t)$$

where y is electrode position, g(y) is a periodic function of position, and h(t) is a periodic function of time. The abridged RF multiple frequency multipole field thus formed focuses ions toward the central axis and thereby guides ions from an entrance end of the abridged RF multiple frequency multipole to its exit end. The effect of applying a potential of this form to the electrodes is to produce an RF field having a substantially multipole—for example, quadrupolar—nature near the central axis and having a significant dipolar nature near the electrodes. The quadrupolar component of the field will tend to confine lower m/z ions to the central axis whereas the higher m/z ions approaching the electrodes will be reflected towards the central axis by the lower frequency dipole field. Unlike prior art multiple frequency multipoles, ions are confined solely by the action of the RF fields. No DC trapping electrodes are required to reflect high m/z ions at the gap between electrodes.

In alternate embodiment methods, the amplitude of the dipole waveform may be set arbitrarily close to zero. Further, a destabilizing DC potential may be applied to the electrodes so as to filter ions in a manner analogous to prior art quadrupole filters. Further, mass spectra may be obtained by scanning the amplitude of the quadrupolar waveform together with the destabilizing DC and recording the intensity of the transmitted ion beam as a function of the waveform amplitude. In further alternate embodiments, the electrodes and/or resistive and/or capacitive components comprising the abridged multiple frequency multipole are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with a further embodiment of the invention, a method is provided whereby ions are filtered by mass selective stability within an abridged quadrupole. According to this method, RF and DC potentials are applied only at the intersections of the lines of electrodes and from there are divided via an RC network among the electrodes. To form the abridged RF quadrupolar field an RF potential is applied between adjacent intersections. That is, at any given intersection, an RF potential is applied. The same RF potential, but 180° out of phase, is applied at adjacent intersections. Similarly, the destabilizing DC field is formed by applying a DC potential between adjacent intersections. At any given intersection, a DC potential is applied. The same magnitude DC potential but of opposite polarity is applied at adjacent intersections. Ions of a single m/z or narrow range of m/z will be stable in an abridged quadrupole when an RF of a given frequency and amplitude and a DC of a given amplitude are applied. The trajectories of other ions will be unstable and these ions will be ejected radially from the abridged quadrupole or will collide with the electrodes. Mass spectra may be obtained by scanning the amplitude of the RF waveform together with the destabilizing DC and recording the intensity of the transmitted ion beam as a function of the waveform amplitude. In an alternate embodiment, gaps may be left in the array of electrodes in the locations where the lines of electrodes would otherwise intersect. Under appropriate conditions, all or some fraction of the ions destabilized by the combination of the RF and DC potentials will be ejected through the gaps left at the intersections of the lines of electrodes. Ions of low m/z will be ejected through two gaps on opposing sides of the abridged quadrupole. Ions of high m/z will be ejected in a direction orthogonal to the low m/z ions, through the two remaining gaps. Ejected ions may be detected via an ion detector or recaptured via another ion optical device for further analysis. In further alternate embodiments, the electrodes and/or resistive and/or capacitive components comprising the abridged quadrupole are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with a further embodiment of the invention, an apparatus and method are provided for a multipole composed of a set of electrodes arranged rectilinearly and symmetrically about a central axis and electrically connected so as to form an abridged quadrupole field when a proper potential is applied between the electrodes. The electrodes are extended parallel to the central axis, however, when the multipole is viewed in cross section, the electrodes are arranged along two parallel lines, on opposite sides of, and equidistant from, the central axis. The extent of the lines of electrodes is preferably greater than the distance between the central axis and the lines of electrodes at their closest approach. An RF potential is applied between the electrodes. Within a given line of electrodes, the potential applied to the electrodes is a linear function of the position of the electrode along the line. The abridged RF quadrupole field thus formed focuses ions toward the central axis and thereby guides ions from an entrance end of the abridged quadrupole to its exit end. In alternate embodiments, the electrodes arranged along a given line are connected via a series of resistors and/or capacitors of substantially equal resistance and capacitance respectively. In further alternate embodiments, the RF potential is applied only at the extents of the lines of electrodes and from there is divided via the RC network among the electrodes. In further alternate embodiments, the electrodes and/or the resistive and/or the capacitive components are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste. In alternate embodiment methods, a destabilizing DC potential may be applied to the electrodes so as to filter ions in a manner analogous to prior art quadrupole filters. Further, mass spectra may be obtained by scanning the amplitude of the RF waveform together with the destabilizing DC and recording the intensity of the transmitted ion beam as a function of the waveform amplitude. In further embodiments, a homogeneous electrostatic field may be formed by applying appropriate DC potentials at the extents of the lines of electrodes. In further embodiments, a supplemental AC potential may be applied to the abridged quadrupole in order to excite ions of selected m/z ratios or ranges of m/z ratios. In one embodiment, the AC potential is applied so as to excite ions in a direction parallel to the lines of electrodes. Sufficiently excited ions may be ejected from the abridged quadrupole in a direction parallel to the line of electrodes and without the ion colliding with an electrode. In further alternate embodiments, the two parallel lines of electrodes are positioned arbitrarily close to each other so as to form a substantially one dimensional abridged quadrupolar field. That is, the field of the abridged quadrupole according to such an embodiment is quadrupolar in nature in two dimensions, but has a significantly greater extent in one dimension—i.e. parallel to the lines of electrodes—than the other—i.e. perpendicular to the line of electrodes. In further embodiments, the two parallel lines of electrodes are brought sufficiently close to one another—i.e. about 1 mm or less—so as to form a miniature abridged quadrupole. In further alternate embodiments, by appropriate connections between electrodes within each of the two lines of electrodes, an array of miniature abridged quadrupoles is formed.

According to another embodiment, an apparatus and method are provided for guiding ions between pumping stages. An abridged multipole, together with its electrically insulating support and electrodes either deposited on or positioned in between insulating layers, acts as a restriction between pumping stages. The abridged multipole has an entrance end in one pumping stage and an exit end in a second pumping stage. Ions are guided from the entrance end in the first pumping stage to the exit end in the second pumping stage via the confining RF field of the multipole. The abridged multipole may be any length along the central axis. In alternate embodiments, the abridged multipole is arbitrarily short and thus takes the form of a plate with an aperture in it. Unlike prior art multipoles, an abridged multipole according to the present invention does not require large slots between the electrodes in the insulating support and therefore can form a superior pumping restriction. Furthermore, an abridged multipole according to the present invention can more readily be constructed with a small inscribed diameter than prior art multipoles. In alternate embodiments the abridged multipole may have a different inscribed diameter at the entrance end than at the exit end. For example, the abridged multipole may have a larger inscribed diameter at the entrance end than at the exit end. This may allow the abridged multipole to collect ions efficiently at the entrance end and focus them down to a tighter beam at the exit end.

According to another embodiment, an apparatus and method are provided for a mass spectrometer comprising at least a source of ions wherein analyte material is formed into ions, an abridged multipole for guiding and/or analyzing ions, and a detector with which ions may be detected. The abridged multipole may be an abridged quadrupole and may be used to filter ions and, by scanning, may be used to produce a mass spectrum. The mass spectrometer may include more than one abridged multipole, said multipoles performing a multitude of functions including guiding ions within or between pumping stages, selecting ions according to their m/z, acting as a collision cell, transmitting ions to downstream analyzers. Alternatively, the mass spectrometer may be a hybrid instrument including an orthogonal TOF analyzer, an FTICR mass analyzer, a prior art quadrupole filter, a quadrupole trap, a linear ion trap, an orbitrap, or any other known mass analyzer. The abridged multipole according to the present invention may be used in conjunction with prior art analyzers to accomplish any combination of tandem ion mobility—mass spectrometry or tandem mass spectrometry experiments known in the prior art in any desired order.

According to another embodiment, an apparatus and method are provided for guiding, trapping, and analyzing ions. According to this embodiment, the apparatus includes an abridged quadrupole, lens elements at either end of said abridged quadrupole, and/or pre and postfilters at either end of said abridged quadrupole. An RF potential applied to the abridged quadrupole, prefilter, and postfilter confines ions radially to the axis of the apparatus. An appropriate DC gradient will cause ions to move along the axis from an entrance end of the apparatus to an exit end of the apparatus. Thus, the apparatus guides ions from an entrance end to an exit end. Alternatively, a DC bias is applied to the abridged quadrupole such that ions are selected based on their mass-to-charge ratio. Selected ions are transmitted from an entrance end to an exit end. Alternatively, DC potentials are applied to the apparatus such that ions are confined axially by the resulting axial DC field and radially by the above mentioned RF potential. In this way, the apparatus according to the present embodiment may be used as an abridged linear ion trap. Ions thus trapped may be selectively ejected via an excitation waveform applied to the abridged quadrupole. Furthermore, the use of an appropriately constructed excitation waveform allows for the ejection of all but selected ions from the abridged quadrupole. Ions isolated in the abridged quadrupole trap in this way may be excited and dissociated to form fragment ions. By mass analyzing the fragment ions and remaining precursor ions, MS/MS spectra may be produced. Extending this method, $MS^n$ spectra may also be produced.

According to another embodiment, an apparatus and method are provided for a mass spectrometer comprising at least a source of ions wherein analyte material is formed into ions, an abridged linear ion trap for guiding, trapping, reacting, and/or analyzing ions, and a detector with which ions may be detected. The abridged linear ion trap may include an abridged quadrupole, or alternatively a higher order abridged multipole, and may be used to filter ions and, by scanning, may be used to produce a mass spectrum. The mass spectrometer may include more than one abridged multipole, said multipoles performing a multitude of functions including guiding ions within or between pumping stages, trapping ions, selecting ions according to their m/z, acting as a collision cell, transmitting ions to downstream analyzers. Alternatively, the mass spectrometer may be a hybrid instrument including an orthogonal TOF analyzer, an FTICR mass analyzer, a prior art quadrupole filter, a quadrupole trap, a linear ion trap, an orbitrap, or any other known mass analyzer. The abridged multipole according to the present invention may be used in conjunction with prior art analyzers to accomplish any combination of tandem ion mobility—mass spectrometry or tandem mass spectrometry experiments known in the prior art in any desired order.

In accordance with a further embodiment of the invention, an apparatus and method are provided for an abridged Paul trap composed of a set of electrodes arranged in a cylindrically symmetric manner about a central axis and electrically connected so as to form an abridged three dimensional quadrupole field when a proper potential is applied between the electrodes. In one embodiment, the abridged Paul trap consists of a set of metal rings having varying inner diameters, bound by baseplates having apertures through which ions may enter and exit the trap. The inner radius, r, and placement of the metal rings along the central axis—i.e. the z-axis—follows the form, $r=mz+r_o$. An RF potential is applied between the metal rings—the potential applied being a linear function of the position along the z-axis. The abridged RF quadrupole field thus formed focuses ions toward the abridged Paul trap. In alternate embodiments, the electrodes arranged along a given line are connected via a series of resistors and/or capacitors of substantially equal resistance and capacitance respectively. In further alternate embodiments, the RF potential is applied only at the central metal ring (i.e. where z=0) and the baseplates and from there is divided via the RC network among the remaining metal rings. In further alternate embodiments, the metal rings and/or the resistive and/or the capacitive components are formed by the deposition of resistive and/or conductive material on insulating rectilinear rods or plates. In further alternate embodiments, the insulating rods or plates are comprised of macor or ceramic. In further alternate embodiments, the electrodes deposited on the insulating plates are electrically connected and adjacent plates are simultaneously mechanically connected via a thin film of solder paste.

In accordance with a further embodiment of the invention, an apparatus and method are provided for an abridged linear ion trap time of flight mass spectrometer comprised of at least an abridged linear ion trap, a drift region, and an ion detector. According to one method of operation, ions are injected into the abridged trap along a central axis. An RF potential applied to the abridged trap produces an RF multipole field therein which radially confines the ions while DC potentials applied to elements at either end of the trap prevent the ions from escaping along the central axis. A time-of-flight mass analysis is initiated by discontinuing the RF and applying a pulsed DC potential to the abridged trap so as to produce a homogeneous dipolar accelerating field which ejects the ions in a direction orthogonal to the central axis. The ions move through the drift region with kinetic energies as imparted on the ions by the dipolar accelerating field. At the end of the drift region the ions strike the detector inducing a signal.

In some alternate embodiments, the abridged linear ion trap may consist of four sets of closely spaced wires spaced about the central axis. In further alternate embodiments, the abridged linear ion trap may consist of two sets of closely spaced wires positioned on opposite sides of the central axis. In alternate embodiments, the abridged trap TOF includes an additional stage of ion acceleration following the initial acceleration of the ions out of the abridged trap. In alternate embodiments, the abridged trap TOF includes one or more reflectrons for reflecting and time focusing the ions. In alternate embodiments, the abridged trap TOF includes collision cells, ion lenses, and/or ion deflectors. The RF potential applied to the abridged trap may follow any periodic function—i.e. sine wave, triangle wave, square wave etc. In further alternate embodiments, the phase in the RF cycle at the time that the application of the RF potential is discontinued is selected to minimize the ion's kinetic energy due to micromotion. In further alternate embodiments the phase is selected to be a multiple of $\pi$—i.e. that time at which the RF waveform is at its maximum.

In further alternate embodiments, the abridged trap is enclosed so as to restrict the flow of gas from inside the abridged trap into the drift region. In further alternate embodiments, gas is introduced into the abridged trap so as to cool the ions via collisions with the gas. Under the influence of the RF multipole field ions are cooled into a thin line at or near the central axis resulting in an improved TOF resolution. The frequency and amplitude of the RF waveform may be selected to optimize the TOF resolution achieved for ions of a specific mass or mass range.

In further alternate embodiments, a delay is introduced between the discontinuance of the RF multipole field and the application of the accelerating dipole field. The introduced delay establishes a space-velocity correlation which in turn improves the TOF mass resolution. Further, the rising edge of the accelerating dipole field may have a long time constant such that the space-velocity correlation focusing occurs over a broad mass range.

In still further alternate embodiments, a sample holder may be placed adjacent to the abridged trap and a laser may be used to induce matrix assisted laser desorption ionization on the samples thereon. In such an embodiment, no RF potential is applied to the abridged trap. Rather only a homogeneous accelerating dipole field is produced in the trap. This together with a potential on the sample holder allows conventional "axial" MALDI experiment to be performed in the same instrument as trap-TOF experiments.

In further alternate embodiments, MS/MS or $MS^n$ experiments may be performed an abridged trap-TOF mass spectrometer according to the present invention. Accordingly, ions are trapped in the abridged trap. Ions are then isolated either via an excitation waveform or via a selected ion stability experiment. Selected ions are excited into motion with an excitation waveform and caused to have energetic collisions with gas molecules. By the energetic collision, the ions are activated towards dissociation. In alternate embodiments, selected ions are caused to react with reagent ions—e.g. electron transfer dissociation reagents—so as to produce fragment or product ions. Product and remaining precursor ions are then cooled to the central axis via collisions with gas molecules. The process of selection, dissociation or reaction, and cooling may be repeated multiple times so as to produce $n^{th}$ generation product ions. Finally, the product ions and remaining precursor ions are accelerated out of the abridged trap via a homogeneous dipole accelerating field and mass analyzed by time of flight to produce an $MS^n$ spectrum.

BRIEF DESCRIPTION OF THE DRAWINGS

For a more complete understanding of the present invention, reference is now made to the following drawings in which:

FIG. 12A shows an end view of an alternate embodiment device which includes lens elements adjacent to either end of an abridged quadrupole;

FIG. 12B is a side view of an alternate embodiment device which includes lens elements adjacent to either end of an abridged quadrupole;

FIG. 12C shows a cross-sectional view, taken at line "A-A" in FIG. 12B, of an alternate embodiment device which includes lens elements adjacent to either end of an abridged quadrupole;

FIG. 13A shows an end view of an alternate embodiment device which includes lens elements and a pre/postfilter adjacent to either end of an abridged quadrupole;

FIG. 13B is a side view of an alternate embodiment device which includes lens elements and a pre/postfilter adjacent to either end of an abridged quadrupole;

FIG. 13C shows a cross-sectional view, taken at line "A-A" in FIG. 13B, of an alternate embodiment device which includes lens elements and a pre/postfilter adjacent to either end of an abridged quadrupole;

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

As discussed above, the present invention relates generally to the mass spectroscopic analysis of chemical samples and more particularly to mass spectrometry. Specifically, an apparatus and method are described for the transport and mass spectrometric analysis of analyte ions. Reference is herein made to the figures, wherein the numerals representing particular parts are consistently used throughout the figures and accompanying discussion.

Prior art quadrupoles are typically comprised of four electrically conducting rods placed symmetrically about a central axis. It is well known that the equation for an ideal quadrupolar field formed in such a device can be expressed as:

$$\Phi(t) = \frac{\Phi_o(t)\cdot(x'^2 - y'^2)}{2r_o'^2} \tag{1}$$

where $\Phi(t)$ is the potential at point (x', y'), $\Phi_o(t)$ is the potential between the electrodes defining the field, and $2r'_o$ is the minimum distance between opposite electrodes.

In an ideal construction, the surfaces of the electrodes fall on equipotential lines of the quadrupole field. That is, the surfaces of the electrodes fall on hyperbolic curves defined by:

$$x'^2 = r'^2_o + y'^2 \tag{2}$$

In this construction the electrodes, i.e. the rods, are extended parallel to the z-axis, the z-axis is orthogonal to the x'-y' plane, the z-axis is the central axis of the device and the potential applied between the electrodes, $\Phi_o(t)$, is a function of time. It is well-known that the so-called "pseudopotential" well produced via such a quadrupolar field is cylindrically symmetric. Surprisingly, the present inventor has discovered that specific lines can be chosen within a quadrupolar field such that, along these lines, the change of the potential, $\Phi(t)$, is a linear function of position.

To demonstrate this, assume that y' is a linear function of x'. That is:

$$y' = mx' + b, \tag{3}$$

where m is the slope of the selected line and b is the y'-intercept. Then equation (1) becomes:

$$\Phi(t) = \frac{\Phi_o(t)\cdot(x'^2 - (mx' + b)^2)}{2r_o'^2} \tag{4}$$

or, expanding $$\Phi(t) = \frac{\Phi_o(t)\cdot(x'^2 - m^2x'^2 - 2mx'b - b^2)}{2r_o'^2} \tag{5}$$

If m=+/−1 then:

$$\Phi(t) = \frac{-\Phi_o(t)\cdot(2mx'b + b^2)}{2r_o'^2} \tag{6}$$

which clearly is a linear function of x'. The implication is that a quadrupolar field may be produced using a rectilinear array of electrodes spaced at intervals along lines selected in accordance with equation (3) and having applied thereto potentials having a linear variation as a function of position in accordance with equation (6).

Figure 1A:
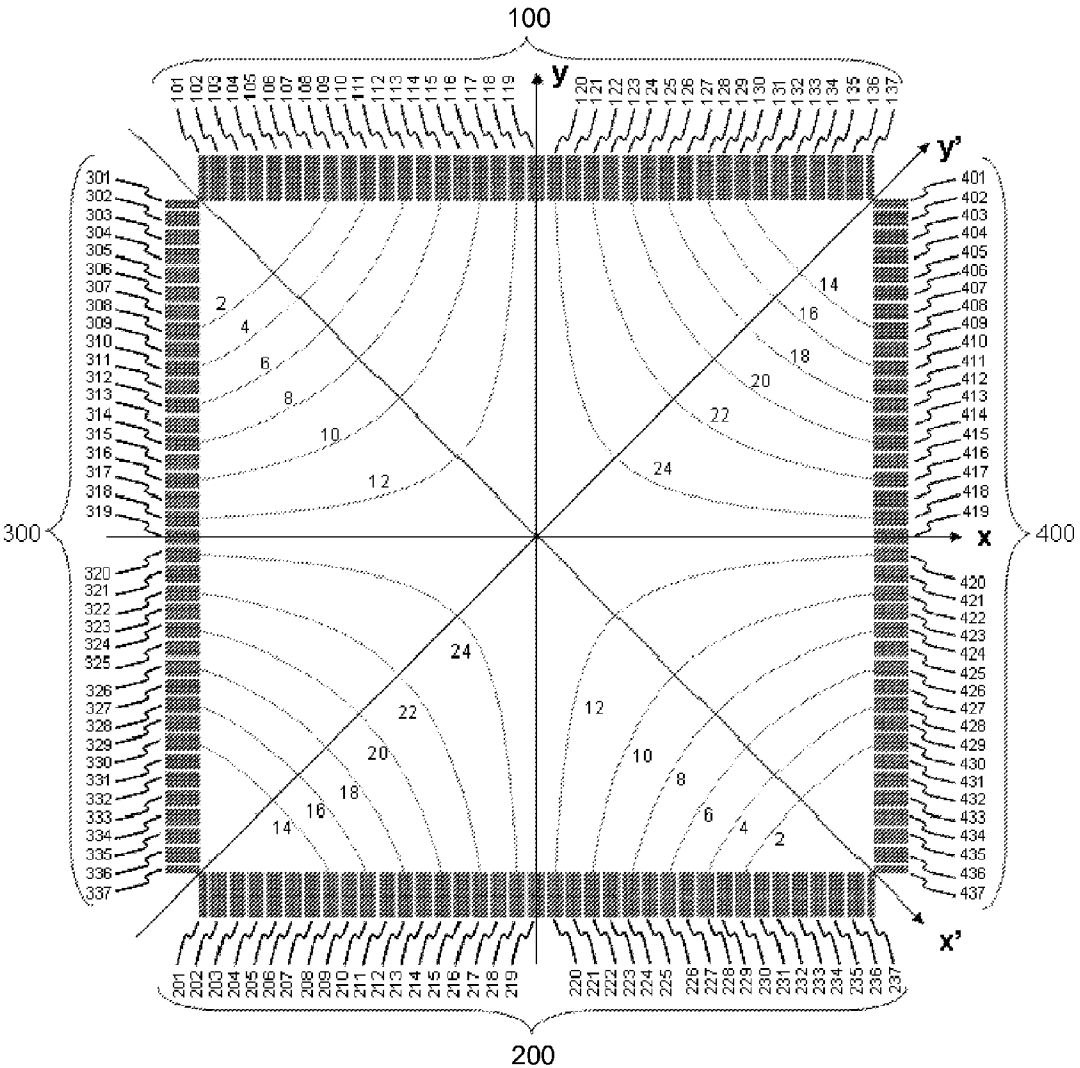
FIG. 1A is a cross-sectional view of an abridged quadrupole according to the present invention and equipotential lines calculated to be formed during operation.

FIG. 1A depicts a cross sectional view of an abridged quadrupole 1 constructed according to the present invention. Here the y'-intercept, b, has been chosen to equal $+/-r'_o$. In this case, equation (6) reduces to:

$$\Phi(t) = -\Phi_o(t)(½ + x'/r'_o) \text{ for } -r_o' \le x' \le 0; \text{ and} \tag{7a}$$

$$\Phi(t) = -\Phi_o(t)(½ - x'/r'_o) \text{ for } 0 \le x' \le r_o'. \tag{7b}$$

For convenience, new axes, x and y, are defined in FIG. 1 rotated 45 degrees from the x', y' coordinate system. In this new coordinate system:

$$\Phi(t) = \frac{-\Phi_o(t)\cdot x\cdot y}{2r_o^2} \tag{8}$$

and the inner surfaces of electrode set 100—comprised of electrodes 101 through 137—and electrode set 200—comprised of electrodes 201 through 237—fall on the lines:

$$y = +/-r_o, \tag{9}$$

whereas those of electrodes set 300 and 400—comprised of electrodes 301-337 and 401-437 respectively—fall on the lines:

$$x = +/-r_o. \tag{10}$$

These lines, and therefore electrode sets 100, 200, 300, and 400, are placed symmetrically about the central axis—i.e. the z-axis—and electrodes 101-137, 201-237, 301-337, and 401-437 are extended parallel to the z-axis—i.e. into the page—for the length of the device. Also, whereas $2r'_o$ is the minimum distance between opposite electrodes along the x' or y' axes, $2r_o$ is the minimum distance between opposite electrodes along the x or y axes. It should be understood that a wide range of dimensions may be chosen for abridged quadrupole 1 of the present invention, however, in the example depicted in FIG. 1, $r_o$ was chosen to be 1.8 mm. Each electrode 102-136, 202-236, 302-336, and 402-436 is 0.08 mm wide. Electrodes 101, 137, 201, 237, 301, 337, 401, and 437 are 0.04 mm wide. The gap separating adjacent electrodes 101-137, 201-237, 301-337, and 401-437 is 0.02 mm wide. Thus, the center-to-center distance between adjacent electrodes 101-137, 201-237, 301-337, and 401-437 is 0.1 mm.

It should be understood that a wide range of potentials may be applied between the electrodes of abridged quadrupole 1, however, as an example, $\Phi_o(t)$ is chosen here to equal 360V. For any given electrode set 100, 200, 300, or 400, the potential $\Phi_o(t)$ is applied across the electrode set. Thus, in accordance with equation (8), the potential applied to electrodes 137, 401, 201, and 337 equals $-\Phi_o(t)/2$ which is −180V. Similarly, +180V is applied to electrodes 101, 301, 437, and 237. The potentials on remaining electrodes 102-136, 202-236, 302-336, and 402-436 bear a linear relationship to the positions of the electrodes in abridged quadrupole 1 in accordance with equation (8). For example, electrodes 119, 120, 121, and 122 have applied to them 0V, −10V, −20V, and −30V, respectively.

Given the potentials, placement, and widths of electrodes 101-137, 201-237, 301-337, and 401-437, as described above, it is possible to calculate the equipotential curves, 2-24, of the resultant electric field as shown in FIG. 1A. The equipotential curves of FIG. 1A were calculated using Simion 7.0 (Scientific Instrument Services, Inc., Ringoes N.J.). Curves 2, 4, 6, 8, 10, and 12, represent equipotentials of 110V, 90V, 70V, 50V, 30V, and 10V respectively. Similarly, curves, 14, 16, 18, 20, 22, and 24 represent equipotentials of −110V, −90V, −70V, −50V, −30V, and −10V respectively. By visual inspection and as defined via equation (8) equipotential curves 2-24 are hyperbolic. As expected, the electric field is "quadrupolar" in nature.

Figure 1B:
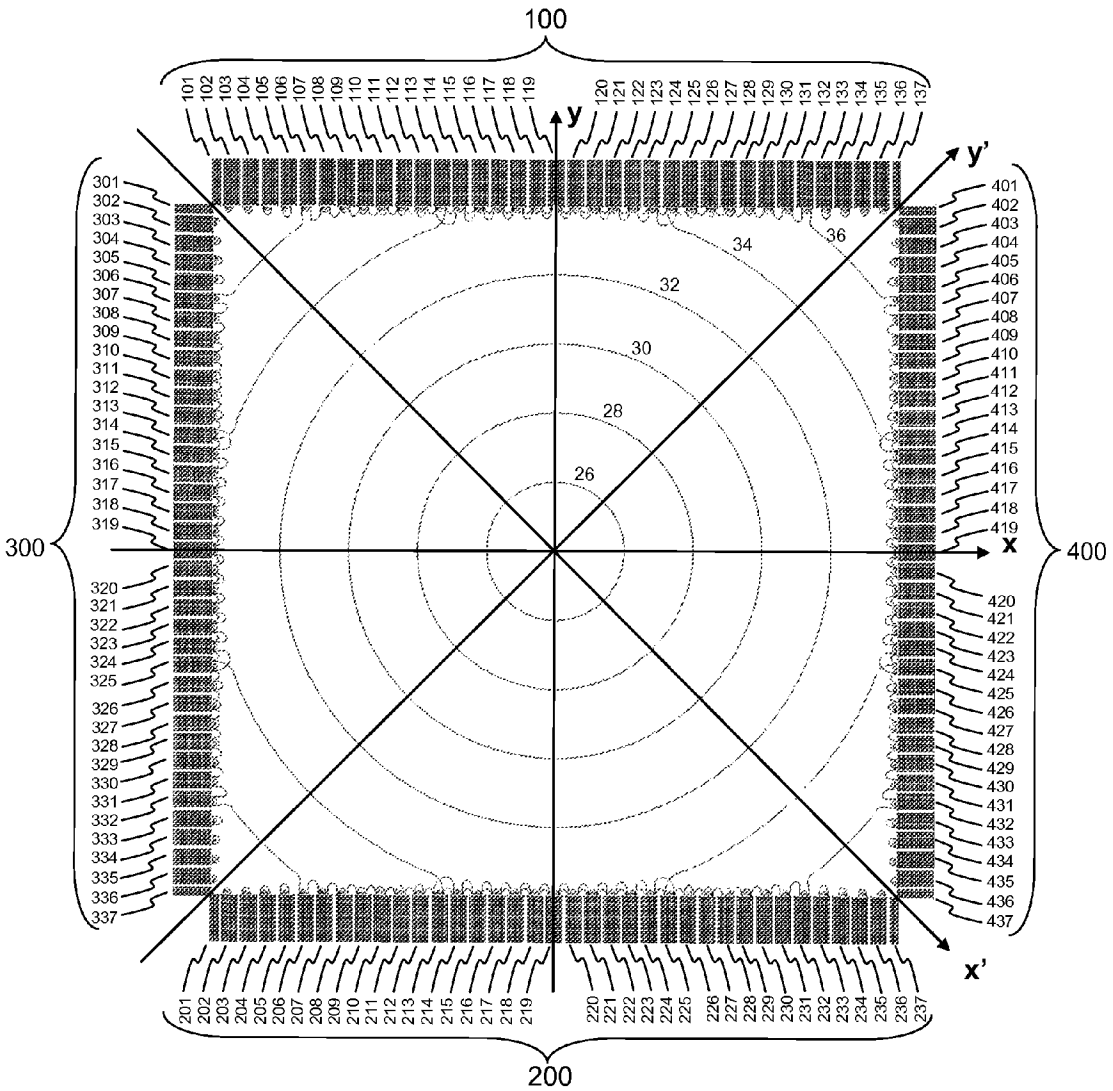
FIG. 1B is a cross-sectional view of an abridged quadrupole according to the present invention and equiqradient lines calculated to be formed during operation.

The quadrupolar nature of the electric field formed this way is further demonstrated in FIG. 1B. In FIG. 1B, equigradient curves, 26-36 are plotted. As calculated using Simion, curves 26, 28, 30, 32, 34, and 36 represent equigradients 20 V/mm, 40 V/mm, 60 V/mm, 80 V/mm, 100 V/mm, and 120 V/mm.

While equigradient curves 26-36 do not represent "pseudopotentials" directly, they do demonstrate a cylindrical symmetry just as the equigradient curves of a quadrupolar electric field should have and as a quadrupolar pseudopotential well should have. Interestingly, the cylindrical symmetry of the equigradient curves is maintained throughout abridged quadrupole 1 except in regions close to electrodes 101-137, 201-237, 301-337, and 401-437—i.e. closer than about the center-to-center spacing between the electrodes. The equipotential curves 2-24 and equigradient curves 26-36 indicate that a near ideal quadrupolar field can be formed in abridged quadrupole 1.

Potentials may be applied to electrode sets 100, 200, 300, and 400 via any known prior art method. However, as an example, potentials from a driver may be applied directly to electrodes at the corners of abridged quadrupole 1—i.e. where the electrode sets intersect. That is, the potential $\Phi_o(t)/2$ may be applied directly to electrodes 237, 437, 101, and 301 and the potential $-\Phi_o(t)/2$ may be applied to electrodes 201, 401, 137, and 337. From these electrodes—i.e. electrodes 101, 201, 301, 401, 137, 237, 337, and 437—the potentials are divided by known prior art methods and applied to remaining electrodes, 102-136, 202-236, 302-336, and 402-436. The voltage divider may be comprised of a resistor divider and/or a capacitor divider and/or an inductive divider. As an example, if a capacitor divider is used, a series of capacitors—one between each of electrodes 101-137, one between each of electrodes 201-237, one between each of electrodes 301-337, and one between each of electrode 401-437—would divide the potentials $\Phi_o(t)/2$ and $-\Phi_o(t)/2$ among the electrodes. Each capacitor used in the divider would have the same capacitive value. The capacitance of the individual capacitors must be chosen to be much higher than the capacitance between electrodes of opposite polarity—for example, that between electrode 413 and all of electrodes 101-119, 301-319, 420-437, and 220-237—and must be substantially higher than the capacitance between an individual electrode and nearby conductors—e.g. conductive supports or housing. However, the capacitance of the individual component should be chosen to be low enough so as not to overload the driver.

It is preferable to use a resistor divider in combination with the above described capacitor divider. Some of the ions passing through abridged quadrupole 1 will strike the electrodes. When this occurs, the charge deposited on the electrode by the ion must be conducted away. One way this may be readily accomplished is via a resistor divider. Like the above described capacitor divider, the resistor divider consists of a series of resistors—one between each of electrodes 101-137, one between each of electrodes 201-237, one between each of electrodes 301-337, and one between each of electrodes 401-437—which, together with the capacitor divider, divides the potentials $\Phi_o(t)/2$ and $-\Phi_o(t)/2$ among the electrodes. Each resistor used in the divider has the same resistance value so that the potentials are divided linearly amongst the electrodes in accordance with equation (8). The resistance of the individual resistors must be chosen to be low enough that charge can be conducted away at a much higher rate than it is deposited on the electrode by the ions. However, the resistance of the individual component must be chosen to be high enough so as not to overload the driver. In principle, a resistor divider may be used alone—without a capacitor divider—if the values of the resistors are sufficiently low that the current through the resistors can charge the electrodes at the desired RF frequency and if such low resistance values do not overload the driver.

Any appropriate prior art electronics may be used to drive the abridged quadrupole according to the present invention. However, as an example, a resonantly tuned LC circuit might be used to provide potentials to abridged quadrupole 1. In one embodiment, a waveform generator drives a current through the primary coil of a step-up transformer. The secondary coil is connected on one end to electrodes 101, 301, 237, and 437 and on the other to electrodes 201, 337, 401, and 137. The potential, $\Phi_o(t)$, produced across the secondary coil is divided among electrodes 102-136, 202-236, 302-336, and 402-436 by, for example, a capacitor divider as described above. In such a resonant LC circuit the waveform will be sinusoidal. The inductance of the secondary coil and the total capacitance of the divider and electrodes will determine the resonant frequency of the circuit. The capacitance and inductance of the system is therefore adjusted to achieve the desired frequency waveform as is well known in the prior art.

In alternate embodiments, each electrode in sets 100, 200, 300, and 400 is electrically connected directly to the above mentioned secondary coil. According to this embodiment, the secondary coil is comprised of a winding wire that is looped around a core—i.e. a cylindrically shaped support—a multitude of times in a helical fashion. For example, the wire may be looped around the core 36 times. During operation, the potential $\Phi_o(t)$ is induced across the length of the secondary coil via the oscillating current in the primary coil. The potential at any given point along the secondary coil is a linear function of position along the coil. Thus, the potential difference between one end of the secondary coil and the first loop is $\Phi_o(t)/36$. Likewise, the potential difference between the end of the secondary coil and the second loop is $\Phi_o(t)/18$. And between the end of the coil and loop, n, the potential difference is n $\Phi_o(t)/36$. Thus, according to this embodiment, electrode 101 is connected to one end of the secondary coil, and electrodes 102-137 are electrically connected to the first through the thirty sixth loop respectively—each successive electrode connected to each successive loop in the coil. Notice that the thirty sixth loop is actually equivalent to the opposite end of the secondary coil. A DC potential may be applied to the secondary coil and thereby to the electrodes of sets 100, 200, 300, and 400 of abridged quadrupole 1 by methods well known in the prior art.

When any of the embodiments discussed above is operated as an ion guide or as a quadrupole mass filter, electrodes 101, 301, 237, and 437 will always be at the same potential and therefore may be directly connected to each other. Similarly, for any of the other electrodes in sets 100, 200, 300, and 400 there are three other electrodes in abridged quadrupole 1 which will always be at the same potential and therefore may be electrically connected to each other.

The potential, $\Phi_o(t)$, applied to abridged quadrupole 1 may be any of a wide variety of functions of time, however, as an example, it may be given by:

$$\Phi_o(t)=V\sin(2\pi ft)+U, \tag{11}$$

where V is the zero-to-peak RF voltage applied between opposite ends of each electrode set 100, 200, 300, and 400, f is the frequency of the waveform in Hertz, and U is a DC voltage applied between opposite ends of each electrode set 100, 200, 300, and 400. In alternate embodiments, $\Phi_o(t)$ may be a triangle wave, square wave, or any other function of time. If the DC voltage, U, is selected to be zero volts, then abridged quadrupole 1 will act as a simple ion guide.

As mentioned above, electrode sets 100, 200, 300, and 400 are extended parallel to a central, z-axis which is orthogonal to the x-y plane. In the preferred embodiment, electrode sets

100, 200, 300, and 400 all originate at the same coordinate along the z-axis and are all of the same length. Abridged quadrupole 1 therefore, is extended along the z-axis and has two ends through which ions may enter and exit. Abridged quadrupole 1 may be any length along the z-axis, however, as an example, quadrupole 1 may be 10 cm long. In one embodiment, ions enter through one end of abridged quadrupole 1, along its central axis—i.e. the z-axis. Ions are preferably injected near the central axis—i.e. near the origin of the x and y axes—and with velocity components parallel to the central axis such that the initial motion of the ions will tend to carry them from the entrance end to the exit end of abridged quadrupole 1. Ion velocity components orthogonal to the central axis will, of course, tend to move the ions radially away from the z-axis. If not for the action of potential $\Phi(t)$, such motion would cause ions to collide with electrode sets 100, 200, 300, and/or 400.

When DC potential U is set to zero, abridged quadrupole 1 acts to radially confine ions to the central axis and thereby to guide ions from the quadrupole entrance end to the exit end. The dimensions of abridged quadrupole 1, the RF potential V, and the frequency f of the applied waveform must be selected appropriately in order to transmit ions of the desired m/z. These can be readily determined using the well-known Mathieu equations as is well established in the prior art. However, when calculating, for example, the classic "q" or "a" values, the potentials $+/-\Phi_o/2$ are applied at $r_o'$ as opposed to $r_o$.

When DC potential U is non-zero, abridged quadrupole 1 acts as a mass filter—guiding ions of a substantially limited m/z range from the entrance end to the exit end of the quadrupole. In accordance with the Mathieu equations and stability diagram, ions of any desired m/z or range of m/z may be transmitted through abridged quadrupole 1. The trajectories of other ions will be unstable and these ions will be ejected radially from abridged quadrupole 1 or will collide with the electrodes. Mass spectra may be obtained by scanning the amplitude of the RF waveform, V, together with the DC potential, U, and recording the intensity of the transmitted ion beam as a function of the waveform amplitude.

Figure 2:
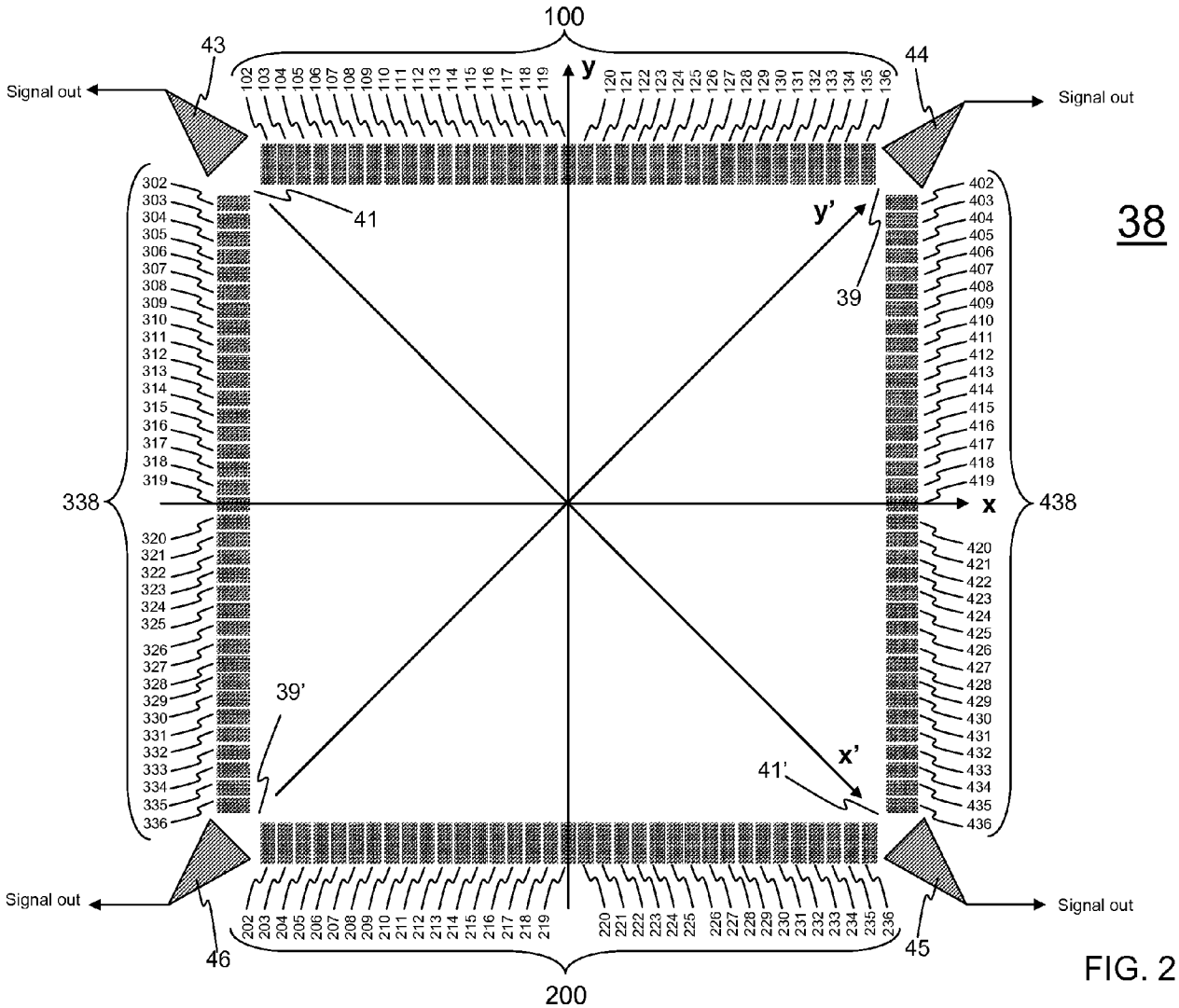
FIG. 2 is a cross-sectional view of an abridged quadrupole according to the present invention including detectors positioned along the x' and y' axes.

In an alternate embodiment, gaps may be left in the array of electrodes in the locations where the lines of electrodes would otherwise intersect. As an example, FIG. 2 depicts a cross sectional view of abridged quadrupole 38 according to the present invention. Abridged quadrupole 38 is identical to quadrupole 1 except for the absence of electrodes 101, 201, 301, 401, 137, 237, 337, and 437 from the corners of the assembly. Electrode sets 138, 238, 338, and 438 of abridged quadrupole 38 are electrically connected and driven in substantially the same manner as described above with respect to abridge quadrupole 1.

Under mass selective stability conditions, ions in a narrow range of m/z values will follow stable trajectories through abridged quadrupole 38. All, or at least some fraction of the ions following unstable trajectories will be ejected through gaps 39, 39', 41, and 41' at the intersections of electrode sets 138, 238, 338, and 438. Unstable ions of low m/z will be ejected through gaps on opposing sides of abridged quadrupole 38. Assuming U is a positive voltage and assuming positively charge ions, the low m/z ions will be ejected through gaps 41 and 41' along the x' axis. Unstable ions of higher m/z than the stable m/z range would be ejected through gaps 39 and 39' along the y' axis.

Unstable ions that are ejected through gaps 39, 39', 41, and 41' may be detected via an ion detector or transmitted to another ion optical device for further analysis. As an example, in FIG. 2 detectors 43 and 45, and 44 and 46 are placed along the x' and y' axes respectively so as to detect ions of lower and higher m/z respectively than the stable m/z range. Detectors 43-46 may be channeltrons, microchannel plates detectors, dynode multipliers, Faraday cups, or any other prior art detectors. Detectors 43-46 may be extended along the z-axis. Ions within the selected m/z range following stable trajectories will be transmitted from the entrance end to the exit end of abridged quadrupole 38. These transmitted ions may be detected at the exit end of quadrupole 38 using an ion detector as is known in the prior art. Mass spectra may be obtained by scanning the amplitude of the RF waveform, V, together with the DC potential, U, and recording the intensity of the transmitted ion beam as a function of the waveform amplitude. Alternatively, selected ions may pass into downstream ion optic devices or mass analyzers.

Outside of the selected m/z range, the trajectory of the ions will be unstable and ions will be ejected through gaps 39, 39', 41, and 41' along the x' and y' axes and may be detected in detectors 43-46. Observing the signals from detectors 43-46 can provide information on what fraction of the ion beam entering abridged quadrupole 38 has an m/z lower than the selected m/z range and what fraction is higher. If the responsiveness of detectors 43-46 and the detector at the exit of quadrupole 38 are identical, and if the ion beam entering quadrupole 38 is constant, then the sum of the signals from all the detectors should be constant throughout a mass scan. In alternate embodiments, the detectors might be calibrated against one another—i.e. 60% of the signal from one detector may be taken to be equal to the full signal from another. Such differences between the observed signals between one detector and another may be due either to differences in the detectors themselves—i.e. conversion efficiency or gain—or may be due to differences between the transmission efficiency of ions through the various gaps 39, 39', 41, and 41' and out of the exit end of abridged quadrupole 38.

Nonetheless, the sum of the responses of detectors 43-46 and the exit detector may be useful as a means of monitoring fluctuations in the ion beam current entering quadrupole 38. This information may, for example, be used to normalize the signal intensities recorded in mass spectra obtained via mass selective stability scans. As an example, if the intensity of the ion beam entering abridged quadrupole 38 drops by a factor of two in the middle of a mass stability scan, then the mass spectral peaks observed in the second half of the resultant spectrum will have areas which are half of what they should be relative to peaks in the first half of the spectrum. However, by monitoring the ion beam current entering abridged quadrupole 38, it is possible to correct the relative intensities of the observed peaks. For example, the entering ion beam current—measured as the sum of the signals from all detectors 43-46 plus the detector at the exit of quadrupole 38—can be recorded as a function of time during the scan. Afterwards, the recorded mass spectrum can be divided by the simultaneously recorded "entering ion beam current", thus normalizing the exit detector response—i.e. peak intensity—to the entering ion beam current. Alternatively, the exit detector signal may be divided in hardware—e.g. via op amps—by the sum of the signals from detectors 43-46 plus the exit detector. This would produce a signal that is already normalized against the entering ion beam current and which can be recorded to produce a normalized mass spectrum.

In addition, mass spectra may be obtained by scanning the amplitude of the RF waveform, V, together with the DC potential, U, and recording the intensities of the ejected ion beams as a function of the waveform amplitude. If the amplitudes of V and U are scanned from low to high potentials, then at the beginning of the scan all ions will be ejected along the y' axis into detectors 44 and 46. The signal on the exit detector and on detectors 43 and 45 will start near zero. As potentials V and U are scanned to higher values, ions of increasing m/z will first be transmitted to the exit detector and later will be ejected along the x' axis onto detectors 43 and 45. The signal at the exit of abridged quadrupole 38 will rise and fall as ions of a given m/z are first transmitted and then fall onto the low m/z side of the transmitted mass range. The signal from detectors 44 and 46 will tend to fall during the course of the scan—decreasing abruptly as high abundance ions assume stable trajectories and then are ejected into detectors 43 and 45. Taking a negative derivative of the signal from detectors 44 and 46 will produce a mass spectrum which is substantially similar to that obtained from the exit detector. The signal from detectors 43 and 45 will tend to rise during the course of the scan—increasing abruptly as high abundance ions assume unstable trajectories as the selected m/z range moves to higher m/z. The ions, then being of lower m/z than the selected range, are ejected into detector 43 and 45. Taking the derivative of the signal recorded at detectors 43 and 45 as a function of time will produce a mass spectrum which is substantially similar to that obtained from the exit detector and via detectors 44 and 46. These three spectra may be compared or summed with each other to produce more reliable, better signal-to-noise results.

Turning next to FIG. 3, abridged quadrupole 1 is depicted with equipotential lines representing a homogeneous dipole field. Mathematically, the dipole field can be represented as a potential that varies linearly along both the x and y axes. Adding a dipole field to the quadrupolar field of equation (8) results in:

$$\Phi(t) = \frac{-\Phi_o(t)\cdot x\cdot y}{2r_o^2} + E_x(t)\cdot x + E_y(t)\cdot y + c \tag{12}$$

where $E_x(t)$ is the dipole electric field strength along the x-axis, $E_y(t)$ is the dipole electric field strength along the y-axis, and where c, the reference potential by which abridged quadrupole 1 is offset from ground, is added simply for completeness. In calculating equipotential lines 47-55 of FIG. 3A, $\Phi_o(t)$ and $E_y(t)$ were taken to be zero and $E_x(t)$ was taken to be 100 V/mm. Equipotential lines are drawn in FIG. 3A at 40V intervals. Lines 51, 52, 53, 54, and 55 represent the 0V, 40V, 80V, 120V, and 160V equipotentials respectively. Similarly, lines 50, 49, 48, and 47 represent the −40V, −80V, −120V, and −160V equipotentials respectively.

Figure 3A:
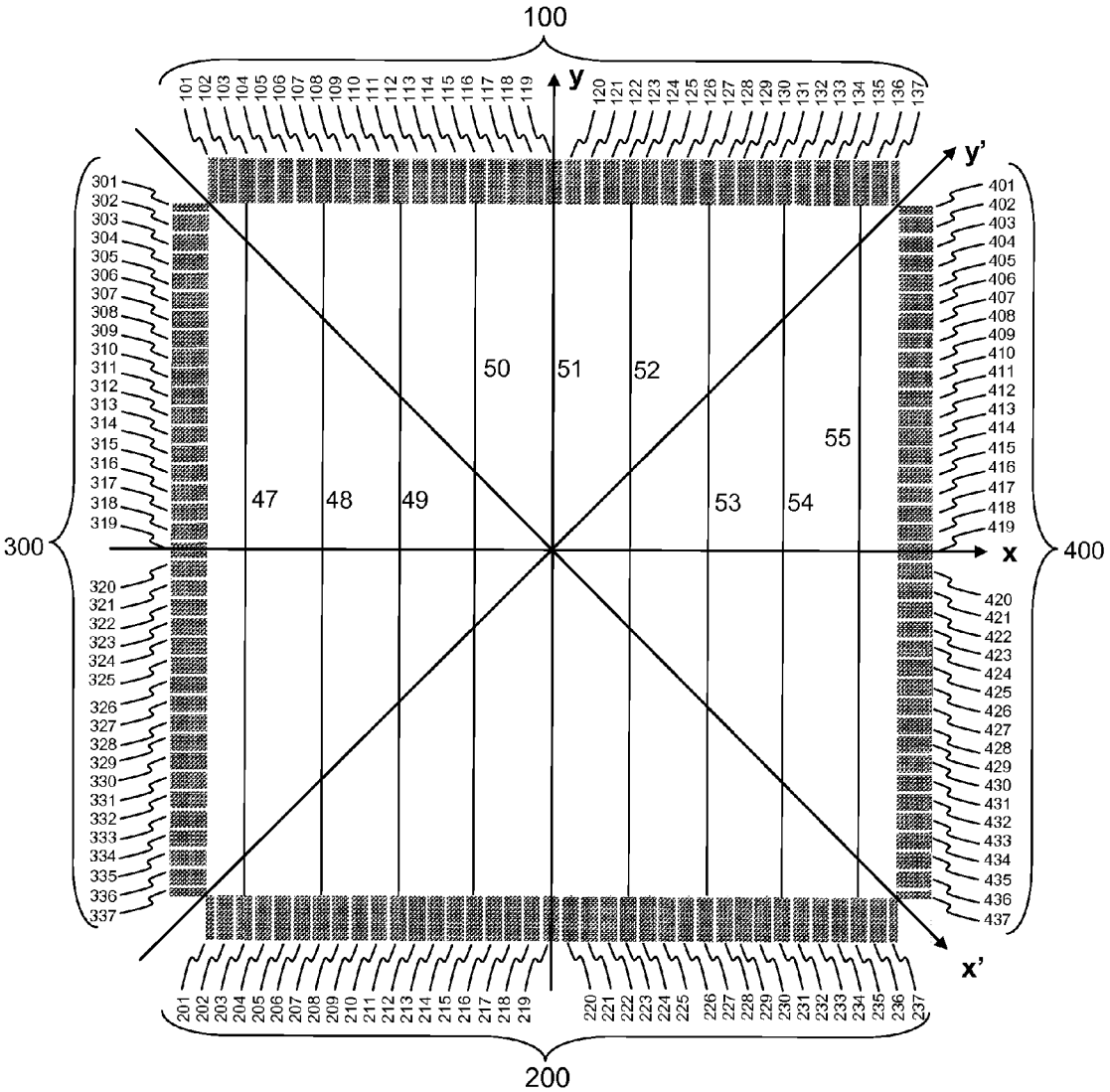
FIG. 3A is a cross-sectional view of an abridged quadrupole according to the present invention with equipotential lines calculated to be formed when the abridged quadrupole is operated so as to form a homogeneous dipole field along the x-axis.

To produce the dipole field represented in FIG. 3A, potentials were applied to the electrodes of abridged quadrupole 1 as described above and with reference to equation (12). Thus, a potential of 10V, 20V, 30V, etc. is applied to electrodes 120, 121, 122, etc. respectively. Further, a potential of 10V, 20V, 30V, etc. is applied to electrodes 220, 221, 222, etc. respectively. Also, in accordance with equation (12) electrodes 137, 237, and 401-437 are all held at a potential of 180V. Similarly, electrodes 101, 201, and 301-337 are all held at a potential of −180V.

As described above with respect to FIG. 1, potentials may be applied to electrode sets 100, 200, 300, and 400 via any known prior art method. However, as an example, potentials from a driver may be applied directly to electrodes at the corners of abridged quadrupole 1—i.e. where the electrode sets intersect. That is, the potential 180V may be applied directly to electrodes 137, 401, 437, and 237 and the potential −180V would be applied to electrodes 101, 201, 301, and 337. From these electrodes—i.e. electrodes 101, 201, 301, 401, 137, 237, 337, and 437—the potentials are divided by known prior art methods and applied to remaining electrodes, 102-136, 202-236, 302-336, and 402-436. The voltage divider may be comprised of a resistor divider and/or a capacitor divider and/or an inductive divider.

Such voltage dividers used to produce a homogeneous dipole field may be identical to those described above with reference to FIG. 1 used to produce an abridged quadrupolar field. That is, in both the case of the quadrupole field generation and the dipole field generation, potentials are linearly divided amongst the electrodes in electrode sets 100, 200, 300, and 400. This feature is represented in equations (8) and (12) wherein the quadrupole potentials, $$\frac{-\Phi_o(t)\cdot x\cdot y}{2r_o^2},$$

are a linear function of x and y and the dipole potentials, $E_x(t)x+E_y(t)$ y, are also a linear function of x and y. Thus, using a single divider network, a field having both a quadrupolar component and a homogeneous dipolar component can be generated.

Figure 3B:
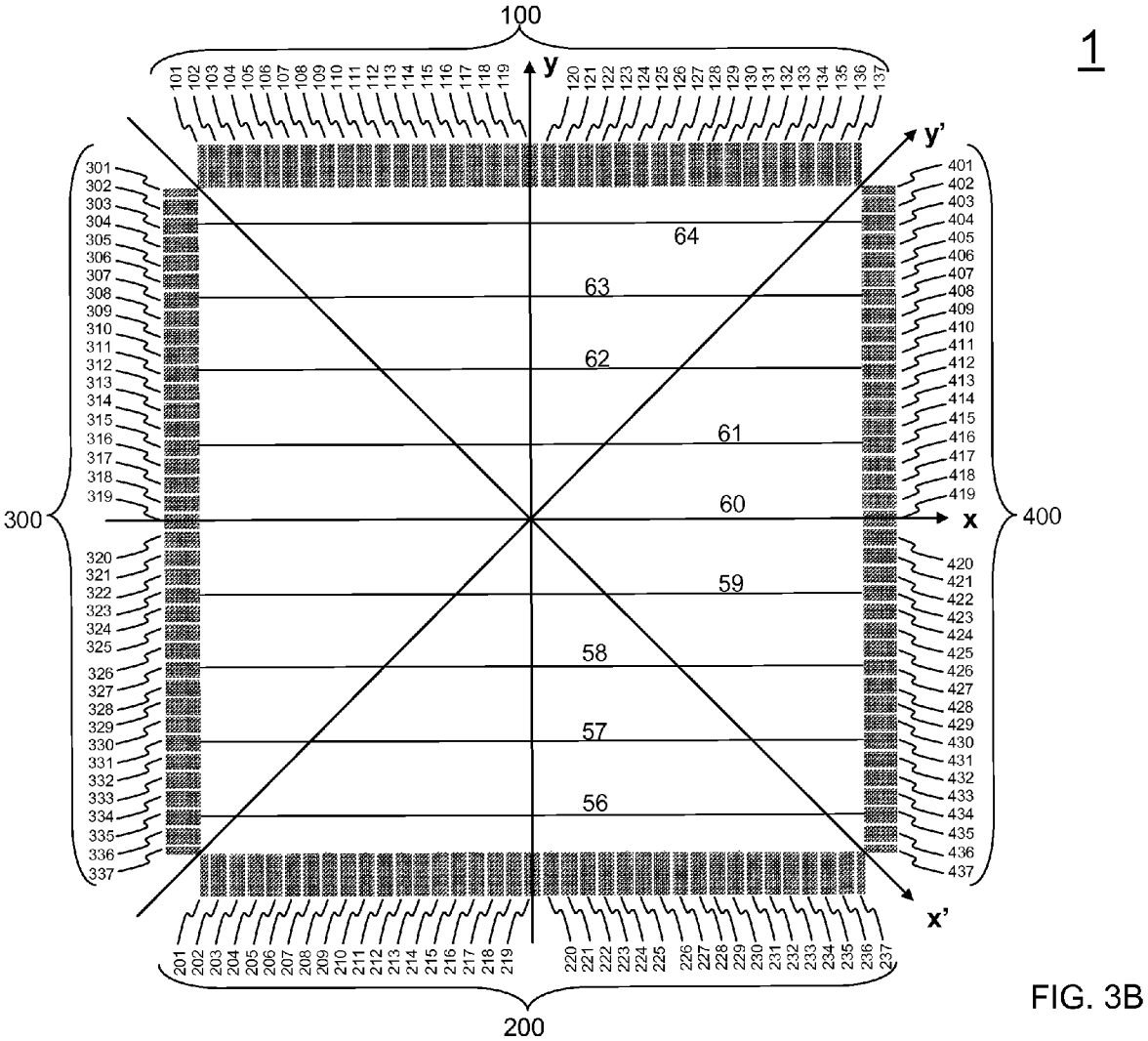
FIG. 3B is a cross-sectional view of an abridged quadrupole according to the present invention with equipotential lines calculated to be formed when the abridged quadrupole is operated so as to form a homogeneous dipole field along the y-axis.

In calculating equipotential lines 56-64 of FIG. 3B, $\Phi_o(t)$ and $E_x(t)$ were taken to be zero and $E_y(t)$ was taken to be 100 V/mm. Equipotential lines are drawn in FIG. 3B at 40V intervals. Lines 60, 61, 62, 63, and 64 represent the 0V, 40V, 80V, 120V, and 160V equipotentials respectively. Similarly, lines 59, 58, 57, and 56 represent the −40V, −80V, −120V, and −160V equipotentials respectively. To produce the dipole field represented in FIG. 3B, potentials were applied to the electrodes of abridged quadrupole 1 as described above and with reference to equation (12). Thus, a potential of 10V, 20V, 30V, etc. is applied to electrodes 319, 318, 317, etc. respectively. Further, a potential of 10V, 20V, 30V, etc. is applied to electrodes 419, 418, 417, etc. respectively. Also, in accordance with equation (12) electrodes 301, 401, and 101-137 are all held at a potential of 180V. Similarly, electrodes 337, 437, and 201-237 are all held at a potential of −180V. Notice that the field in FIG. 3B is homogeneous and of the same strength as that in FIG. 3A. The field is simply, in effect, rotated from the x to the y-axis.

Figure 3C:
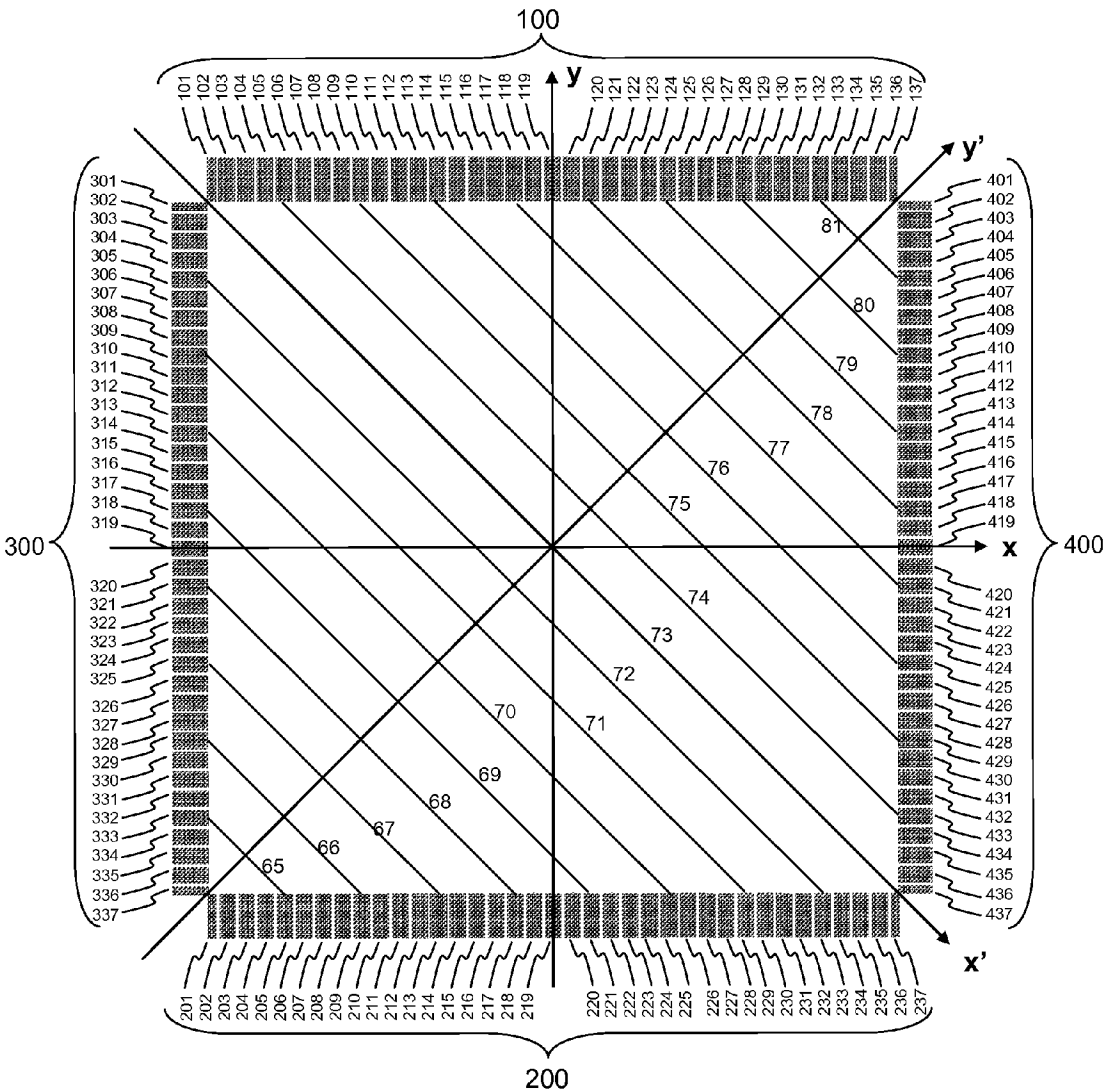
FIG. 3C is a cross-sectional view of an abridged quadrupole according to the present invention with equipotential lines calculated to be formed when the abridged quadrupole is operated so as to form a homogeneous dipole field along the y'-axis.

Finally, in calculating equipotential lines 65-81 of FIG. 3C, $\Phi_o(t)$ was taken to be zero and $E_x(t)$ and $E_y(t)$ were taken to be 100 V/mm. Equipotential lines are drawn in FIG. 3C at 40V intervals. For example, lines 74, 75, 76, and 77 represent the 40V, 80V, 120V, and 160V equipotentials respectively. Similarly, lines 72, 71, 70, and 69 represent the −40V, −80V, −120V, and −160V equipotentials respectively. To produce the dipole field represented in FIG. 3C, potentials were applied to the electrodes of abridged quadrupole 1 as described above and with reference to equation (12). Thus, a potential of 10V, 20V, 30V, etc. is applied to electrodes 436, 435, 434, etc. respectively. Further, a potential of 10V, 20V, 30V, etc. is applied to electrodes 102, 103, 104, etc. respectively. Also, in accordance with equation (12) electrodes 101, 301, 237, and 437 are all held at a potential of 0V. Electrodes 137 and 401 are held at a potential of 360V whereas a potential of −360V is applied to electrodes 201 and 337. As described above, the potential on all other electrodes in electrode sets 100, 200, 300, and 400 can be determined by dividing the above given potentials linearly as a function of electrode position or via equation (12). Again, notice that the field of FIG. 3C is homogeneous and is the sum of the fields of FIGS. 3A and 3B.

It should be noted that $E_x(t)$ and $E_y(t)$ may each be any function of time from DC to complex waveforms, however, as an example, $E_x(t)$ and $E_y(t)$ may be given by:

$$E_x(t)=A_x\cos(2\pi f_x t), \tag{13}$$

$$E_y(t)=A_y\sin(2\pi f_y t), \tag{14}$$

Where $A_x$ and $f_x$ are the amplitude and frequency of the electric dipole waveform along the x-axis and $A_y$ and $f_y$ are the amplitude and frequency of the electric dipole waveform along the x-axis. The amplitudes and frequencies of these waveforms may be any desired amplitude and frequency, however, as an example, one may choose $A_y=A_x$ and $f_y=f_x$. In such a case, one achieves a homogeneous electric dipole of fixed amplitude, $A_x$, that rotates with frequency, $f_x$, about the z-axis.

Such a dipole field may be used, for example, to excite ions into motion about the axis of abridged quadrupole 1. Assuming, for example, a quadrupolar potential according to equations (11) and (12), wherein, V is 200V, and f is 1 MHz, is produced in abridged quadrupole 1, then ions entering quadrupole 1 will tend to be focused to the axis of abridged quadrupole 1. If U is 0V, then ions in abridged quadrupole 1 will oscillate about the axis at a resonant frequency (also known as the ion secular frequency) related to the ion mass. If a rotating dipole field as described above is applied to the abridged quadrupole, at a frequency, $f_x$, which is equal to the secular frequency of ions of a selected mass, then ions of that mass will be excited into a circular motion about the abridged quadrupole axis. If the amplitude, $A_x$, is high enough and the time that the ions are exposed to the dipole field is long enough, then the radius of the ions' circular motion will be large enough to collide with the electrodes comprising the abridged quadrupole and the ions will be destroyed.

In alternate embodiments, dipoles of the form given in equations (13) and (14) may be used to excite ions at their secular frequencies along the x or y-axis or in any direction perpendicular to the axis of abridged quadrupole 1. In further alternate embodiments, the dipole frequency applied along the x-axis may differ from the dipole frequency applied along the y-axis, such that ions of a first secular frequency are excited along the x-axis whereas ions having a second secular frequency are excited along the y-axis. In alternate embodiments, $E_x(t)$ and $E_y(t)$ are complex waveforms that may be represented as being comprised of many sine waves of a multitude of frequencies. Such complex waveforms may therefore be used to simultaneously excite ions of a multitude of secular frequencies. As in the case of the prior art method known as SWIFT, complex waveforms may be built and applied so as to excite all ions except those in selected secular frequency ranges. Such SWIFT waveforms applied via the dipole electric field may be used to eliminate ions of all but selected ranges of masses from abridged quadrupole 1.

Figure 4A:
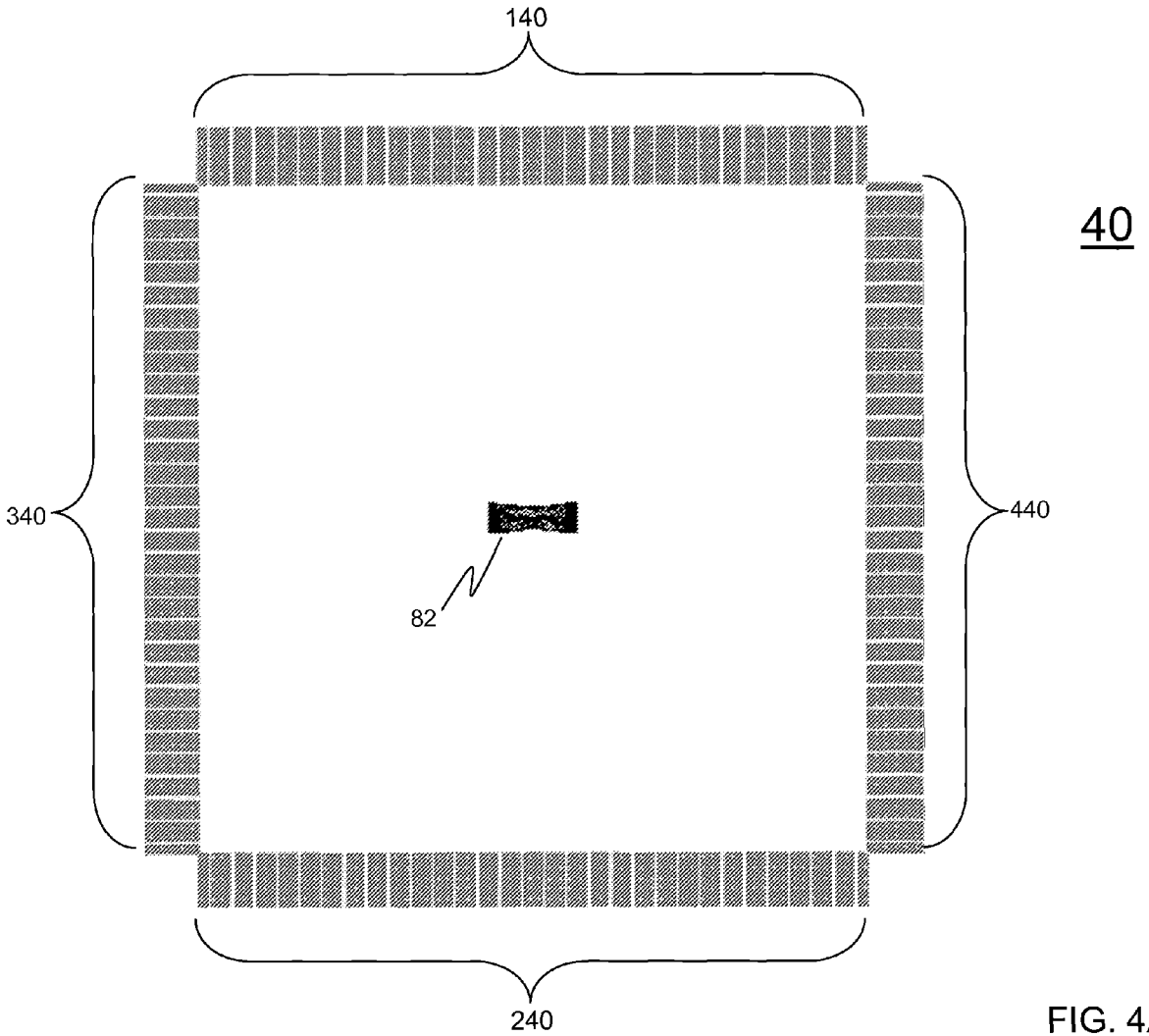
FIG. 4A is a cross-sectional view of an abridged quadrupole according to the present invention and the trajectory of a 400 Da/q ion simulated assuming the abridged quadrupole is operated under multiple frequency RF conditions.
Figure 4B:
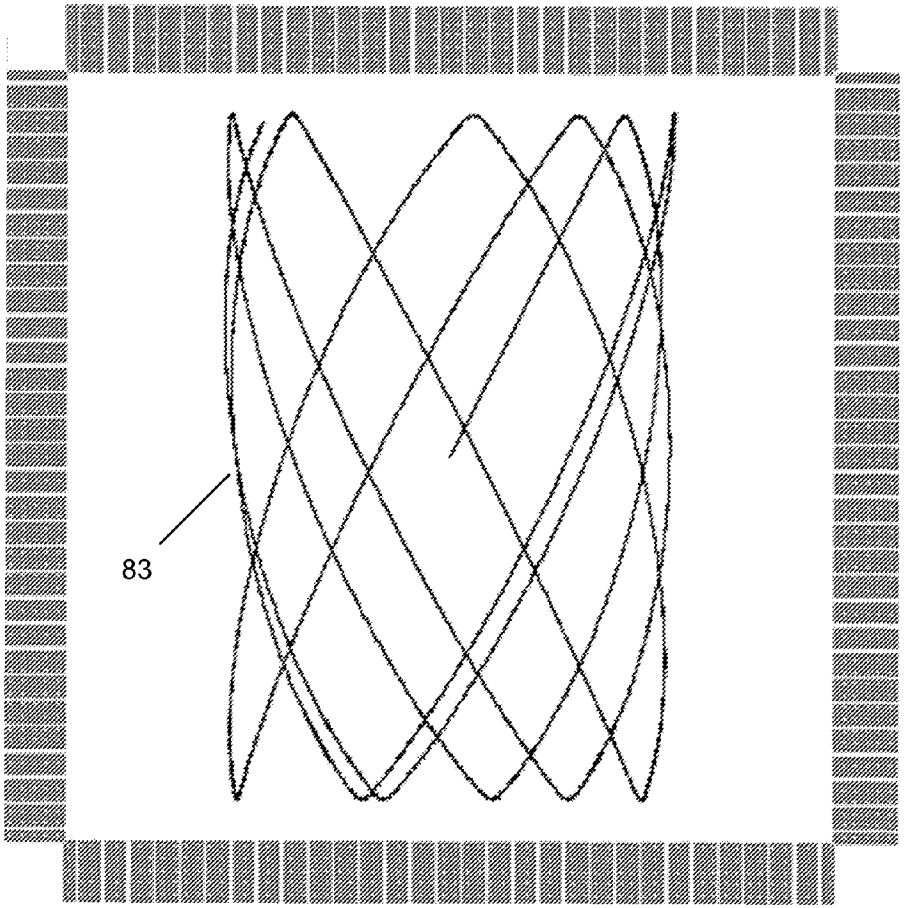
FIG. 4B is a cross-sectional view of an abridged quadrupole according to the present invention and the trajectory of a 40 kDa/q ion simulated assuming the abridged quadrupole is operated under multiple frequency RF conditions.

Turning next to FIGS. 4A and 4B, a cross sectional view of abridged quadrupole 40 is shown. Abridged quadrupole 40 is substantially the same as abridged quadrupole 1 except electrode sets 140, 240, 340, and 440 are comprised of 31 electrodes each whereas electrode sets 100, 200, 300, and 400 are comprised of 37 electrodes each and the inscribed diameter of abridged quadrupole 40 is 3 mm whereas that of abridged quadrupole 1 is 3.6 mm Abridged quadrupole 40 is composed of electrode sets 140, 240, 340, and 440 arranged rectilinearly and symmetrically about a central axis and electrically connected so as to form a multiple frequency multipole field when a proper potential is applied between the electrodes. The electrodes are extended parallel to the central axis, however, when the multipole is viewed in cross section, the electrodes are arranged along four lines, symmetrically about the central axis and form a rectangle. The potentials applied to the electrodes take the form:

$$\text{at } x=+/-r_o;\ \Phi(y,t)=\sum_{i=1}^{j} g_i(y)h_i(t); \tag{15}$$

$$\text{and } y=+/-r_o;\ \Phi(x,t)=\sum_{i=1}^{j} k_i(x)l_i(t). \tag{16}$$

where the functions $g_i(y)$ and $k_i(x)$ may be any functions of position in the y and x dimensions respectively and the functions $h_i(t)$ and $l_i(t)$ may be any functions of time. As an example, equation (15) may take the form:

$$\Phi(t)=\frac{-(V\cdot\sin(2\pi f_1 t)+U)\cdot y}{2r_o}+A_y\sin(2\pi f_y t)\cdot y+c+B_y\sin(2\pi f_2 t)\cos\left(\frac{2\pi y}{a_y}\right) \tag{17}$$

where $f_1$ and $f_2$ are the oscillation frequencies of quadrupolar and heterogeneous dipolar fields respectively. $B_y$ and $a_y$ are constants relating to the amplitude and spatial repetition of the heterogeneous dipolar field. Similarly, equation (16) may take the form:

$$\Phi(t)=\frac{-(V\cdot\sin(2\pi f_1 t)+U)\cdot x}{2r_o}+A_x\sin(2\pi f_x t)\cdot x+c-B_x\sin(2\pi f_2 t)\cos\left(\frac{2\pi x}{a_x}\right) \tag{18}$$

where $B_x$ and $a_x$ are constants relating to the amplitude and spatial repetition of the heterogeneous dipolar field.

Simulated ion trajectories 82 and 83 depicted in FIGS. 4A and 4B were calculated assuming the conditions given by equations (17) and (18) where U, $A_x$, $A_y$, and c were taken to be zero. V, $B_x$, and $B_y$ were taken to be 100V. $f_1$ and $f_2$ were taken to be 1 MHz and 0.5 MHz, respectively, and $a_x$ and $a_y$ were taken to be 0.2 mm. Because the center-to-center spacing between the electrodes is 0.1 mm, the heterogeneous dipole term in equations (17) and (18) alternates from $B_x\sin(2\pi f_2 t)$ to $-B_x\sin(2\pi f_2 t)$ between adjacent electrodes.

A simulated trajectory 82 of an ion having a mass to charge ratio of 400 Da/q is shown in FIG. 4A. Notice in FIG. 4A that the ion is confined near the axis of abridged quadrupole 40 mainly by the action of the higher frequency, quadrupolar component of the multiple frequency field—i.e. $\Phi(t)=V\sin(2\pi ft)xy/2r_o^2$. A simulated trajectory 83 of an ion having a mass to charge ratio of 40 kDa/q is shown in FIG. 4B. For both simulated trajectories, it was assumed that the initial kinetic energy of the ion was 0.1 eV. Notice in FIG. 4B that the ion is confined near the boundaries of abridged multipole 40 mainly by the action of the lower frequency, heterogeneous dipole component of the multiple frequency field. Thus, in a manner similar to prior art multiple frequency multipoles, ions of a broad range of mass to charge ratios may be radially confined and transmitted through the abridged multipole. However, unlike prior art multiple frequency multipoles, no "DC electrode" is required to radially contain the ions. Rather, the multiple frequency field in an abridged quadrupole according to the present invention radially confines the ions by action of the RF field alone.

In alternate embodiments, higher order multipole fields may be formed by comprising an abridged multipole of a larger number of electrode sets. For example, an abridged hexapole may be formed using six sets of electrodes instead of just the four sets thus far described. Within each set, the electrodes are arranged in a line as viewed in the x-y plane. The electrode sets are arranged symmetrically around a central axis to form a hexagon in cross sectional view. As described above with respect to the abridged quadrupole, an RF potential is divided linearly amongst the electrodes of each set so as to form an abridged hexapole field. In a similar manner as described above, a heterogeneous dipole RF field component may be added so as to form a multiple frequency multipole field having hexapole and dipole components.

Electrode sets as described above including electrode sets 100, 200, 300, and 400 and the electrodes of which they are comprised—for example, electrodes 102 and 210—may be formed by any known prior art means. As an example, the electrodes comprising an electrode set may be formed from metal foils. For example, electrode 120 would be formed from a foil 80 μm thick. The edge of the foil would be positioned at $y=r_o$ and the mid-plane of the foil would be positioned at x=0.1 mm. Such metal foil electrodes may be spaced apart from one another in an electrode set using an electrically insulating sheet of, for example, polyimide. This would result in an array of electrodes such as electrode set 100 shown in FIG. 1 wherein the gaps between the electrodes are filled with polyimide. In such a construction, adjacent metal foil electrodes will have an electrical capacitance between them—i.e. adjacent foils will form a capacitor. If the metal foil electrodes comprising an electrode set are all of the same dimensions and are uniformly spaced apart from one another, then they will form a capacitor divider which, as described above, is useful for dividing the applied RF potentials linearly amongst the electrodes. It should be noted that the dielectric constant of the insulating sheet will influence the capacitance between adjacent foil electrodes. Thus, to maintain a uniform capacitance between adjacent electrodes, the dielectric constant of the insulating sheets must also be uniform.

In alternate embodiments, the above mentioned sheets separating the metal foil electrodes may not be insulating, but rather may be electrically resistive. Such a resistive sheet may be formed from any material, however, as an example, the resistive sheets may be formed from graphite doped polypropylene. Within an electrode set, the resistive sheets, electrically connected to one another via the metal foil electrodes, form a resistor divider. If the resistive sheets all have the same dimensions and resistance, then they will form a resistor divider which, as described above, is useful for dividing the applied RF and DC potentials linearly amongst the electrodes of the set. It should be noted that the resistance of the sheets may be any desired value, however, in one embodiment, the resistance of the sheets is chosen so that the resistance of the abridged multipole assembly is sufficiently high that the drive electronics are not overloaded.

In further alternate embodiments, the electrodes of the above mentioned electrode sets may be formed as conducting material bound to insulating supports. For example, the electrodes may be formed as conductive traces on PC boards or ceramic plates. Ideally, that surface of the insulating support which faces the interior of the multipole, and therefore carries the electrodes, should be perfectly flat. In practice, the supporting surface should be flat with the precision needed to perform the desired task. For example, when using an abridged multipole to simply guide ions, the flatness of the supporting surface may be poor—for example 10 to 1000 μm. Alternatively, to use an abridged quadrupole according to the present invention to analyze ions with poor resolution—e.g. 10 Da resolution—a moderate flatness specification should be kept—for example 10-100 μm. However, to analyze ions with an abridged quadrupole and achieve the best possible resolution—i.e. better than 1 Da resolution—a flatness of 10 μm or less should be maintained. In embodiments including insulating supports, such as PC boards or ceramic plates, capacitors and resistors may be added on the back surface of the insulating support—i.e. the surface opposite that which is exposed to the ions. The capacitors and resistors may be used to form the RC divider discussed above for dividing the potentials amongst the electrodes.

Figure 5B:
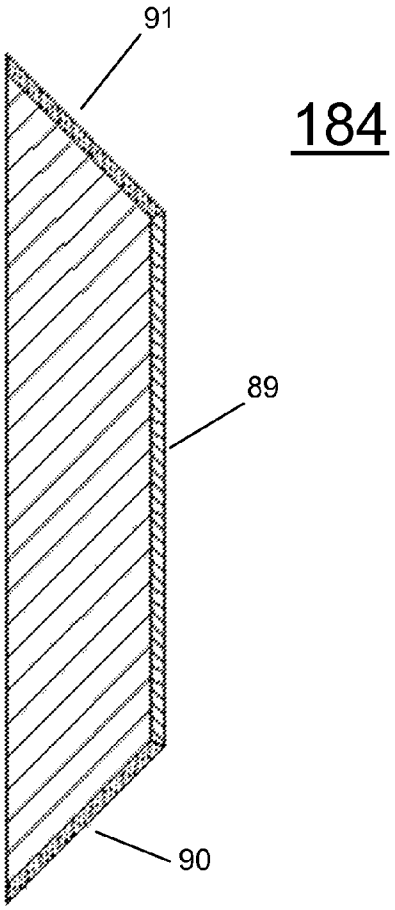
FIG. 5B is a cross sectional view of a plate constructed by depositing a resistive layer and conducting layers on the surfaces of the support depicted in FIG. 5A.
Figure 5A:
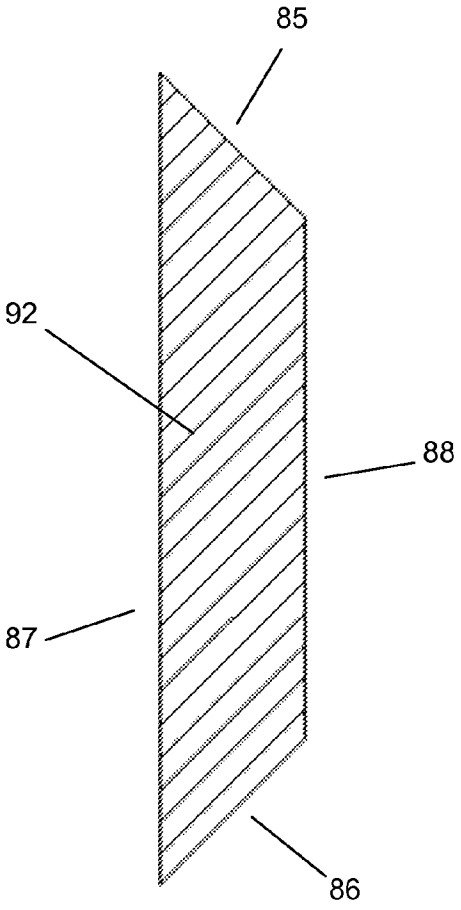
FIG. 5A is a cross-sectional view of an insulating support used in the construction of the abridged quadrupole depicted in FIG. 5C.
Figure 5C:
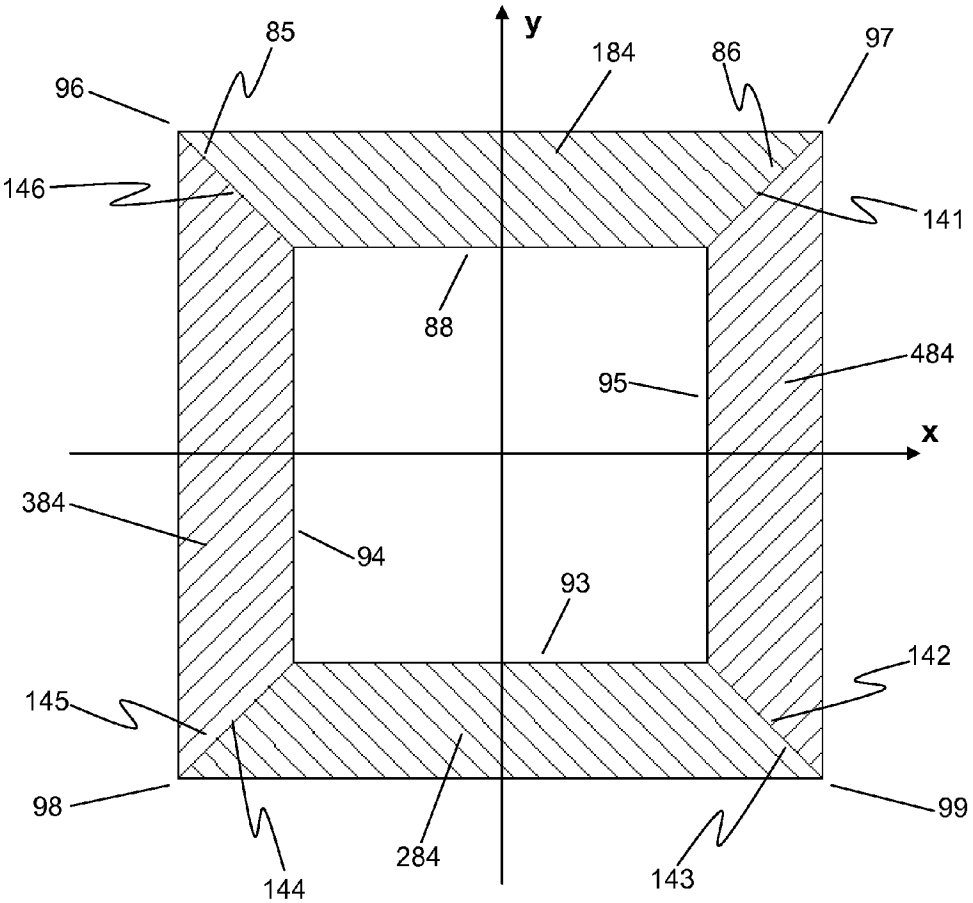
FIG. 5C is a cross sectional view of an abridged quadrupole constructed using four plates substantially identical to that depicted in FIG. 5B.

Turning next to FIGS. 5A, 5B and 5C, yet another alternate embodiment abridged quadrupole is depicted. FIG. 5A shows a cross-sectional view of insulating support 92 used in the construction of abridged quadrupole 84 depicted in FIG. 5C. Insulating support 92 may be comprised of any electrically insulating material, however, as an example, insulating support 92 may be comprised of ceramic. Note that FIGS. 5A and 5B depict cross-sectional views. That is, support 92 extends into the page and has a length which is the same as that of abridged quadrupole 84. Although any insulating material may be used to make support 92, ceramic is especially advantageous in that it is hard and rigid. As shown in FIGS. 5A and 5B, the cross section of support 92 has the form of an isosceles trapezoid with legs 85 and 86 having a 45° angle with respect to base 87 and a 135° angle with respect to base 88. A wide variety of dimensions may be chosen for support 92, however, as an example, base 88 is 3.5 mm long. Support 92 is 1 mm thick and 96.4 mm long (i.e. into the page).

As depicted in FIG. 5B, plate 184 is constructed using support 92 with resistive layer 89 deposited on surface 88 and conducting layers 90 and 91 deposited on surfaces 85 and 86 respectively. The thicknesses of layers 89, 90, and 91 are not shown to scale. The actual thicknesses of layers 89, 90, and 91 may be chosen to be any thickness—even to the extent that, for example, support 92 is replaced by bulk resistive material (for example, graphite doped polymer). However, in the example of FIGS. 5A and 5B, layers 89, 90, and 91 are between $10^{-10}$ and $10^{-5}$ m thick. Resistive layer 89 may be comprised of any known electrically resistive material, however, as an example, resistive layer 89 is comprised of a metal oxide such as tin oxide. Preferably, the resistance of resistive layer 89 is uniform across surface 88, however, in alternate embodiments, the resistance of layer 89 may be non-uniform along the length or width of surface 88. Conductive layers 90 and 91 may be comprised of any electrically conducting material, however as an example, conductive layers 90 and 91 are comprised of a metal, such as gold. Resistive layer 89 is bounded by, and in electrical contact with, conductive layers 90 and 91.

In alternate embodiments, support 92 may be comprised of glass—for example, the type of glass used in the production of microchannel plate detectors (Photonis Inc., Sturbridge, Mass.). Resistive layers may be formed on the surface of such glass by reduction in a hydrogen atmosphere.

in FIG. 5C, abridged quadrupole 84 is constructed using plates 184, 284, 384, and 484. Each of these plates is constructed in the manner described above with respect to plate 184 having supports, and resistive and conductive films. Thus, each plate 184, 284, 384, and 484 has a resistive coating on its inner surface, 88, 93, 94, and 95 respectively. Note that resistive and conductive coatings are not shown in FIG. 5C because these coatings are so thin. In the preferred embodiment, the resistance of the coating on each of the plates 184, 284, 384, and 484 is identical to that on each of the other plates in assembly 84. In alternate embodiments, the resistance of the coating may differ from one plate to another.

As described above with respect to plate 184, each of plates 284, 384, and 484 has a metal coating on those surfaces which appear as legs in the trapezoidal cross section of these plates—i.e. surfaces 141-146. As depicted in FIG. 5C, the metal coated surfaces of adjacent plates are in direct contact with each other when assembled into abridged quadrupole 84. When assembling abridged quadrupole 84, plates 184, 284, 384, and 484 may be held in position by any known prior art means. However, as an example, during the assembly process, the metal coated surfaces of each plate—i.e. surfaces 85, 86, and 141-146—may be coated with a thin layer of solder paste. Plates 184, 284, 384, and 484 may then be held together in a fixture (not shown) such that their metal coated surfaces plus solder paste are in contact as depicted in FIG. 5C. Then plates 184, 284, 384, and 484 together with the fixture may be heated sufficiently to melt the solder paste and thereby solder the metal coatings of adjacent plates together. After cooling, the fixture is removed and the solder will bind the assembly together via the metal coatings on surfaces 85, 86, and 141-146.

Abridged quadrupole 84 has substantially the same geometry as abridged quadrupole 1 and can be used to produce substantially the same field abridged quadrupolar field. Like abridged quadrupole 1, abridged quadrupole 84 is square in cross section, each side being 3.6 mm in length. Like abridged quadrupole 1, abridged quadrupole 84 therefore has an inscribed radius, $r_o$, of 1.8 mm. Electrode sets 100, 200, 300, and 400 of abridged quadrupole 1 are represented in abridged quadrupole 84 by the resistive coatings on plates 184, 284, 384, and 484 respectively.

In accordance with equation (8), a quadrupolar field can be formed in abridged quadrupole 84 by applying a potential of $-\Phi_o/2$ at junctions 97 and 98 between adjacent plates 184 and 484 and plates 284 and 384 respectively and a potential of $\Phi_o/2$ at junctions 96 and 99 between adjacent plates 184 and 384 and plates 284 and 484 respectively. Because the resistive coatings on plates 184, 284, 384, and 484 are uniform, the potential difference, $\Phi_o$, applied between the junctions is divided linearly across the resistive coatings in accordance with equations (8), (9), and (10). That is, the potential on the surface of a resistive coating is a linear function of distance between the junctions bounding the resistive coating. For example, the potential on the surface of resistive coating 89 on plate 184 is given by $(-\Phi_o/2r_o)x$.

The potentials on the resistive coatings of plates 184, 284, 384, and 484 in turn result in an abridged quadrupolar field substantially the same as that depicted in FIG. 1. According to the preferred embodiment, the electric field in the volume encompassed by plates 184, 284, 384, and 484 will take the form given in equation (8).

Figure 6B:
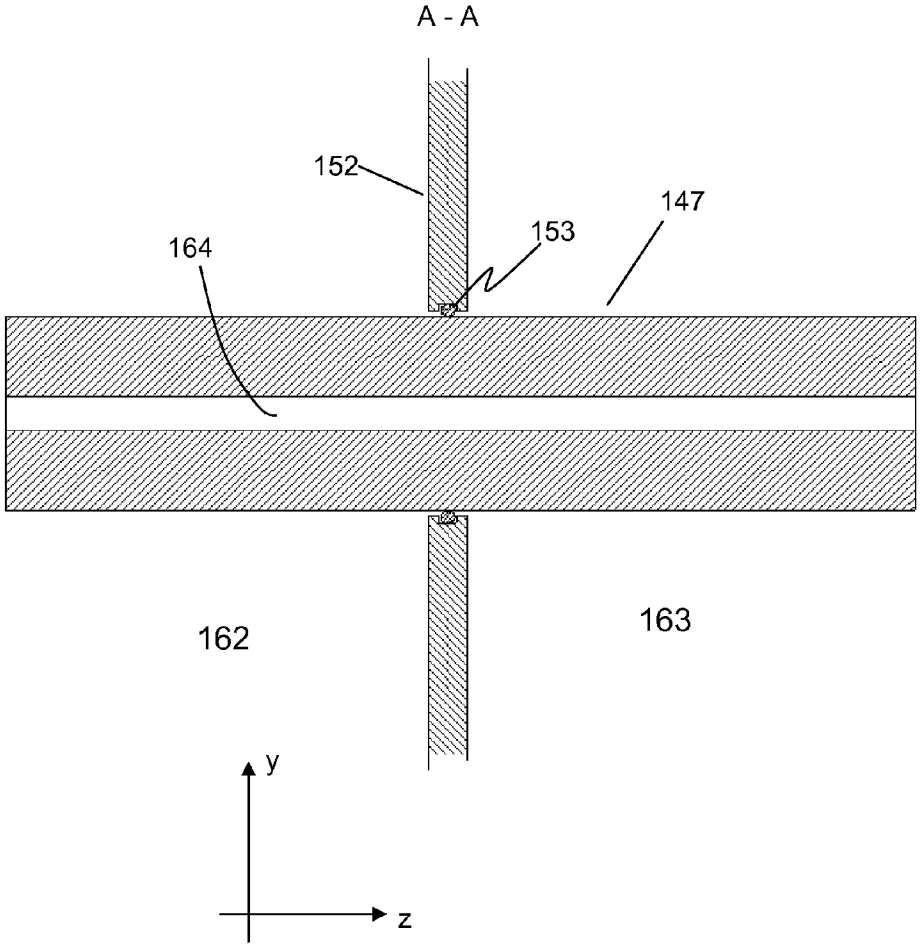
FIG. 6B is a cross-sectional view of an abridged quadrupole according to the present invention comprised of four substantially identical wedge shaped supports arranged symmetrically about a central axis including a pumping restriction and an o-ring.
Figure 6A:
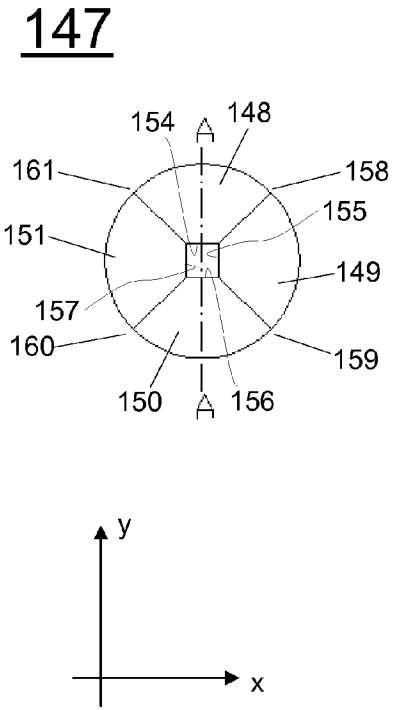
FIG. 6A is an end view of an abridged quadrupole according to the present invention comprised of four substantially identical wedge shaped supports arranged symmetrically about a central axis.

Turning next to FIGS. 6A and 6B, an abridged quadrupole 147 according to the present invention is comprised of four substantially identical wedge shaped supports 148-151 arranged symmetrically about a central axis (i.e. the z-axis). FIG. 6A shows an end view of abridged quadrupole 147 whereas FIG. 6B shows a cross sectional view including pumping restriction 152 and o-ring 153. The construction of abridged quadrupole 147 is substantially identical to that of abridged quadrupole 84 except that supports 148-151 have wedge shaped cross sections whereas supports 184, 284, 384, and 484 of abridged quadrupole 84 have trapezoidal cross sections. Inner surfaces 154, 155, 156, and 157 of supports 148, 149, 150, and 151 respectively are coated with a resistive film of, for example, tin oxide. The surfaces where adjacent supports come in contact—i.e. at junctions 158-161—are coated with a conductor, for example gold. As described above, adjacent supports are bound together by soldering the conductive surfaces of adjacent supports together forming junctions 158-161. Alternatively, the conductive surfaces of adjacent supports may be bound to each other and electrically connected using conductive epoxy.

In one embodiment, the union between adjacent supports, whether via solder or epoxy, is substantially gas tight. Gas and ions may readily move along the axis of abridged quadrupole 147—i.e. the z-axis—however, the flow of gas or ions between the conductive surfaces of adjacent supports—i.e. through junctions 158-161—is negligible. The outer surfaces of supports 148-151 are rounded such that the outer surface of abridged quadrupole 147 is substantially cylindrical. The outer surface of abridged quadrupole 147 and the inner surface of pumping restriction 152 are smooth such that a seal may be formed between abridged quadrupole 147 and pumping restriction 152 via o-ring 153. Pumping restriction 152 is, in effect a wall between two pumping regions 162, and 163 in a vacuum system (not shown). During normal operation, pumping regions 162 and 163 are maintained at two different pressures via a pumping system (not shown). During normal operation, an RF potential applied to junctions 158-161 in accordance with equation (8) tends to focus ions toward the axis of abridged quadrupole 147. Thus, ions entering abridged quadrupole 147 at one end will tend to be guided by its abridged quadrupolar field to the other end. Thus, ions are efficiently transmitted from pumping region 162 to pumping region 163, or vice versa, via abridged quadrupole 147.

However, the flow of gas between pumping regions 162 and 163 is restricted via pumping restriction 152, o-ring 153, and abridged quadrupole 147. To pass between pumping regions 162 and 163, gas must flow through channel 164 of abridged quadrupole 147. Unlike prior art multipoles, abridged multipoles according to the present invention do not require physical gaps between the electrodes forming the multipole fields. As a result, channel 164 has a much smaller effective cross section for a given inscribed diameter than prior art multipole ion guides. Thus, the gas conductance of abridged quadrupole 147 is substantially smaller than that of equivalent prior art quadrupoles. Similarly, abridged multipoles—i.e. hexapoles, octapoles, etc.—according to the present invention will have a much smaller gas conductance than equivalent prior art multipoles.

The gas conductance of abridged quadrupole 147 is inversely proportional to its length, however, its ion conductance is not strongly dependent on its length. Thus, the gas conductance between pumping regions 162 and 163 can be decreased without significantly influencing the transmission of ions from one pumping stage to the next. In an instrument with a differential pumping system between an ion source and an ion analyzer, this implies that a higher pressure difference between pumping stages can be maintained without substantial losses in ion signal.

While the embodiment depicted in FIGS. 6A and 6B has an inscribed radius of 1.8 mm, alternate embodiment abridged quadrupoles may have any desired inscribed radius. The gas conductance of an abridged quadrupole under molecular flow conditions is roughly proportional to the cross sectional area of the channel through the abridged quadrupole. Thus, an abridged quadrupole having an inscribed radius of 0.9 mm would have a gas conductance about four times less than abridged quadrupole 147 assuming the two abridged quadrupoles are the same length. The gas conductance of an abridged quadrupole of any particular dimensions may be estimated using gas flow theory and equations which are well known in the prior art. By selecting an abridged quadrupole of a particular inscribed radius and length, it is possible to construct a system having a desired gas and ion conductance. An abridged multipole similar to multipole 147 may be any length along the central axis. In alternate embodiments, the abridged multipole is arbitrarily short and thus takes the form of a plate with an aperture in it.

In alternate embodiments, the abridged multipole may have a different inscribed diameter at the entrance end than at the exit end. For example, the abridged multipole may have a larger inscribed diameter at the entrance end than at the exit end. This would allow the abridged multipole to collect ions efficiently at the entrance end and focus them down to a tighter beam at the exit end. In this respect, such an abridged multipole could perform the function of an ion funnel.

Figure 7B:
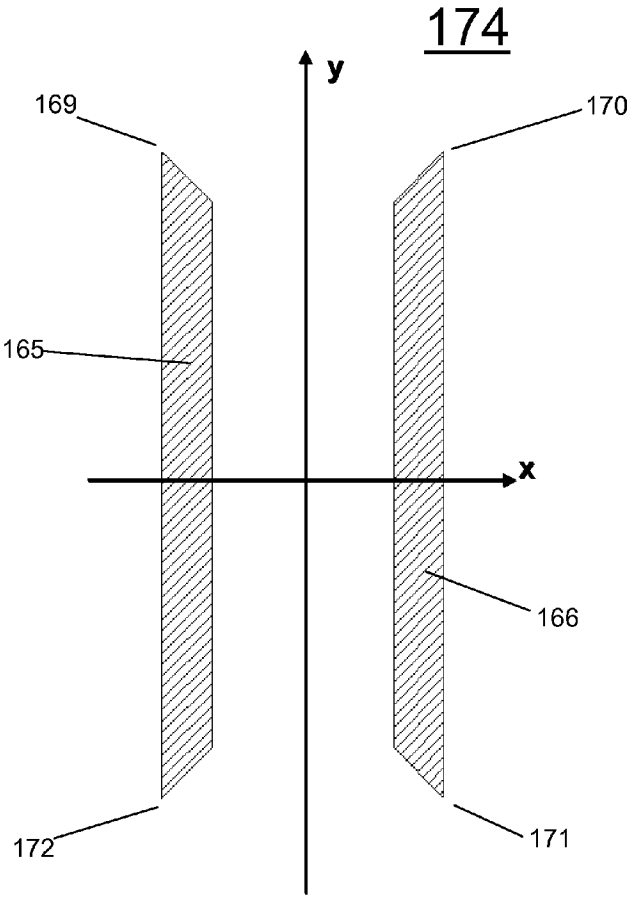
FIG. 7B is a cross sectional view of yet another alternate embodiment abridged quadrupole formed from only two elements.
Figure 7A:
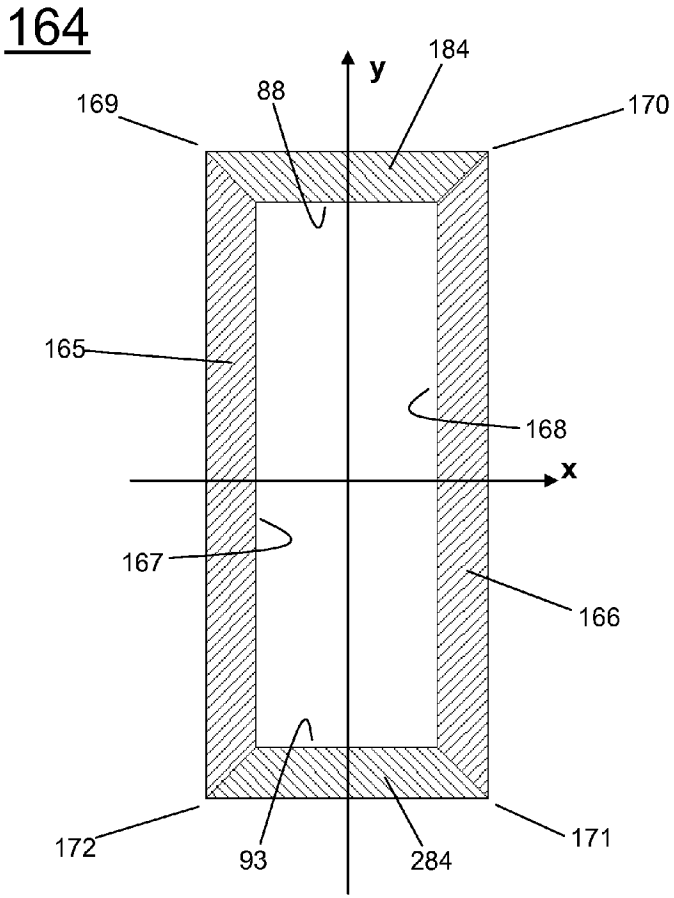
FIG. 7A is a cross-sectional view of an abridged quadrupole according to the present invention wherein the quadrupole is extended further along the y-axis than it is along the x-axis.

Turning next to FIG. 7A, a cross-sectional view of abridged quadrupole 164 according to the present invention is shown wherein the quadrupole is extended further along the y-axis than it is along the x-axis. Abridged quadrupole 164 of FIG. 7A is identical to abridged quadrupole 84 of FIGS. 5A, 5B and 5C except plates 165 and 166 are 10.8 mm long along the y-axis on their inner surfaces 167 and 168 thus producing a rectangular geometry as opposed to the square geometry of quadrupole 84. However, like plates 184 and 284, inner surfaces 167 and 168 are coated with a uniform, electrically resistive coating such that the potentials applied at junctions 169-172 are divided linearly as a function of position along surfaces 167 and 168 in accordance with equation (8).

Here the inscribed diameter, $2r_o$, is taken to be the minimum distance between opposite surfaces along the x axis. By this definition, abridged quadrupoles 84 and 164 have the same inscribed diameter. However, to produce a field of the same strength in abridged quadrupole 164 as in abridged quadrupole 84, the potentials applied to junctions 169-172 will, in accordance with equation (8), need to be three times greater than that applied to the equivalent junctions of quadrupole 84.

In alternate embodiments, the dimensions of an abridged quadrupole along the x and y axes may be any desired dimension. Increasing the dimension of the quadrupole either along the x or y axis will, in accordance with equation (8), require proportionally larger potentials at the junctions of the quadrupole in order to produce the same field within the abridged quadrupole. Making an abridged quadrupole five times larger along the y axis while maintaining its dimension along the x axis will require potentials five times greater at the junctions in order to produce a given field. Alternatively, making an abridged quadrupole five times larger along the y axis while simultaneously decreasing its dimension along the x axis by a factor of five would require the same potentials at the junction to produce a given field.

In alternate embodiments, the length of an abridged quadrupole in one dimension, for example the x-axis, may be arbitrarily small whereas its length in a second dimension, for example along the y-axis, may be arbitrarily large. Notice, in all embodiments, the abridged quadrupole is extended along the z-axis. In the limit, the spatial extent of the quadrupolar field is vanishingly small along the x-axis and has no dependence on position along the z-axis. Thus, in the limit, a spatially one dimensional—in this example, spatially extended with quadrupolar dependence only along the y-axis—quadrupolar field may be formed. Further, in embodiments where the extent of the quadrupolar field is small along the x-axis—e.g. $r_o$<0.5 mm—the abridged quadrupole may act as a "miniature" abridged quadrupole—i.e. taking on many of the attributes of prior art miniature quadrupoles. For example, when $r_o$ is sufficiently small, the abridged quadrupole may be operated at elevated pressures.

FIG. 7B is a cross sectional view of yet another alternate embodiment abridged quadrupole formed from only two elements. Abridged quadrupole 174 depicted in FIG. 7B is identical abridged quadrupole 164 of FIG. 7A except that plates 184 and 284 have been removed. The abridged quadrupole field is thus supported only by plates 165 and 166. The field produced in this way will be similar to that produced via the embodiment of FIG. 7A when applying the same potentials at the junctions 169-172. However, in the embodiment of FIG. 7B the quadrupolar field will be distorted at large values of y. That is, at small values of y, near the axis of the device, the field is well described by equation (8). However, at large values of y, the field will be distorted as compared to equation (8) and the pseudopotential will be weakened relative to a purely quadrupolar field.

Even though the embodiment of FIG. 7B produces a non-ideal field, it does offer the advantage of improved simplicity relative to the embodiment of FIG. 7A in that only two plates are required to produce the field. In further alternate embodiments, the quality of the field—i.e. the degree to which the field resembles an ideal quadrupole field as defined by equation (8)—can be improved either by further elongating plates 165 and 166 along the y-axis or by decreasing the inscribed radius—i.e. bringing the plates 165 and 166 closer together. Given the ratio of the extent of plates 165 and 166 along the y-axis to the inscribed radius, the larger the ratio is, the more ideal will be the field produced via the embodiment.

In further embodiments, a supplemental AC potential may be applied to the abridged quadrupole in order to excite ions of selected m/z's or ranges of m/z's. As discussed above and in prior art literature when placed in a quadrupole field, ions will oscillate about the central axis of the quadrupole with a resonant secular frequency. The resonant frequency of motion is dependent on the m/z of the ion and the amplitude, V, and frequency, f, of the RF waveform applied to the device. As a result, ions of a selected m/z may be excited—that is the amplitude of the ion's oscillation about the central axis may be increased—by applying an additional AC waveform to the device at the resonant frequency of the selected ions. If the amplitude of the ions' oscillations is increased enough, they will be ejected from the quadrupole.

In one method according to the present invention, an excitation potential, $E_y(t)$, is applied to abridged quadrupole 174 via junction 169-172 in a manner consistent with equations (12) and (14). According to the present method, $E_x(t)$ and U are set to 0 V, however, in alternate methods, $E_x(t)$ and U may be set to any desired value. According to the present method the frequency of the excitation potential, $f_y$, is selected to be the same as the secular frequency of the ions of a selected m/z. In further alternate methods, the excitation potential, $E_y(t)$, may be comprised of a multitude of excitation frequencies such that ions of a multitude of m/z values may be excited simultaneously. In such further alternate methods, the excitation potential, $E_y(t)$, may have the form of a SWIFT waveform such that ions of a range of masses or multiple ranges of masses may be excited simultaneously.

The potential, $\Phi(t)$, applied to abridged quadrupole 174 may be complex, as implied by equation (12). However, from equations (12) and (14), it is clear that a homogeneous, oscillating dipole excitation field can be formed along the y-axis by applying the potentials $3r_oA_y \sin(2\pi f_y t)$ at junctions 169 and 170 and the potentials $-3r_oA_y \sin(2\pi f_y t)$ at junctions 171 and 172—keeping in mind of course that these potentials are only components of the complete applied potentials, $\Phi(t)$. Such a dipole field will excite the motion of ions only along the y-axis. If the ions are sufficiently excited, they will be ejected along the y-axis without colliding with plates 165 or 166.

In alternate embodiment abridged quadrupoles, any desired dimensions—i.e. extents along the x, y, and z-axes—may be selected for any of the above embodiments. Especially with respect to embodiments similar to that of FIG. 7B, the dimensions of the device can be chosen such that the quality of the field near the axis of the device is sufficient for analytical purposes. Dimensions appropriate for a higher quality field must be selected in order to obtain higher quality analytical results.

Many prior art analytical quadrupoles are operated at frequencies of near one MHz. That is, the potential applied between the rods to produce the quadrupolar field has an RF frequency, f, of near 1 MHz (see equations (1) and (11)). In principle any frequency, f, might be used, however, higher frequencies tend to produce better analytical results because the number of oscillations in the electric field experienced by the ions as they pass through a quadrupole determines, in part, the resolving power of the quadrupole. In prior art instruments, high frequency, high amplitude waveforms, $\Phi_o(t)$, are typically achieved via resonantly tuned LC circuits. In such systems, energy is repeatedly transferred back and forth between an electric field formed between the rods of the quadrupole—the capacitor in the LC circuit—and a magnetic field formed in the secondary coil of an RF generator. As a result, only a small amount of power is required to maintain the waveform.

In contrast, the embodiments of FIGS. 5A, 5B, 5C, 6A, 6B, 7A and 7B rely on a resistive film deposited on supports—for example as in plates 184, 284, 384, and 484—to set the potentials at the boundaries of the abridged quadrupolar field. Each point on these resistive films has a capacitive coupling to all other points on the resistive films of each plate comprising the abridged quadrupole. Thus, in an equivalent circuit, each point on every resistive film has a capacitive connection to every other point on every resistive film. Thus, to generate a quadrupolar electric field within an abridged quadrupole according to the embodiments of FIGS. 5A, 5B, 5C, 6A, 6B, 7A and 7B each of these small capacitances must be charged appropriately. The charges required to charge these equivalent capacitors and thereby generate the quadrupolar electric field must flow across the resistive films to/from the electrical junctions—for example, junctions 96 and 97. The time constant for charging the surfaces of the resistive films and the frequencies of the waveforms that can be supported via the resistive films is given by the resistance of the film and the overall capacitance of the abridged quadrupole. Of course, the capacitance of the abridged quadrupole is given by its geometry.

The overall capacitance of a typical abridged quadrupole may be, for example, 10 pF. In order to operate such an abridged quadrupole at a frequency of 1 MHz, the RC time constant, $\tau$, of the quadrupole would need to be on the order of $10^{-6}$ s. Therefore, the maximum resistance across the resistive films (taken together in parallel would be on the order of, $R=\tau/C=10^5\Omega$. Such a low resistance will cause a large amount of power to be consumed across the resistive films during operation. For example, if an abridged quadrupole having a resistance of $10^5\Omega$ were to be operated at 1 kVpp then the power consumed across the resistive films would be roughly—$P\sim0.707\ V^2/R=7$ W.

While this kind of power may be supported by appropriate power supplies and waveform generators, it is desirable to reduce the power consumed by, for example, increasing the resistance of the film. One way of increasing the resistance of the film while maintaining the desired potentials on the surface of the resistive film is to increase the capacitive coupling between the resistive film and the junction electrodes. In such a case it is desirable that the capacitive coupling between the resistive film and the junction electrodes is a function of position on the resistive film such that the potential induced on the resistive film via the junction electrodes is a linear function of position. This is, in effect, equivalent to the capacitor divider discussed with respect to FIG. 1 above.

Figure 8B:
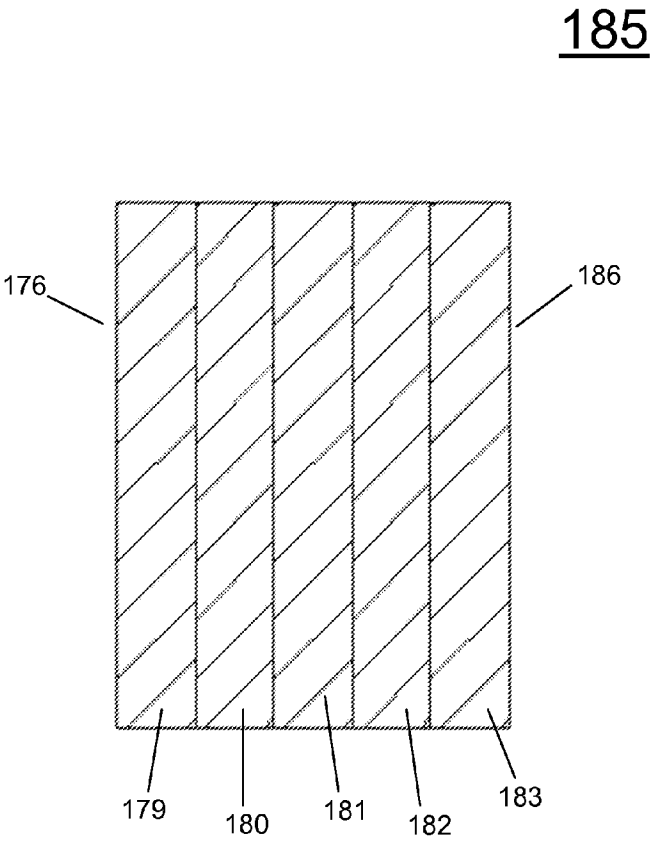
FIG. 8B is a cross-sectional view of set of five elements as described with respect to FIG. 8A stacked together in an assembly.
Figure 8A:
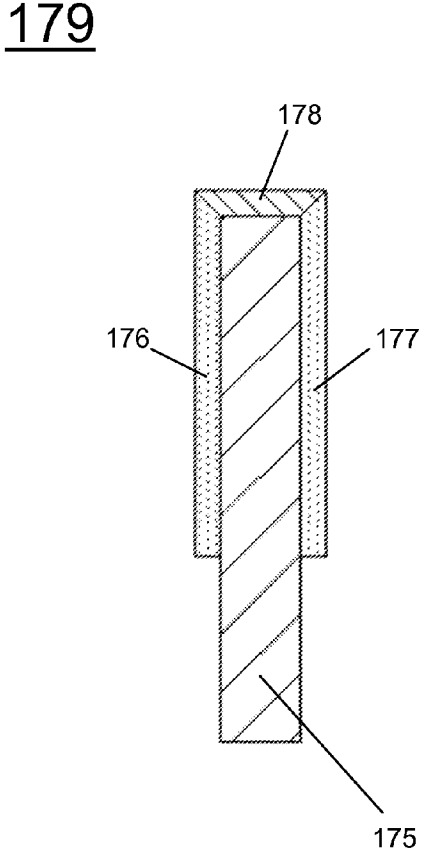
FIG. 8A is a cross sectional view of an element comprised of a rectangular insulating support with thin films of conducting and resistive material on its surfaces.

The embodiments of FIGS. 8A-8C and 9A-9B include such improved capacitive coupling between the resistive film and the junction electrodes. Turning first to FIG. 8A, a cross sectional view is shown of element 179 comprised of a rectangular insulating support 175 with thin films of conducting, 176 and 177, and resistive, 178, material on its surfaces. The thickness of films 176-178 are not shown to scale. The actual thickness of films 176-178 may be chosen to be any thickness—even to the extent that, for example, support 175 is replaced by bulk resistive material (for example, graphite doped polymer). However, in the embodiment of FIG. 8A, films 176-178 are between $10^{-10}$ and $10^{-5}$ m thick. Resistive film 178 may be comprised of any known electrically resistive material, however, as an example, resistive film 178 is comprised of a metal oxide such as tin oxide. Preferably, the resistance of resistive film 178 is uniform across the surface of support 175, however, in alternate embodiments, the resistance of film 178 may be non-uniform along the length or width of support 175. Conductive films 176 and 177 may be comprised of any electrically conducting material, however, as an example, conductive films 176 and 177 are comprised of a metal such as gold. Notice that resistive film 178 is electrically connected to and bounded by conductive films 176 and 177. Notice, also, that insulating support 175 and films 176-178 are extended into the page. The dimensions of the support may be any desired dimensions, however, as an example, support 175 is 0.3 mm thick, 2 mm wide, and 100 mm long (into the page). Conducting films 176 and 177 on opposite sides of support 175 form a capacitor. The capacitance between conductors 176 and 177 in the present embodiment is $C=\epsilon\epsilon_r A/d=8.85*10^{-12}\times3\times(1.3*10^{-3}\times0.1)/3*10^{-4}\sim11$ pF.

In FIG. 8B, a set of five elements as described with respect to FIG. 8A are shown, in cross section, stacked together in an assembly. Each element 179-183 has on it thin conductive and thin resistive films as described with respect to FIG. 8A. Elements 179-183 are aligned with each other such that the metal coated surfaces of adjacent elements are in direct contact with each other when assembled into a set as shown in FIG. 8B. Notice that each of elements 179-183 is oriented such that the resistive film of each element is facing the same way—i.e. toward the top of the page. When assembling set 185, elements 179-183 may be held in position by any known prior art means. However, as an example, during the assembly process, the metal coated surfaces of each plate may be coated with a thin layer of solder paste. Elements 179-183 may then be held together in a fixture such that their metal coated surface plus solder paste are in contact as depicted in FIG. 8B. Then elements 179-183 together with the fixture may be heated sufficiently to melt the solder paste and thereby solder the metal coatings of adjacent elements together. After cooling, the fixture is removed and the solder will bind the assembly together via the metal coatings on elements 179-183. Notice in the complete assembly that the metal films on opposite sides of elements 179-183 form a capacitor divider and the resistive film forms a resistor divider. An electrical potential may be applied across set 185 via the conducting films 176 and 186 at either end of the set.

According to the present embodiment, the capacitances between opposite sides of each of elements 179-186 are all the same. This results in a linear division of potentials applied between conducting films 176 and 186 at opposite ends of set 185. In alternate embodiments the capacitance across the elements forming a set may be any selected capacitance and this capacitance may vary as a function of position within the assembly so as to produce a non-linear division of potentials applied across the set. The capacitance across an element may be varied by, for example, changing the thickness of the support, the dielectric constant of the insulating support, or the area of the conductive coatings on the insulating support.

According to the present embodiment, the resistances across each of elements 179-183 are all the same. This results in a linear division of potentials applied at opposite ends 176 and 186 of set 185. In alternate embodiments, the resistance across the elements forming a set may be any desired resistance and this resistance may vary as a function of position within the assembly so as to produce a non-linear division of potentials applied across the set. The resistance across an element may be varied by changing, for example, the composition or thickness of the resistive film.

Figure 8C:
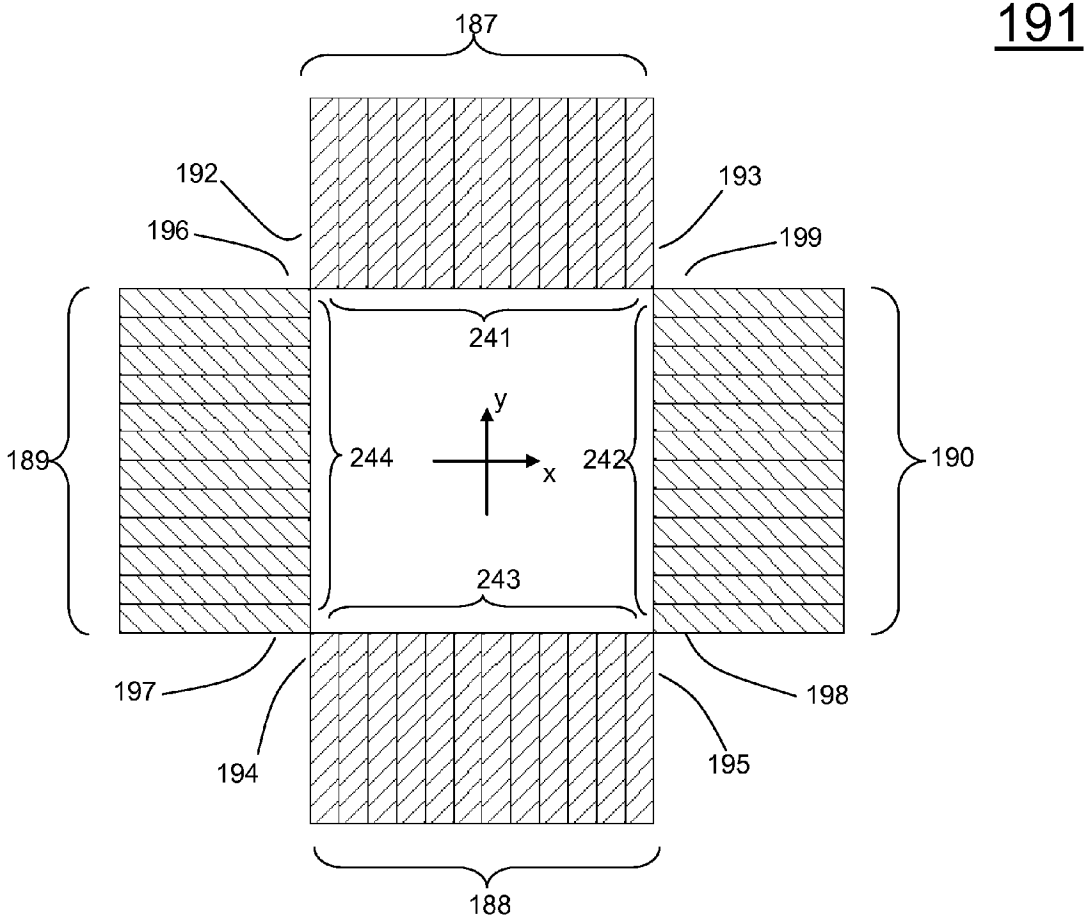
FIG. 8C is a cross-sectional view of an abridged quadrupole formed from sets of elements as described with reference to FIGS. 8A and 8B.

Turning next to FIG. 8C, shown is a cross sectional view of abridged quadrupole 191 formed from sets of elements as described with reference to FIGS. 8A and 8B. Abridged quadrupole 191 is formed from four sets of elements, 187-190, arranged symmetrically about a central axis—i.e. the z-axis. Each set of elements, 187-190, is in turn comprised of 12 elements, each of which is constructed in a similar manner as element 179 as described with reference to FIG. 8A. Notice that the resistive films 241-244 of each set are facing the interior of abridged quadrupole 191. As described with reference to FIG. 8B, an electrical potential may be applied across each of sets 187-190 via the conducting films 192 and 193, 194 and 195, 196 and 197, and 198 and 199 at either end each of the sets 187, 188, 189, and 190 respectively. According to the present embodiment, the capacitances and resistances between opposite sides of each element are the same for every element. This results in a linear division of potentials applied between conducting films 192 and 193, 194 and 195, 196 and 197, and 198 and 199 at either end each of the sets 187, 188, 189, and 190 respectively. By applying the potentials $\Phi_o(t)/2$ at conducting films 192, 195, 196, and 198, and the potential $-\Phi_o(t)/2$ at conducting films 193, 194, 197, and 199, an abridged quadrupolar field can be established in accordance with equation (8).

Figure 9A:
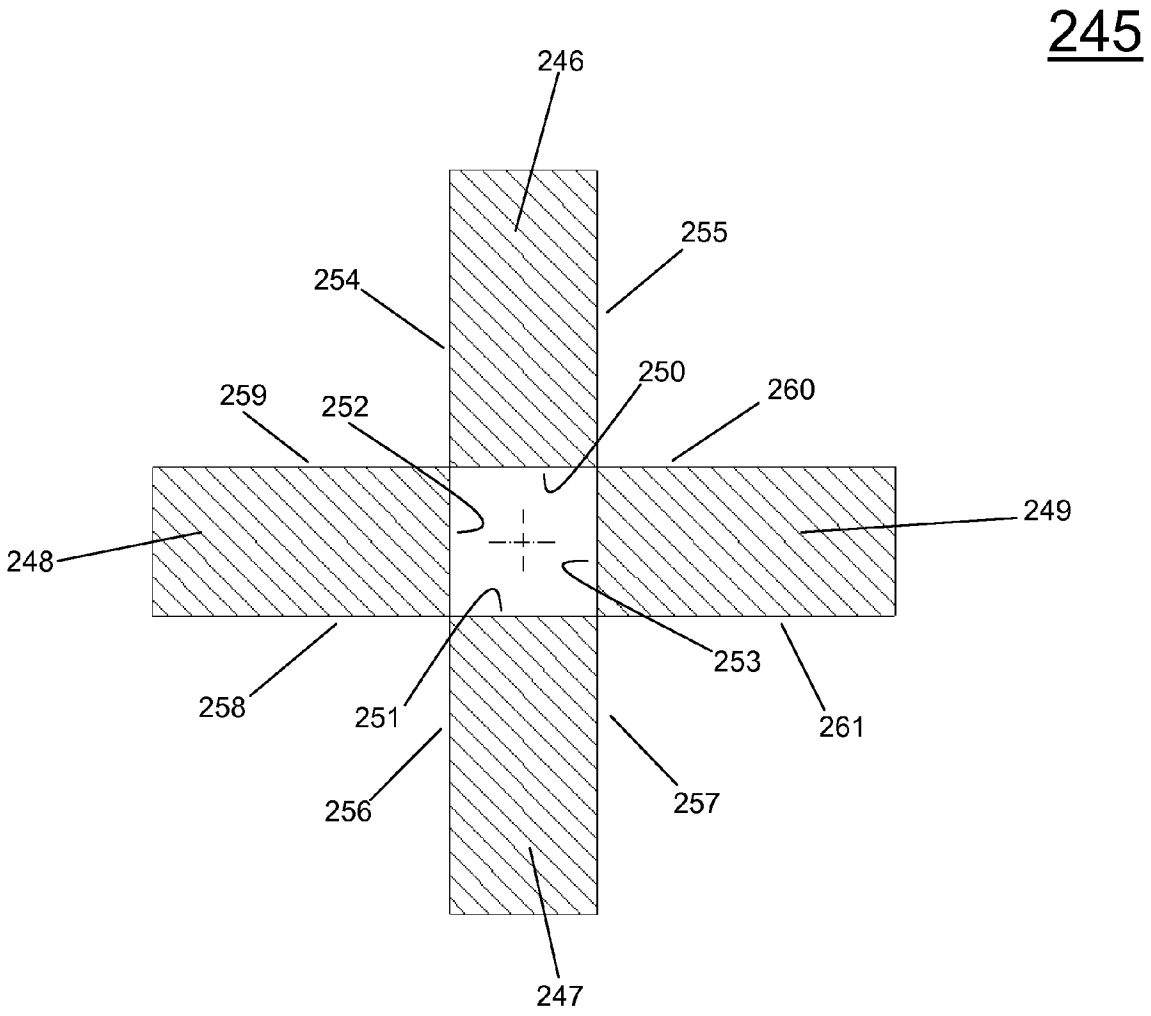
FIG. 9A is a cross-sectional view of yet another alternate embodiment abridged quadrupole consisting of four elements, each of which is of substantially the same construction as that described with reference to FIG. 8A.
Figure 9B:
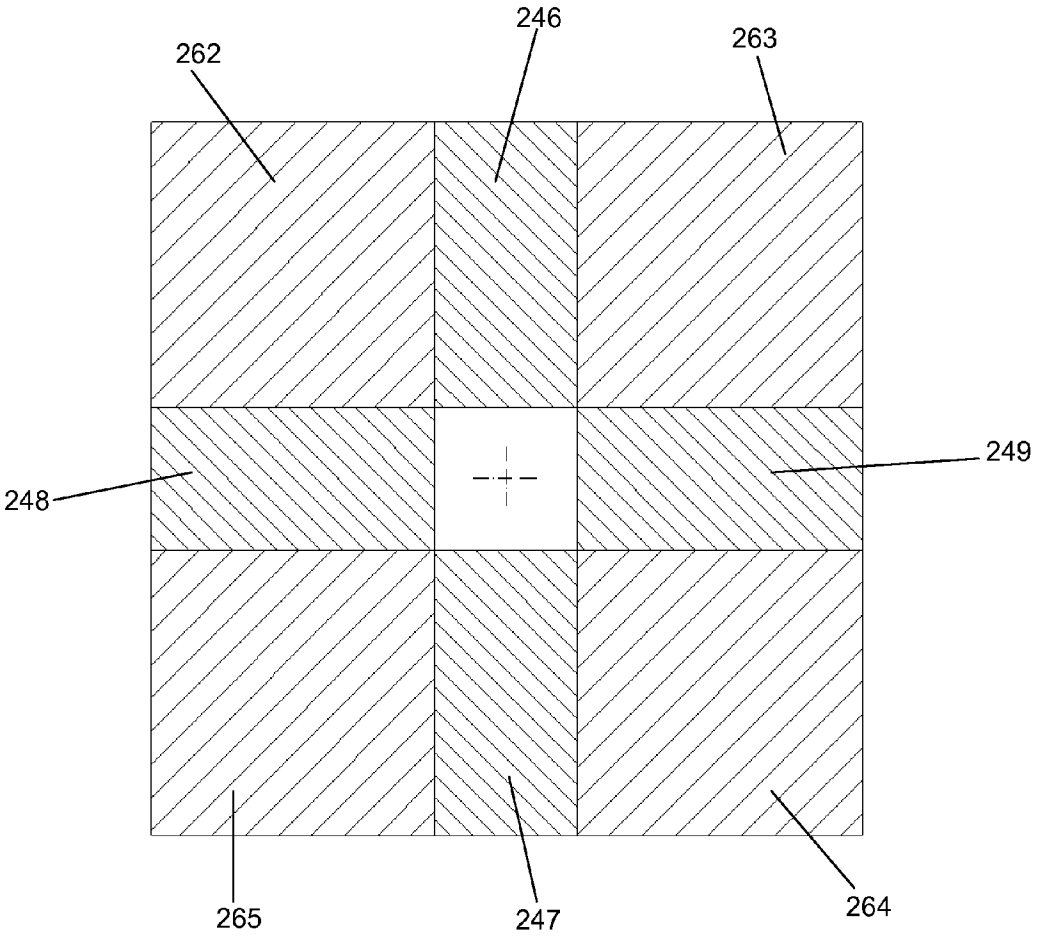
FIG. 9B is a cross-sectional view of the abridged quadrupole of FIG. 9A now also showing braces used for holding the assembly together.

FIGS. 9A and 9B depict a cross sectional view of yet another alternate embodiment abridged quadrupole 245. The embodiment according to FIG. 9A consists of four elements, 246-249. Each of the four elements 246-249 are of substantially the same construction as element 179 described with reference to FIG. 8A. Each element 246-249 is constructed of an insulating support of rectangular cross section. The inner surfaces 250-253 of the supports are covered with a thin film of electrically resistive material. Adjacent surfaces 254-261 are covered with a thin film of electrically conducting material. Within each element 246-249, the conductive and resistive films are in electrical contact with each other. Notice that elements 246-249 and their conducting and resistive films are extended along the z-axis—i.e. into the page. The dimensions of elements 246-249 may be any desired dimensions, however, as an example, elements 246-249 are 5.8 mm thick, 11.6 mm wide, and 200 mm long (into the page). In alternate embodiments, the insulating supports of elements 246-249 may be comprised of any desired insulating material, however, as an example, the supports of elements 246-249 are constructed of a ceramic having a dielectric constant of 20. The high dielectric constant of the ceramic used as the supports in elements 246-249 results in a high capacitive coupling between the resistive film and the conductive films. This increased capacitive coupling between the resistive film and conductive films within each of elements 246-249 causes charge to be induced on the surface of the resistive film when a potential is applied to the conductive films. In effect, the coupling of the resistive film to the conductive films in this way is the same as that of a capacitor divider. The capacitively induced potential on the resistive film is a linear function of position on the film—that is, the distance between the conductive films—in accordance with equation (8).

If one of the elements 246-249 were isolated from the others and from all other electrical influences, then the dielectric constant of the ceramic support would have no influence on the potential induced on the resistive film. Even a relatively weak coupling of the resistive film to the conductive films would result in a linear dependence of induced potential vs. position on the film. However, when in assembly 245 as depicted in FIG. 9A, the capacitively induced potential on the resistive films of any of elements 246-249 will depend also on the potentials on and capacitive coupling of resistive films to each other. The capacitive coupling of the resistive films to the conductive films and the coupling of the resistive films to each other can be calculated by methods well known to the prior art. However, it should be clear from the above discussion that in order to induce as near an ideal potential distribution as possible on the resistive films, one must increase the coupling of the resistive films to the conducting films and/or decrease the coupling of the resistive films—i.e. between elements 246-249—to each other. It is for this reason that using a ceramic having a high dielectric constant as the support in elements 246-249 is valuable. Using ceramic having a dielectric constant of 20 improves the coupling of the resistive film within an element 246-249 to the conductive films within that element by a factor of 20.

FIG. 9B depicts a cross sectional view of abridged quadrupole 245 of FIG. 9A now with rectilinear braces 262-265 holding elements 246-249 in the assembly. According to the present embodiment, each brace 262-265 has a square cross section—11.6×11.6 mm—and extends the length of quadrupole 245—i.e. 20 cm. In alternate embodiments, braces 262-265 need not extend the entire length of abridged quadrupole 245. In alternate embodiments, braces 262-265 need not be square in cross section, but rather may be any desired cross sectional shape including triangular or L shaped in cross section. According to the present embodiment, braces 262-265 are substantially rigid and electrically conducting—for example, gold coated steel.

Each of the metal coated surfaces 254-261 of elements 246-249 are in contact with one of the surfaces of one of the braces 262-265 when assembled into abridged quadrupole 245 as shown in FIG. 9B. When assembling quadrupole 245, elements 246-249, and braces 262-265 may be held in position by any known prior art means. However, as an example, during the assembly process, the metal coated surfaces 254-261 of each element 246-249 may be coated with a thin layer of solder paste. Elements 246-249, and braces 262-265 may then be held together in a fixture (not shown) such that the metal coated surfaces of the elements plus solder paste are in contact with the braces as depicted in FIG. 9B. Then elements 246-249 and braces 262-265 together with the fixture may be heated sufficiently to melt the solder paste and thereby solder metal coatings 254-261 together with braces 262-265. After cooling, the fixture is removed and the solder binds the assembly together. An electrical potential may be readily applied via braces 262-265.

The rectilinear construction of abridged quadrupole 245 has the advantage that it is easy to fabricate with high mechanical precision. The improved coupling between the resistive and conductive films allows for the use of a resistive film having a higher resistance than that used in abridged quadrupole 84. This in turn presents less of a load to the power supply. However, the need to use an insulator having a high dielectric constant also increases the capacitance between conducting films on opposing sides of the supports in elements 246-249. Assuming the supports have a dielectric constant of 20, the capacitance between the conductive films on opposite sides of each of elements 246-249 in the present embodiment is $C=\epsilon\epsilon_r A/d=8.85*10^{-12}\times 20\times(1.16*10^{-2}\times 0.2)/5.8*10^{-3}\sim 70$ pF. Because abridged quadrupole 245 includes four elements 246-249, its total capacitance is 280 pF—significantly higher than conventional prior art quadrupoles of similar dimensions.

Figures 10A, 10B:
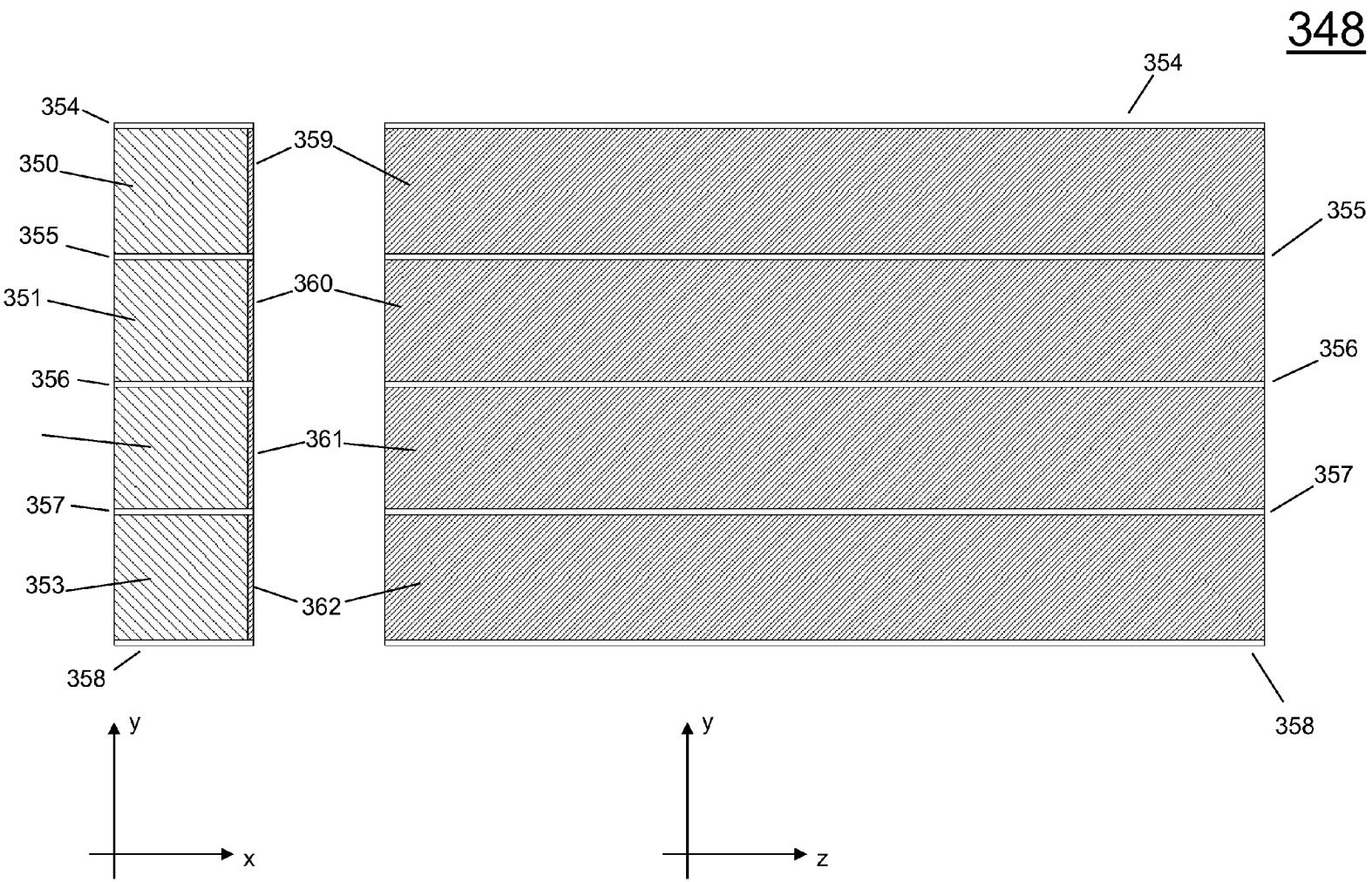
FIG. 10A is an end view of a set of four elements used in the construction of the abridged quadrupole array of FIG. 10C.
FIG. 10B is a side view of a set of four elements used in the construction of the abridged quadrupole array of FIG. 10C.
Figure 10C:
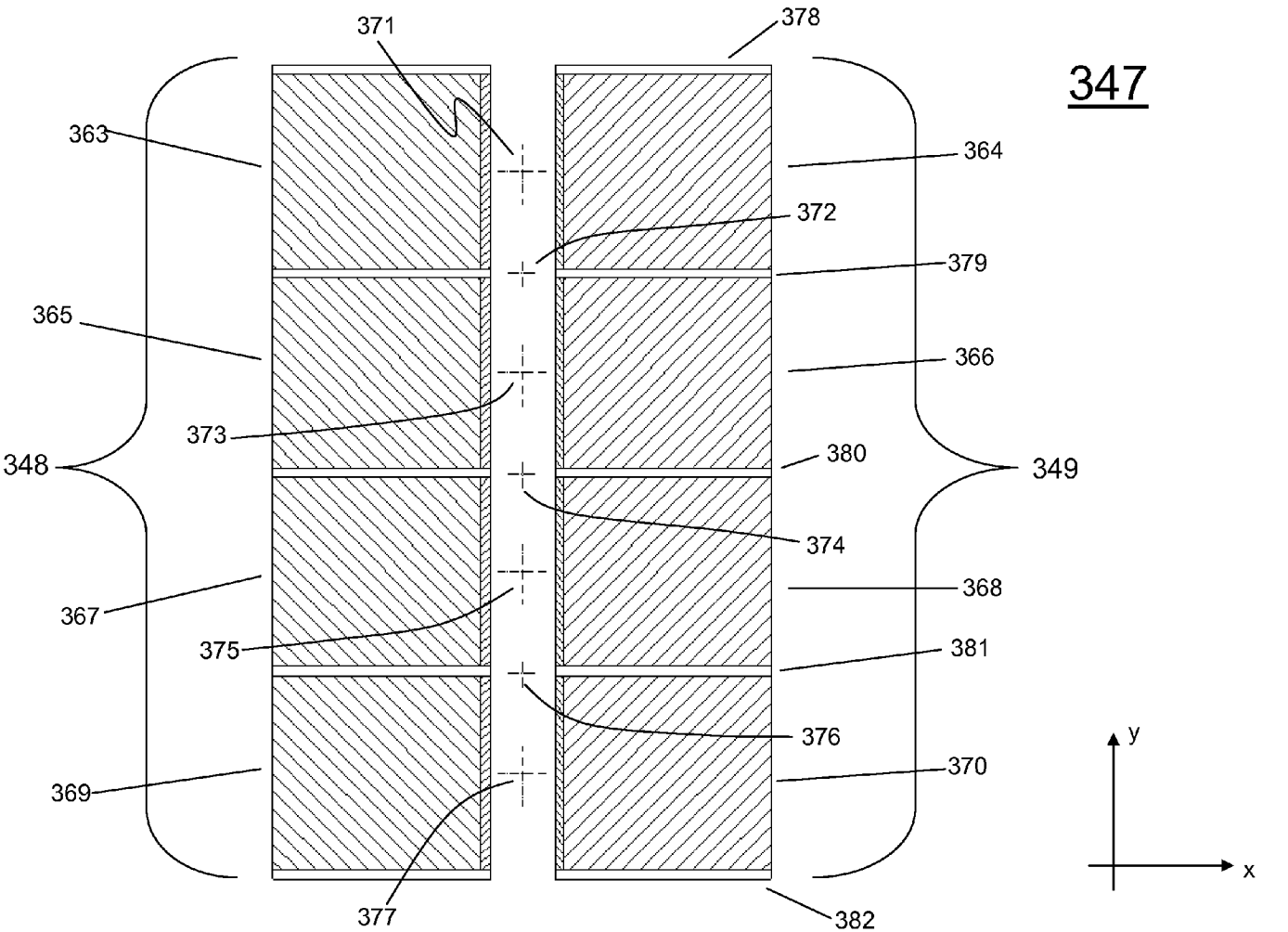
FIG. 10C is an end view of an abridged quadrupole array comprised of four abridged quadrupoles arranged linearly.

Turning next to FIGS. 10A, 10B and 10C, an abridged quadrupole array 347 is shown comprised of four abridged quadrupolar fields arranged linearly. In alternate embodiments, the abridged quadrupole may be comprised of any desired number of quadrupolar fields. Abridged quadrupole array 347 is constructed using two sets of elements 348 and 349 each having similar construction as sets 187-190 described with reference to FIGS. 8A-8C. FIG. 10A depicts an end view of set 348 whereas FIG. 10B depicts a side view of set 348. Set 348 is comprised of square insulating supports 350-353 separated from each other and bounded by electrically conducting plates 354-358. Conducting plates 354-358 may be comprised of any desired conducting material, however, as an example, they are comprised of steel. The inner surfaces of supports 350-353—i.e. those surfaces which face the interior of abridged quadrupole array 347—are covered with electrically resistive material 359-362. The thickness of resistive material 359-362 may be chosen to be any thickness—even to the extent that, for example, supports 350-353 are replaced by bulk resistive material (for example, graphite doped polymer). However, in the present embodiment, resistive material 359-362 is 0.25 mm thick. Resistive material 359-362 may be comprised of any known electrically resistive material, however, as an example, resistive layer 359-362 is comprised of graphite doped polypropylene. Preferably, the resistance of resistive material 359-362 is uniform across the surface of supports 350-353, however, in alternate embodiments, the resistance of resistive material 359-362 may be non-uniform along the length or width of supports 350-353. Notice that each of conductive plates 354-358 is in electrical contact with resistive material 359-362. In alternate embodiments, any of the above described methods of capacitively coupling the resistive film to the metal plates may be used. However, in the present embodiment, the capacitive coupling of resistive films 359-362 to adjacent metal plates 354-358 is increased by making supports 350-353 from ceramic having a high dielectric constant.

In alternate embodiments, the dimensions of the support may be any desired dimensions, however, as an example, each of supports 350-353 is 5 mm square in cross section by 35 mm long. In alternate embodiments, the width of each support is 5 mm, however, the height of the supports varies. For example, in one alternate embodiment, supports 350, 351, 352, and 353 are 5 mm, 7 mm, 9 mm, and 11 mm high respectively—i.e. along the y-axis. Metal plates 354-358 may be of any desired dimensions, however, in the present embodiment, they are 5.25 mm wide, 0.25 mm thick and 35 mm long. Conducting plates 354-358 on opposite sides of each support 350-353 form a capacitor. The capacitance for example, between plates 354 and 355 in the present embodiment is $C=\epsilon\epsilon_r A/d=8.85*10^{-12}\times 100\times(5*10^{-3}\times 0.033)/5*10^{-3}\sim 30$ pF. According to the present embodiment, the capacitances between plates on opposite sides of each of supports 350-353 are all the same. In alternate embodiments, the capacitance across the supports forming a set may be any selected capacitance and this capacitance may vary as a function of position within the assembly. The capacitance across an element may be varied by, for example, changing the thickness of the support, the dielectric constant of the insulating support, or the area of the conductive plates bounding the insulating support.

According to the present embodiment, the resistances through resistive material 359-362 between each of adjacent conducting plates 354-358 are all the same. In alternate embodiments, the resistance between adjacent conducting plates within a set may be any desired resistance and this resistance may vary as a function of position within the assembly so as to produce a non-linear division of potentials applied across the set. The resistance between adjacent conducting plates may be varied by changing, for example, the composition or thickness of the resistive film.

Turning next to FIG. 10C, shown is a cross sectional view of abridged quadrupole array 347 formed from two sets of elements 348 and 349 which are constructed as described with reference to FIGS. 10A and 10B. Abridged quadrupole array 347 is formed by placing two substantially identical sets facing and parallel to each other, and spaced apart from each other along the x-axis. In alternate embodiments, a wide range of geometries and dimensions may be used. For example, in alternate embodiments, sets 348 and 349 may be non-parallel to each other along either the y or z-axes or both. The separation of sets 348 and 349 along the x-axis may vary widely, however, as an example, the spacing between sets 348 and 349 in the present embodiment is 1.66 mm. In as much as sets 348 and 349 have a length of 35 mm as detailed above, abridged quadrupole array 347 also has a length of 35 mm.

Abridged quadrupole array 347 may be viewed as being comprised of four pairs of elements 363 and 364, 356 and 366, 367 and 368, and 369 and 370. Each pair of elements substantially resembles "one dimensional" abridged quadrupole 174 as depicted in FIG. 7B. Each pair of elements can be used to form an abridged quadrupole field around one of central axes 371, 373, 375, or 377. To produce abridged quadrupole fields in array 347, potentials are applied at conducting plates 354-358 and 378-382. As implied above, the inscribed radius of each abridged quadrupole in array 347 is 0.833 mm. Notice that this is ⅓ the distance along the y-axis from one of the central axes—for example axis 371—to an adjacent conducting plate—for example plate 354. As $y=+/-3r_o$ and $x=+/-r_o$ at the conducting plates 354-358 and 378-382, in accordance with equation (8), the potential $3\Phi_o(t)/2$ should be applied at plates 354, 356, 358, 379 and 381 and the potential $-3\Phi_o(t)/2$ should be applied at plates 355, 357, 378, 380, and 382. Such potentials will result in abridged quadrupolar fields about each of axes 371, 373, 375, and 377. The quadrupolar fields thus formed will be of substantially equal spatial extent, quality, and field strength as one another. Each of the abridged quadrupolar fields thus formed will be highly quadrupolar in nature near axes 371, 373, 375, and 377 and less quadrupolar further from the axes.

Each of the abridged quadrupolar fields in array 347 will tend to focus ions towards the axis of that field—i.e. axes 371, 373, 375, and 377. Abridged quadrupole array 347 has two ends along the z-axis through which ions may enter and exit the array. According to the present embodiment, ions may enter through one end of array 347, be focused by a quadrupole field toward one of axes 371, 373, 375, or 377, and move, under the influence of the ion initial kinetic energy, via diffusion, or Coulombic influences through array 347 toward and out of the opposite end of the array. In accordance with equations (8)-(14), potentials can be applied at conducting plates 354-358 and 378-382 so that array 347 acts to transmit ions over a broad or narrow mass range from an entrance of the array to an exit end—i.e. along the z-axis. Alternatively, in accordance with equations (8)-(14), the motion of ions of selected masses or mass ranges may be excited so as to radially eject unwanted ions while transmitting ions having desired masses.

Ions transmitted by array 347 may be all from the same ion source. Alternatively, ions transmitted along one of the axes—for example axis 371—may originate from a first sample via a first ion source whereas ions transmitted along another axis—for example axis 375—may originate from second sample via a second ion source. Further, a first type of ion might be transmitted along one axis whereas a second type of ion may be transmitted simultaneously along a second axis of array 347. For example, negative ions may be injected into array 347 along axis 371 while simultaneously positive ions are injected into the array along axis 377. In this way both positive and negative ions might be transmitted or analyzed simultaneously.

According to an alternate method of operation, potentials are applied to conductive plates 354-358 and 378-382 so as to form not four abridged quadrupole fields but rather just two or only one. According to this method, two abridged quadrupolar fields are formed, one about each of axes 372 and 376 by applying the potential $3\Phi_o(t)$ at plates 354, 380, and 358, the potential $-3\Phi_o(t)$ at plates 378, 356, and 382, and ground potential at plates 355, 379, 357, and 381. Each of the abridged quadrupole fields thus formed would cover half the volume between sets 348 and 349. Alternatively, a single abridged quadrupole field covering the entire volume between sets 348 and 349 can be formed about axis 374 by applying the potential $6\Phi_o(t)$, at plates 354 and 382, the potential $-6\Phi_o(t)$ at plates 378 and 358, the potential $3\Phi_o(t)$ at plates 355 and 381, the potential $-3\Phi_o(t)$ at plates 379 and 357, and ground potential at plates 356 and 380.

In further alternate methods, not all of the quadrupoles in array 347 need be operated simultaneously. Rather, potentials may be applied between selected plates while others are not actively driven. For example, the potential $3\Phi_o/2$ may be applied at plates 354 and 379 and the potential $-3\Phi_o/2$ may be applied at plates 378 and 355 while all other plates 356-358 and 380-382 are held at ground potential. In this way, an abridged quadrupole field is formed only about axis 371.

In alternate embodiments, the width of each support may be, for example, 5 mm, however, the height of the supports varies. For example, in one alternate embodiment, elements 363 and 364 are 5 mm in height, elements 365 and 366 are 6.67 mm in height, elements 367 and 368 are 8.33 mm in height, and elements 369 and 370 are 10 mm in height—i.e. along the y-axis. In one such alternate embodiment, element sets 348 and 349, modified to comprise elements that are 5, 6.67, 8.33, and 10 mm high are still positioned facing, and parallel to each other and having an $r_o$ of 0.833 mm. Note that element 363 having a height of 5 mm in set 348 is adjacent to and aligned with element 364 having a height of 5 mm in set 349. Similarly, the elements having heights of 6.67, 8.33, and 10 mm in set 348 are adjacent to and aligned with the elements having heights of 6.67, 8.33, and 10 mm respectively in set 349. In one preferred method, the potential $3\Phi_o(t)/2$ is applied at plates 354, 356, 358, 379 and 381 and the potential $-3\Phi_o(t)/2$ is applied at plates 355, 357, 378, 380, and 382. As described above, if element 363-370 were the same size, the field strength about each axis 371, 373, 375, and 377 would be the same, however, because elements 363-370 in the present alternate embodiment have different heights from one another, the field strength will also vary from one abridged quadrupole to the next within this alternate embodiment array. Abridged quadrupoles having supports of heights 6.67, 8.33, and 10 mm will have field strengths 0.75, 0.6, and 0.5 times respectively the field strength of the abridged quadrupole having supports of 5 mm height. This difference in field strength will result in the transmission of different masses or mass ranges through the different abridged quadrupoles of the array. The abridged quadrupole having supports of 5 mm height will transmit ions of higher mass while simultaneously the abridged quadrupole having supports of 10 mm height will transmit ions of lower mass. In this manner, an abridged quadrupole array can be made and operated so as to transmit ions wherein the transmitted mass is a function of position within the array.

Further, in embodiments where the extent of the fields of the abridged quadrupole array are small along the x-axis—e.g. $r_o<0.5$ mm—the abridged quadrupole array may act as a "miniature" abridged quadrupole array—i.e. taking on many of the attributes of prior art miniature quadrupole arrays. For example, when $r_o$ is sufficiently small, the abridged quadrupole array may be operated at elevated pressures.

Figure 11:
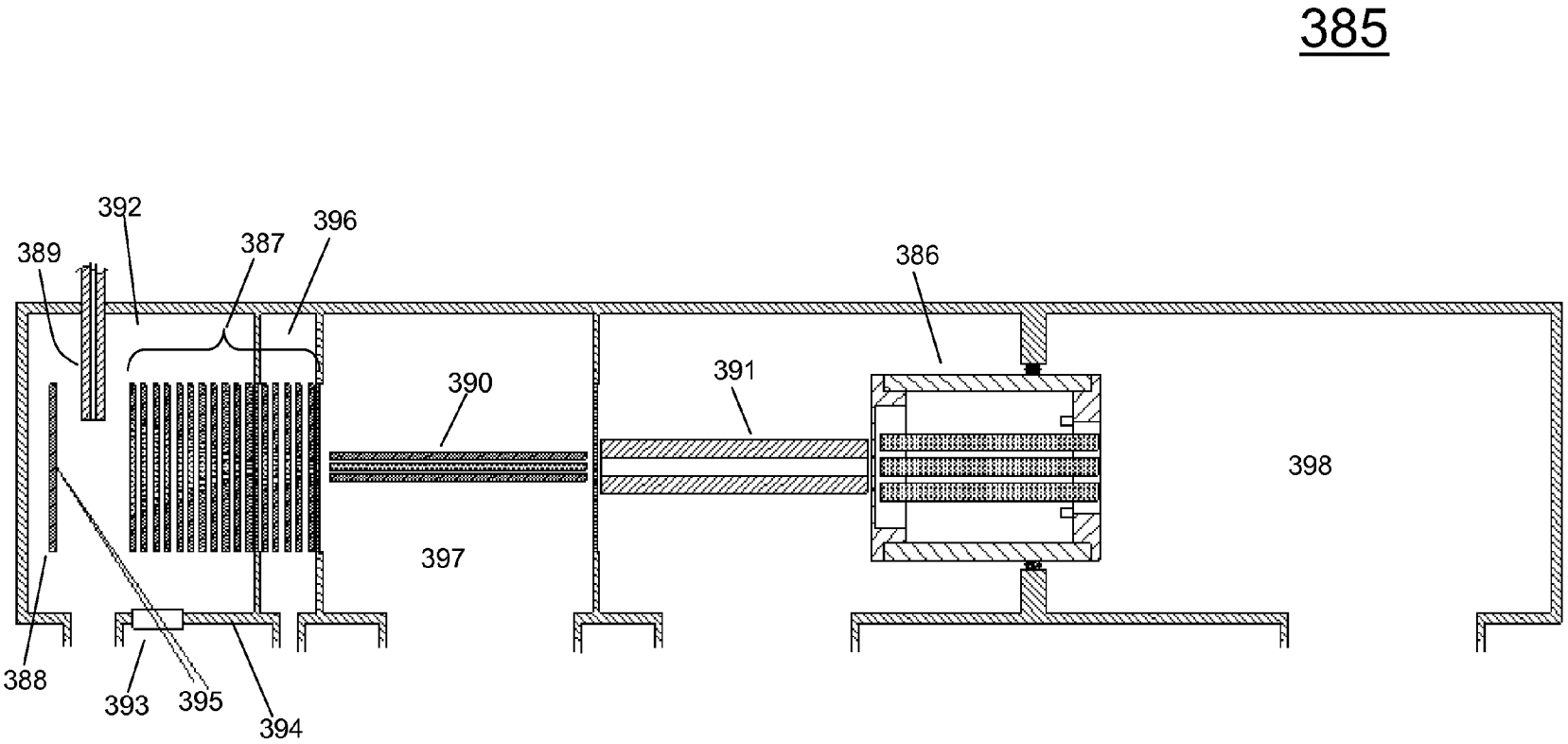
FIG. 11 shows a mass spectrometry system including an ion source, an ion guide, an abridged quadrupole, and a mass analyzer.

The various embodiments of the abridged multipoles and abridged quadrupoles described above may be incorporated into a wide variety of mass spectrometry systems. Any number of abridged multipoles arranged in parallel or in series may be used in conjunction with any prior art ion production means, any combination of other types of mass analyzers, collision cells, ion detectors, digitizers, and computer and software systems. However, as an example, shown in FIG. 11 is mass spectrometry system 385, including collision cell 386, ion guide 387, MALDI target 388, orthogonal glass capillary 389 by which ESI ions may be introduced, multipole ion guide 390, and abridged quadrupole 391. Either MALDI or ESI may be used to produce ions simultaneously, in close succession, or independently. Of course, any other prior art ionization means may be used to produce ions in conjunction with the present embodiment.

Gas and ions are introduced from, for example, an elevated pressure ion production means (such as electrospray ionization) into chamber 392 via capillary 389. After exiting capillary 389 the directional flow of the ions and gas will tend to continue in the direction of the capillary axis. Deflection electrode 388 is preferably a planar, electrically conducting electrode oriented perpendicular to the axis of ion guide 387 and parallel to the axis of capillary 389. A repulsive potential is applied to electrode 388 so that ions exiting capillary 389 are directed toward and into the inlet of ion guide 387. Through a combination of DC and RF potentials and the flow of gas—by methods well known in the prior art—ions are passed through ion guide 387 and into downstream optics.

Alternatively, ions may be produced by Matrix-Assisted Laser Desorption/Ionization (MALDI). To produce MALDI ions, samples are prepared and deposited onto electrode 388. Window 393 is incorporated into the wall of chamber 394 such that laser beam 395 from a laser positioned outside the vacuum system may be focused onto the surface of electrode 388 such that the sample thereon is desorbed and ionized. Again, a repulsive potential on electrode 388 directs the MALDI ions into ion guide 387.

As known from the prior art, two stage ion guide 387 (a.k.a. an ion funnel) is capable of accepting and focusing ions even at a relatively high pressure (i.e., ~1 mbar in first pumping chamber 392) and can efficiently transmit them through a second, relatively low pressure differential pumping stage (i.e., ~$5\times10^{-2}$ mbar in second pumping chamber 396) and into a third pumping chamber 397. Once in chamber 397 ions pass into and through RF multipole ion guide 390. RF multipole ion guide 390 is constructed and operated by methods known in the prior art. Ion guide 390 may be a quadrupole, hexapole, octapole, or other higher order multipole. In alternate embodiments, ion guide 390 may be an abridged multipole—for example, an abridged quadrupole. While in ion guide 390, ions undergo collisions with gas molecules and are thereby cooled towards the axis of the ion guide. After passing through ion guides 387 and 390, the ions are mass analyzed by abridged quadrupole 391. That is, ions of a selected mass-to-charge ratio are passed from ion guide 390 to collision cell 386 via abridged quadrupole 391 while rejecting substantially all other ions. In order to avoid collisions with gas interfering with the mass analysis, the pressure in abridged quadrupole 391 should be maintained at $10^{-5}$ mbar or less. In the present embodiment, a DC potential is applied between all adjacent elements so as to force the ions through the system from upstream elements (e.g., funnel 387) toward downstream elements (e.g., cell 386)—that is, from left to right in FIG. 11.

Collision cell 386 is comprised of an RF multipole ion guide in an enclosed volume and is constructed and operated by methods known in the prior art. Collision cell 386 may include a quadrupole, hexapole, octapole, or other higher order multipole. In alternate embodiments, the RF multipole ion guide of the collision cell may be an abridged multipole—for example, an abridged quadrupole. The gas pressure in collision cell 386 is preferably $10^{-3}$ mbar or greater. Typically the gas is inert (e.g., Nitrogen or Argon), however, reactive species might also be introduced into the cell. When the potential difference between abridged quadrupole 391 and cell 386 is low, for example 5V, the ions are simply transmitted therethrough. That is, the energy of collisions between the ions and the gas in ion guide 386 is too low to cause the ions to fragment. However, if the potential difference between abridged quadrupole 391 and cell 386 is high, for example 100 V, the collisions between the ions and gas may cause the ions to fragment.

From collision cell 386, ions are released into region 398 where the precursor and fragment ions may be analyzed by a mass analyzer (not shown). The mass analyzer used to analyze the ions released from collision cell 386 may be any known prior art analyzer including a time-of-flight mass analyzer, an ion cyclotron resonance mass analyzer, an orbitrap, quadrupole trap, a quadrupole filter, or an abridged quadrupole according to the present invention. It should also be noted that abridged quadrupole 391 may be operated in any manner consistent with equations (8) through (14). Such operation may include, for example, transmission over a broad mass range by applying an RF-only potential, transmission over a narrow mass range by applying RF and DC potentials, or transmission of notched mass ranges by applying an RF-only potential to radially confine ions and an AC potential for resonant excitation of ions at specific frequencies to eliminate unwanted mass ranges.

In alternate embodiments, ion optic elements are positioned adjacent to each end of any the above described abridged multipoles. Such ion optic elements may be used to focus ions into or out of the abridged multipoles. Alternatively, the added elements may be used to produce an axial field (i.e. along the z-axis) to confine ions in the multipole. In such cases these alternate embodiments are, in effect, used as so-called linear ion traps. Ions are confined radially via an RF potential applied to the multipole elements as described above and axially via potentials applied between the multipole elements and the ion optic elements positioned adjacent to the ends of the multipole. Examples of such embodiments are depicted in FIGS. 12 and 13.

Turning first to FIGS. 12A, 12B and 12C, depicted is an alternate embodiment device including abridged quadrupole 174 and lens elements 441 and 442 positioned adjacent to either end 443 and 444 respectively of the quadrupole. Lens elements 441 and 442 are electrically conducting, apertured plates. FIG. 12A depicts an end view of the embodiment wherein only lens element 441 is visible. Aperture 445 in lens 441 is centered on central axis 446 (i.e. the z-axis) of abridged quadrupole 174. Similarly, the aperture in lens 442 (not shown) is also centered on central axis 446. The apertures in lenses 441 and 442 may be any desired dimension, however, as an example, the apertures are 1 mm in diameter.

FIG. 12B depicts a side view of the present embodiment wherein lenses 441 and 442 are shown adjacent to ends 443 and 444 respectively. Lenses 441 and 442 are spaced apart from ends 443 and 444 respectively by 1 mm. In alternate embodiments, the distance between the lenses and abridge quadrupole 174 may be any desired distance. FIG. 12C depicts a cross-sectional view of the present embodiment taken at line "A-A" in FIG. 12B. The construction and orientation of plates 165 and 166 are as described above with respect to FIG. 7B.

During operation, ions enter abridged quadrupole 174 from one of its ends. For example, ions enter quadrupole 174 along central axis 446 via aperture 445. When acting as a simple ion guide, RF potentials are applied to quadrupole 174 as described above with respect to FIG. 7. The RF potentials tend to confine the ions radially to central axis 446, however, the ions are free to move axially (i.e. along axis 446) through quadrupole 174. Ions are injected into quadrupole 174 with some velocity directed towards end 444. The momentum of the ions will thus tend to carry them towards end 444 where they may exit abridged quadrupole 174. When acting as an ion guide, lenses 441 and 442 and abridged quadrupole 174 have potentials applied between them which tend to encourage the progress of ions along central axis 446 from an entrance end—i.e. end 443—to an exit end—i.e. end 444. In general, such potentials will be more attractive towards exit end 444. As an example, when considering positive ions, a DC potential of 4 V may be applied to lens 441, a DC bias—i.e. as represented by "c" in equation (12)—of 2 V may be applied to abridged quadrupole 174, and a DC potential of 0 V may be applied to lens 442.

During operation, abridged quadrupole 174 and lens elements 441 and 442 reside in a vacuum chamber. When used as an ion guide, the pressure of the chamber in which abridged quadrupole 174 resides may vary widely. As an example, the pressure in abridged quadrupole 174 may be any pressure below 50 mbar. In alternate methods, abridged quadrupole 174 may be used to selectively transmit ions of a given mass or mass range. In such a case, a DC potential, U, is applied as given by equations (8)-(12). When operated as a mass filter, abridged quadrupole 174 is maintained at a pressure low enough to substantially avoid collisions between the ions being analyzed and gas molecules. For example, when operated as a mass filter, abridged quadrupole 174 is maintained at a pressure of less than $10^{-4}$ mbar.

In alternate methods, abridged quadrupole 174 together with lenses 441 and 442 are operated as a linear ion trap.

When operated as a linear ion trap, abridged quadrupole 174 is maintained at a gas pressure which is high enough that collisions between ions and gas molecules can "cool" the ions and thereby allow the ions to become trapped. However, the pressure is also low enough that the motion of the ions is not so rapidly damped as to make the resonant excitation of the ions impractical. As an example, when operated as a linear ion trap, the pressure in abridged quadrupole 174 is between $10^{-1}$ and $10^{-4}$ mbar.

When operated as a trap, both lens 441 and 442 are held at potentials more repulsive to the ions than the bias on abridged quadrupole 174. As an example, when considering positive ions, a DC potential of 2 V may be applied to lens 441, a DC bias—i.e. as represented by "c" in equation (12)—of 0 V may be applied to abridged quadrupole 174, and a DC potential of 2 V may be applied to lens 442. An RF potential (i.e. V in equation (11)) is applied to abridged quadrupole 174 in order to confine ions radially about axis 446. However, no DC potential (i.e. U in equation (11)) is applied. In alternate embodiments a non-zero DC potential may be applied.

Ions enter abridged quadrupole 174 via aperture 445 in lens 441. Initially, the ions have some significant kinetic energy directed along central axis 446. In the present example, the kinetic energy of the ions is near or greater than 2 eV—i.e. the potential drop between lens 441 and quadrupole 174—when the ions initially enter quadrupole 174. However, collisions between the ions and gas molecules cause the ions to lose kinetic energy. The gas pressure in quadrupole 174 is high enough that by the time the ions have reached lens 442 they have undergone sufficient collisions that they no longer have enough kinetic energy to overcome the DC potential barrier between end 444 and lens 442. The ions are reflected by the potential on lens 442 and are thereby trapped in quadrupole 174. In alternate embodiments, lens 442 is held at a much higher potential—for example 4V—than lens 441, such that ions having lost little or no kinetic energy upon reaching lens 442 are nonetheless reflected. In such a case, the ions need lose enough energy to be trapped only by the time they have returned to end 443.

The ions may, in principle, be held indefinitely in abridged quadrupole 174—being confined radially by the RF potential on quadrupole 174 and axially by the DC potential between abridged quadrupole 174 and lenses 441 and 442. Ions may later be released from abridged quadrupole 174 by lowering the potential on lens 442. For example, the potential on lens 442 may be lowered to −1 V. Ions near end 444 will be extracted from quadrupole 174 by the potential on lens 442. Ions further from lens 442 may diffuse, or be pushed by Coulomb repulsion towards and through the aperture in 442 and thereby exit abridged quadrupole 174 along central axis 446.

In addition to a DC offset, an RF auxiliary potential can be applied to lenses 441 and 442 so as to form an axial pseudo-potential barrier capable of trapping both positive and negative ions simultaneously in abridged quadrupole 174. Any desired auxiliary RF potential may be applied to lenses 441 and 442, however as an example, an auxiliary RF potential of about 150 $V_{zero\text{-}to\text{-}peak}$ at 500 kHz may be used to trap both positively and negatively charged ions. In alternate embodiments, any type of electrode or set of electrodes, including a rod set, might be used instead of, or in addition to, lenses 441 and 442. The application of appropriate DC and RF potentials between abridged quadrupole 174 and lenses 441 and 442 or alternate electrodes will tend to trap ions in quadrupole 174 whereas the absence of such RF and the use of a second appropriate set of DC potentials will allow for the transmission of ions in and out of abridged quadrupole 174.

Turning next to FIGS. 13A, 13B and 13C, depicted is alternate embodiment device 470 similar to that of FIG. 12 including prefilter 447, and postfilter 448, in addition to abridged quadrupole 174, and lens elements 441 and 442. Prefilter 447 is comprised of two elements 449 and 450 each of which is constructed in the same way as element 184 (FIGS. 5A and 5B) except that the length of elements 449 and 450 is 15 rather than 96.4 mm long (i.e. along the z-axis). Similarly, postfilter 448 is comprised of two elements 451 and 452 each of which is constructed in the same way as element 184 except that the length of elements 451 and 452 is 15 rather than 96.4 mm long (i.e. along the z-axis). In alternate embodiments prefilter 447 and postfilter 448 may be any desired length. As shown in FIGS. 13B and 13C, elements 449 and 450 of prefilter 447 are positioned parallel with one another about axis 446 and adjacent to entrance end 443 of abridged quadrupole 174. Similarly, elements 451 and 452 of postfilter 448 are positioned parallel with one another about axis 446 and adjacent to exit end 444 of abridged quadrupole 174.

FIG. 13A depicts an end view of the embodiment wherein only lens element 441 is visible. Aperture 445 in lens 441 is centered on central axis 446 (i.e. the z-axis) of abridged quadrupole 174. Similarly, the aperture 453 in lens 442 is also centered on central axis 446. The apertures in lenses 441 and 442 may be any desired dimension, however, as an example, the apertures are 1 mm in diameter. FIG. 13B depicts a side view of the present embodiment wherein lenses 441 and 442 are shown adjacent to prefilter 447 and postfilter 448 respectively which themselves are adjacent to ends 443 and 444 respectively. Lenses 441 and 442 are spaced apart from prefilter 447 and postfilter 448 respectively by 1 mm. Prefilter 447 and postfilter 448 are spaced apart from ends 443 and 444 respectively by 0.5 mm. In alternate embodiments, the distances between the lenses, prefilter, postfilter, and abridge quadrupole 174 may be any desired distance. FIG. 13C depicts a cross-sectional view of the present embodiment taken at line "A-A" in FIG. 13B. The construction and orientation of plates 165 and 166 are as described above with respect to FIG. 7B.

During operation, ions enter abridged quadrupole 174 from one of its ends. For example, ions enter quadrupole 174 along central axis 446 via aperture 445 and prefilter 447. When acting as a simple ion guide, RF potentials are applied to quadrupole 174, prefilter 447, and postfilter 448 as described above with respect to FIG. 7. According to the present embodiment, the same RF potential (amplitude and frequency) is applied to abridged quadrupole 174, prefilter 447, and postfilter. In alternate embodiments the RF potentials applied to abridged quadrupole 174, prefilter 447, and postfilter 448 may differ from one another. The RF potentials tend to confine the ions radially to central axis 446, however, the ions are free to move axially (i.e. along axis 446) through quadrupole 174. Ions are injected into quadrupole 174 with some velocity directed towards end 444. The momentum of the ions will thus tend to carry them towards end 444 where they may exit abridged quadrupole 174. When acting as an ion guide, lenses 441 and 442, prefilter 447, postfilter 448, and abridged quadrupole 174 have potentials applied between them which tend to encourage the progress of ions along central axis 446 from an entrance end—i.e. end 443—to an exit end—i.e. end 444. In general, such potentials will be more attractive towards exit end 444. As an example, when considering positive ions, a DC potential of 4 V may be applied to lens 441, a DC bias of 3 V may be applied to prefilter 447, a DC bias—i.e. as represented by "c" in equation (12)—of 2 V may be applied to abridged quadrupole 174, a DC bias of 1 V may be applied to postfilter 448, and a DC potential of 0 V may be applied to lens 442.

During operation, abridged quadrupole 174, prefilter 447, postfilter 448, and lens elements 441 and 442 reside in a vacuum chamber. When used as an ion guide, the pressure of the chamber in which abridged quadrupole 174 resides may vary widely. As an example, the pressure in abridged quadrupole 174 may be any pressure below 50 mbar. In alternate methods, abridged quadrupole 174 may be used to selectively transmit ions of a given mass or mass range. In such a case, a DC potential, U, is applied as given by equations (8)-(12). According to the present embodiment, the potential, U, is not applied to prefilter 447 or postfilter 448, but only to abridged quadrupole 174. When operated as a mass filter, abridged quadrupole 174 is maintained at a pressure low enough to substantially avoid collisions between the ions being analyzed and gas molecules. For example, when operated as a mass filter, abridged quadrupole 174 is maintained at a pressure lower than $10^{-4}$ mbar.

In alternate methods, abridged quadrupole 174 together with prefilter 447, postfilter 448, and lenses 441 and 442 are operated as a linear ion trap. When operated as a linear ion trap, abridged quadrupole 174 is maintained at a gas pressure which is high enough that collisions between ions and gas molecules can "cool" the ions and thereby allow the ions to become trapped. However, the pressure is also low enough that the motion of the ions is not so rapidly damped as to make the resonant excitation of the ions impractical. As an example, when operated as a linear ion trap, the pressure in abridged quadrupole 174 is between $10^{-1}$ and $10^{-4}$ mbar.

When operated as a trap, prefilter 447, postfilter 448, and lenses 441 and 442 are held at potentials more repulsive to the ions than the bias on abridged quadrupole 174. As an example, when considering positive ions, a DC potential of 2 V is applied to lenses 441 and 442, a DC potential of 1 V is applied to prefilter 447 and postfilter 448, and a DC bias—i.e. as represented by "c" in equation (12)—of 0 V is applied to abridged quadrupole 174. In alternate embodiments, lenses 441 and 442 are not held at repulsive potentials. In further alternate embodiment, lenses 441 and 442 are held at repulsive potentials, but the DC potentials applied to prefilter 447, and postfilter 448 are not. An RF potential—i.e. V in equation (11)—is applied to abridged quadrupole 174, prefilter 447, and postfilter 448, in order to confine ions radially about axis 446. However, no DC potential—i.e. U in equation (11)—is applied. According to the present embodiment, the same RF potential (i.e. amplitude and frequency) is applied to abridged quadrupole 174, prefilter 447, and postfilter 448. In alternate embodiments the RF potentials applied to prefilter 447, postfilter 448 and abridged quadrupole 174 are different from one another. In alternate embodiments a non-zero DC potential, U, may be applied.

Ions enter abridged quadrupole 174 via aperture 445 in lens 441 and prefilter 447. Initially, the ions have some significant kinetic energy directed along central axis 446. In the present example, the kinetic energy of the ions is near or greater than 2 eV—i.e. the potential drop between lens 441 and quadrupole 174—when the ions initially enter quadrupole 174. However, collisions between the ions and gas molecules cause the ions to lose kinetic energy. The gas pressure in quadrupole 174 is high enough that by the time the ions have reached lens 442 they have undergone sufficient collisions that they no longer have enough kinetic energy to overcome the DC potential barrier between end 444 and lens 442. The ions are reflected by the potential on lens 442 and are thereby trapped in quadrupole 174. In alternate embodiments, lens 442 is held at a much higher potential—for example 4V—than lens 441, such that ions having lost little or no kinetic energy upon reaching lens 442 are nonetheless reflected. In such a case, the ions need lose enough energy to be trapped only by the time they have returned to end 443. Through additional collisions, the ions continue to lose kinetic energy until they become thermalized—I.e. the temperature of the ions is near the temperature of the gas. When the ions are cooled to near room temperature, they become trapped within abridged quadrupole 174. That is, the ions are reflected at prefilter 447 and postfilter 448 by the 1 V DC potential on these elements. The ions may, in principle, may be held indefinitely in abridged quadrupole 174—being confined radially by the RF potential on quadrupole 174 and axially by the DC potential between abridged quadrupole 174 and prefilter 447 and postfilter 448. Ions may later be released from abridged quadrupole 174 by lowering the potentials on postfilter 448 and lens 442. For example, the DC potential on postfilter 448 may be lowered to −1V and that on lens 442 may be lowered to −2 V. Ions near end 444 will be extracted from quadrupole 174 by the potentials on postfilter 448 and lens 442. Ions further from lens 442 may diffuse, or be pushed by Coulomb repulsion towards and through the aperture in 442 and thereby exit abridged quadrupole 174 along central axis 446.

In addition to, or instead of, a DC offset, an RF auxiliary potential can be applied to prefilter 447 and postfilter 448 and/or lenses 441 and 442 so as to form an axial pseudopotential barrier capable of trapping both positive and negative ions simultaneously in abridged quadrupole 174. To form an axial pseudopotential barrier, the auxiliary RF potential is applied to all the junctions of prefilter 447 and postfilter 448 in addition to the radially trapping RF potential, V, applied to the junctions as defined in equations (8)-(12). Any desired auxiliary RF potential may be applied to prefilter 447 and postfilter 448, however, as an example, an auxiliary RF potential of about 150 $V_{zero\text{-}to\text{-}peak}$ at 500 kHz may be used to trap both positively and negatively charged ions in abridged quadrupole 174. In alternate embodiments, any type of electrode or set of electrodes, including a rod set, might be used instead of, or in addition to, lenses 441 and 442 or prefilter 447 and postfilter 448. The application of appropriate DC and auxiliary RF potentials between abridged quadrupole 174 and prefilter 447 and postfilter 448 or alternate electrodes will tend to confine ions to quadrupole 174 whereas the absence of such RF and the use of a second appropriate set of DC potentials will allow for the transmission of ions in and out of abridged quadrupole 174.

While trapped in abridged quadrupole 174 ions may be excited via AC dipole fields as described above with reference to equations (12) through (14). Specifically, a dipole field may be used, for example, to excite ions into motion about axis 446 of abridged quadrupole 174. Assuming, for example, a quadrupolar field according to equations (11) and (12), wherein, V is 200V, and f is 1 MHz, is produced in abridged quadrupole 174, then ions entering quadrupole 174 will tend to be focused toward axis 446. Collisions between the ions and gas in abridged quadrupole 174 will tend to cool the ions allowing the RF field (i.e. "V") to better focus the ions to axis 446. If U is 0V, then ions in abridged quadrupole 1 will oscillate about the axis at a resonant frequency (also known as the ions' secular frequency) related to the ions' mass. If a rotating dipole field as described above is applied to the abridged quadrupole, at a frequency, $f_x$, which is equal to the secular frequency of ions of a selected mass, then ions of that mass will be excited into a circular motion about the abridged quadrupole axis. If the amplitude, $A_x$, is high enough and the time that the ions are exposed to the dipole field is long enough, then the radius of the ions' circular motion will be large enough to collide with the electrodes comprising the abridged quadrupole and the ions will be destroyed. Alternatively, excited ions may collide with gas molecules and consequently dissociate into fragment ions.

In alternate embodiments, dipoles of the form given in equations (13) and (14) may be used to excite ions at their secular frequencies along the x or y-axis or in any direction perpendicular to axis 446. Excitation of the ion's motion along the y-axis may be particularly advantageous in conjunction with the embodiments of FIG. 12A, 12B, 12C or 13A, 13B, 13C in that the ions may be readily ejected (i.e. without colliding with an electrode) along the y-axis through the gap between plates 165 and 166. In alternate embodiments, an ion detector may be placed adjacent to abridged quadrupole 174 such that ions being ejected along the y-axis may be detected. In such an embodiment, the excitation frequency, $f_y$, and/or the RF amplitude, V, may be scanned so that ions are ejected according to their mass as a function of time during the scan. Recording the signal produced by the ion detector as a function of time would thus produce a mass spectrum.

In further alternate embodiments, the dipole frequency applied along the x-axis may differ from the dipole frequency applied along the y-axis, such that ions of a first secular frequency are excited along the x-axis whereas ions having a second secular frequency are excited along the y-axis. In alternate embodiments, $E_x(t)$ and $E_y(t)$ are complex waveforms that may be represented as being comprised of many sine waves of a multitude of frequencies. Such complex waveforms may therefore be used to simultaneously excite ions of a multitude of secular frequencies. As in the case of the prior art method known as SWIFT, complex waveforms may be built and applied so as to excite all ions except those in selected secular frequency ranges. Such SWIFT waveforms applied via the dipole electric field may be used to eliminate ions of all but selected ranges of masses from abridged quadrupole 174. In alternate methods, mass selective stability may be used to isolate ions of interest in abridged quadrupole 174.

The isolation of selected ions in abridged quadrupole 174 may be used as one step in a tandem mass spectrometry method. The steps in such a method would include, the production of analyte ions in an ion source, the introduction of analyte ions into the abridged quadrupole 174, the trapping of analyte ions in abridged quadrupole 174 by the application of appropriate DC and/or auxiliary RF potentials to prefilter 447 and postfilter 448 and/or lenses 141 and 142, the cooling of analyte ions via collisions with gas, focusing of the analyte ions toward axis 446 via an RF quadrupolar field according to equations (11) and (12), the elimination of ions of all but a selected mass, the fragmentation of the selected mass ions to produce fragment ions, the mass analysis of the fragment ions and remaining precursor ions by scanning the frequency of an excitation waveform, the detection of ions ejected from abridged quadrupole 174 due to the excitation waveform, and the production of a mass spectrum by recording the signal from the detector. In the above described method, the elimination of ions of all but a selected mass may be achieved via dipole excitation, SWIFT excitation, mass selective stability or any known prior art method. In the above described method, the fragmentation of the selected mass ions to produce fragment ions may be achieved by the dipole excitation of the selected ions followed by collisions between the excited ions and gas molecules. Alternatively, fragmentation may be induced by electron capture dissociation, electron transfer dissociation, photodissociation, metastable activated dissociation, or any other known prior art dissociation method. In the above described method, the mass analysis of the fragment ions and remaining precursor ions may be achieved by scanning the frequency, $f_y$, of an excitation waveform and/or the amplitude, V, of the confining RF waveform such that ions are ejected according to their mass as a function of time. In alternate methods, $MS^n$ experiments may be performed by repeatedly performing the steps of selecting ions of interest from a group of fragment ions and then producing a next generation of fragment ions. The ions produced from the final dissociation step are then mass analyzed to produce the $MS^n$ mass spectrum.

In alternate embodiments, any of the above described abridged quadrupoles might be used instead of abridged quadrupole 174. For example, abridged quadrupole 275 might be used instead of abridged quadrupole 174. In such a case, it would be advantageous, for example, to excite ions by a dipole excitation waveform along the x' and/or y' axes so the ions are ejected via gaps 285-288.

In further alternate embodiments, a higher order abridged multipole, for example an abridged hexapole or octapole, may be substituted for abridged quadrupole 174 in the embodiments of FIG. 12A, 12B, 12C or 13A, 13B, 13C. In embodiments employing higher order abridged multipoles, ion selection and tandem mass spectrometry experiments are not practical, however, higher order abridged multipoles may be used effectively as ion guides or ion traps.

Figure 14:
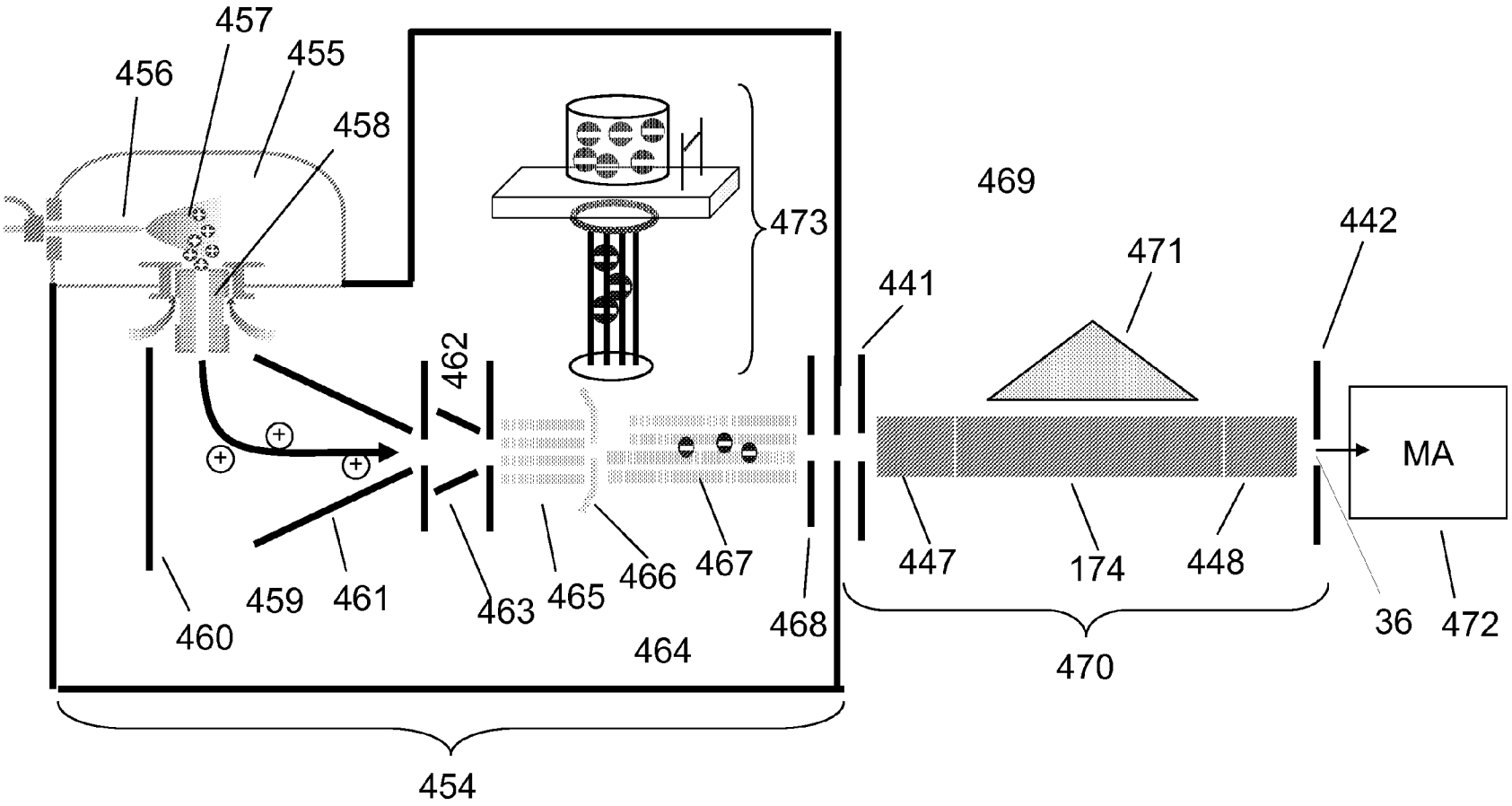
FIG. 14 depicts an example mass spectrometer incorporating device 470 of FIG. 13.

FIG. 14 depicts an example of how the embodiments of FIGS. 12A, 12B, 12C and 13A, 13B, 13C may be incorporated in a mass spectrometer. As shown, the embodiment includes ion source 454 including means of producing both analyte ions and ETD reagent ions. Analyte ions are produced by electrospray ionization at substantially atmospheric pressure in ionization chamber 455. To accomplish this, analyte is first dissolved in a liquid solvent and introduced into sprayer 456. The analyte solution is electrosprayed via sprayer 456 to produce a plume of gas phase ions 457. At least some of these analyte ions are entrained in a carrier gas and transported by the flow of carrier gas into and through capillary 458 into region 459 of the vacuum system of the mass spectrometer. In region 459, ions are deflected orthogonal to the flow of the carrier gas by a potential on deflector 460. Ions enter ion funnel 461 and are thereby focused and transmitted into second pumping region 462 of the vacuum system. In pumping region 462, analyte ions are further separated from the carrier gas. Ions are focused by ion funnel 463 and transmitted into pumping region 464 whereas gas is pumped away by a vacuum pump (not shown). In region 464, the ions pass through octapole ion guide 465, partition lens 466 and second octapole ion guide 467. The ions then pass through source exit lens 468 into abridged linear ion trap 470 in pumping region 469.

Ion source 454 also includes a negative chemical ionization (nCI) ion production means 473. During operation, negative ions are generated in nCI means 473 and transmitted into octapole 467. From octapole 467, the negative ions can be transmitted downstream to abridged linear ion trap 470 and mass analyzer 472. Negative ions produced in nCI means 473 may be used as reagent ions in ion-ion reactions. As discussed below, reagent ions from nCI means 473 are especially useful in electron transfer dissociation experiments.

Abridged linear ion trap 470 may be operated in any manner as described above with reference to FIGS. 13A, 13B, 13C. For example, analyte ions may be trapped in abridged quadrupole 174 by the application of appropriate DC and/or auxiliary RF potentials to prefilter 447 and postfilter 448 and/or lenses 141 and 142. Analyte ions may be cooled via collisions with gas and focused toward the ion trap axis via an RF quadrupolar field according to equations (11) and (12). Analyte ions may be excited toward fragmentation or ejection by a dipole or SWIFT excitation waveform. Alternatively, fragmentation may be induced by electron capture dissociation, electron transfer dissociation, photodissociation, metastable activated dissociation, or any other known prior art dissociation method. Ions may be selected via mass selective stability or any known prior art method of quadrupole ion selection. The ions may be mass analyzed by scanning the frequency of an excitation waveform. Ions ejected in this manner may be detected via ion detector 471. A mass spectrum may be generated by recording the signal from detector 471 as a function of time during a scan. Alternatively, analyte ions may be ejected through aperture 36 into downstream mass analyzer 472.

An abridged quadrupole in an instrument as described with reference to FIG. 14 may be used to perform tandem MS experiments wherein ions are selected and reacted or dissociated in the abridged quadrupole—i.e. abridged quadrupole 174. The products of the reaction or dissociation could then be analyzed by either a mass scan via abridged quadrupole 174 or by a down stream mass analyzer—i.e. mass analyzer 472. Ions may be fragmented by ETD via methods similar to those described in the prior art. For example, in U.S. Pat. No. 7,534,622, incorporated herein by reference, Hunt et al. describe various methods of performing ETD experiments. In the performance of such methods with the present invention, the "front and back lens" of Hunt may be taken to be lenses 441 and 442 respectively of the present invention, the "Front, Back, and Center Sections" of Hunt may be taken to be prefilter 447, postfilter 448, and abridged quadrupole 174 respectively of the present invention. As an example, an ETD experiment in an instrument according to the present embodiment may include the steps of producing multiply charged analyte ions, trapping the analyte ions in abridged quadrupole 174, isolating the analyte ions of interest, confining the analyte ions of interest to post filter 448, generating ETD reagent ions in nCI source 473, trapping the reagent ions in prefilter 447, allowing the analyte and reagent ions to mix and react, and mass analyzing the products of the reaction.

Prior art three dimensional quadrupole ion traps (a.k.a. Paul traps) are typically comprised of three electrically conducting, cylindrically symmetric electrodes placed symmetrically about a central axis. These are a central "ring electrode" set between two "end cap" electrodes. During operation, an RF potential applied between the electrodes generates a pseudopotential which confines ions in all dimensions around a point at the center of the trap. It is well known that the equation for an ideal 3D quadrupolar trapping field formed in such a device can be expressed as:

$$\Phi(t) = \frac{\Phi_o(t)(r^2 - 2z^2)}{2r_o^2} \tag{19}$$

where $\Phi(t)$ is the potential at point (r, z), $\Phi_o(t)$ is the potential between the electrodes defining the field, and $2r_o$ is the inner diameter of the ring electrode. In an ideal construction, the surfaces of the electrodes fall on equipotential lines of the quadrupole field. That is, the surfaces of the electrodes fall on hyperbolic curves defined by:

$$r^2 = r_o^2 + 2z^2 \tag{20}$$

In this construction, the electrodes are cylindrically symmetric about the z-axis and r is a radial distance from the z-axis and the potential applied between the electrodes, $\Phi_o(t)$, is a function of time. It is also well known that the so-called "pseudopotential" well produced via such a quadrupolar field is cylindrically symmetric. Surprisingly, the present inventor has discovered that specific lines can be chosen within a quadrupolar field such that, along these lines, the change of the potential, $\Phi(t)$, is a linear function of position.

To demonstrate this, assume that r is a linear function of z. That is:

$$r = mz + b, \tag{21}$$

where m is the slope of the selected line and b is the r-intercept. From equation (21), it's easy to see that $b = r_o$, where $r_o$ is the inner radius of the ring electrode. If m is selected to be $-\sqrt{2}$ for positive z and $+\sqrt{2}$ for negative values of z then equation (19) becomes:

$$\Phi(t) = \Phi_o(t)\frac{r_o^2 - |2\sqrt{2}\, r_o z|}{2r_o^2} \tag{22}$$

which clearly is a linear function of z. The implication is that one may produce a 3D quadrupolar field using an array of ring shaped electrodes spaced at regular intervals along the z-axis, each electrode having an inner radius selected in accordance with equation (21) and each having an applied potential according to equation (22) which is a linear function of the electrode's position along the z-axis.

Figure 15B:
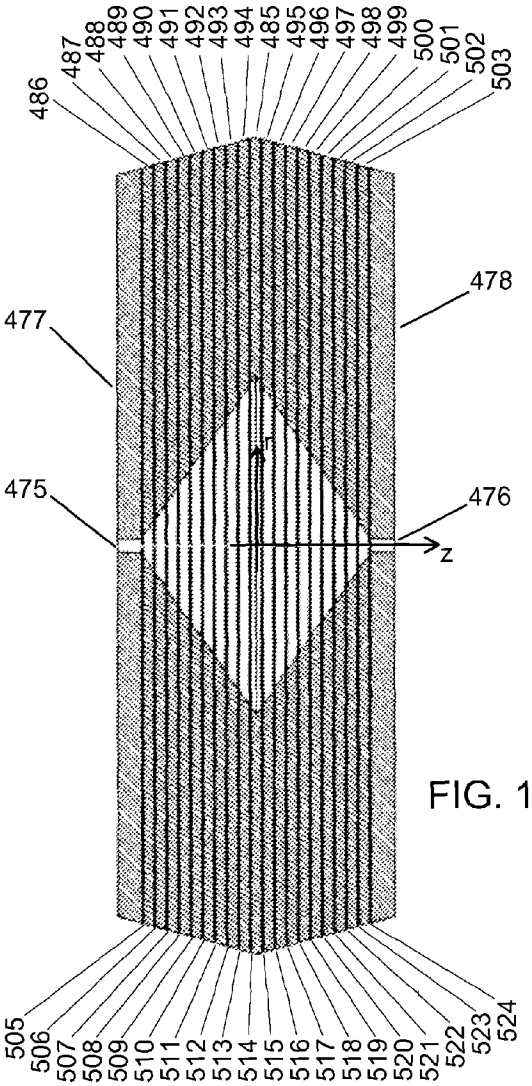
FIG. 15B shows a cross-sectional view of abridged trap 474 taken at line A-A in FIG. 15A.
Figure 15A:
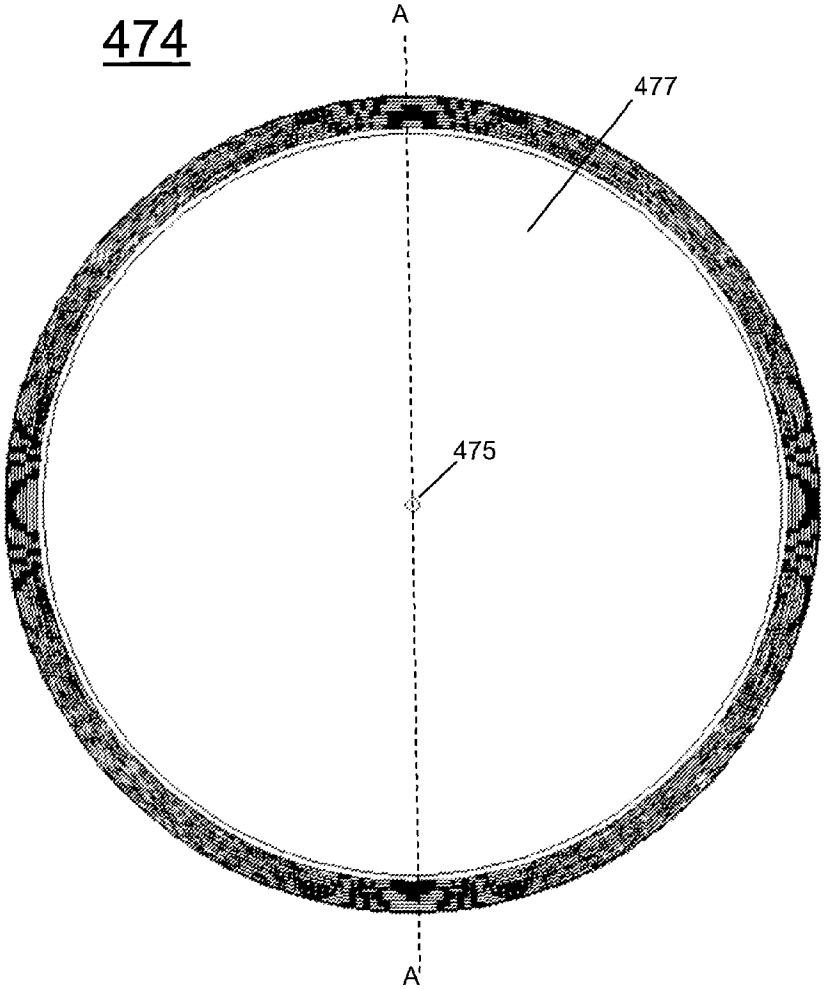
FIG. 15A depicts an end view of abridged Paul trap 474.

FIGS. 15A and 15B depict an embodiment of an abridged Paul ion trap formed from metal plates and insulators. FIG. 15A depicts an end view of the complete abridged Paul trap 474. FIG. 15B shows a cross sectional view of abridged trap 474 taken at line A-A in FIG. 15A. As shown, abridged trap 474 consists of a set of metal rings 485-503 having varying inner diameters, bound by baseplates 477, and 478 having apertures 475 and 476 respectively. Insulating spacers 505-524 electrically isolate adjacent metal rings 485-503 from one another. In alternate embodiments, rings 485-503 may be comprised of any electrically conducting material. In further alternate embodiments rings 485-503 may be comprised of insulating material coated with electrical conductor.

The radius, $r_o$, of abridged Paul trap 474, and the dimensions of metal rings 485-503 and insulators 505-524 may vary widely. However, as an example, metal rings 485-503 are 0.4 mm thick, insulating plates 505-524 are 0.1 mm thick, and $r_o$ is 7.07 mm. The inner diameters of metal rings 485-503 are defined in accordance with equation (21). Further, the inner surfaces of metal rings 485-503 are angled so as to conform to equation (21). Insulating plates 505-524 are recessed to prevent them from distorting the field formed on the interior of abridged trap 474. In alternate embodiments, insulating spacers may be recessed by any of a wide range of values, however, as an example, insulating plates 505-524 are recessed by 0.2 mm from the nearest inner edge of metal rings 485-503. Apertures 475 and 476 are selected to have an inner diameters of 0.57 mm and baseplates 477 and 478 are selected to be 1 mm thick. In alternate embodiments, apertures 475 and 476 and baseplates 477 and 478 may have a wide range of dimensions.

Potentials may be applied to metal rings 485-503 via any known prior art method. As an example, potentials from a driver may be applied directly to metal rings 485-503. Alternatively, the potential $\Phi_o(t)/2$ may be applied to metal ring 485 and the potential $-\Phi_o(t)/2$ may be applied at baseplates 477 and 478. From these electrodes—i.e. ring 485 and base plates 477 and 478—the potentials are divided by known prior art methods and applied to remaining metal rings, 486-503. The voltage divider may be comprised of a resistor divider and/or a capacitor divider and/or an inductive divider. As an example, if a capacitor divider is used, a series of capacitors—one between each of metal rings 485-503, one between baseplate 477 and ring 486, and one between baseplate 478 and ring 503—would divide the potentials $\Phi_o(t)/2$ and $-\Phi_o(t)/2$ among the electrodes. Each capacitor used in the divider would have the same capacitive value. The capacitance of the individual capacitors must be chosen to be much higher than the capacitance between electrodes of opposite polarity and must be substantially higher than the capacitance between an individual electrode and nearby conductors—e.g. conductive supports or housing. However, the capacitance of the individual component should be chosen to be low enough so as not to overload the driver.

It is preferable to use a resistor divider in combination with the above described capacitor divider. Some of the ions being analyzed with abridged Paul trap 474 will strike metal rings 485-503 or baseplates 477 and 478. When this occurs, the charge deposited on the electrode by the ion must be conducted away. One way this may be readily accomplished is via a resistor divider. Like the above described capacitor divider, the resistor divider consists of a series of resistors—one between each of metal rings 485-503, one between baseplate 477 and ring 486, and one between baseplate 478 and ring 503—which, together with the capacitor divider, divides the potentials $\Phi_o(t)/2$ and $-\Phi_o(t)/2$ among the electrodes. Each resistor used in the divider has the same resistance value so that the potentials are divided linearly amongst the electrodes in accordance with equation (22). The resistance of the individual resistors must be chosen to be low enough that charge can be conducted away at a much higher rate than it is deposited on the electrodes by the ions. However, the resistance of the individual component must be chosen to be high enough so as not to overload the driver. In principle, a resistor divider may be used alone—without a capacitor divider—if the values of the resistors are sufficiently low that the current through the resistors can charge the electrodes at the desired RF frequency and if such low resistance values do not overload the driver.

Any appropriate prior art electronics may be used to drive the abridged Paul trap according to the present invention. However, as an example, a resonantly tuned LC circuit might be used to provide potentials to abridged Paul trap 474. In one embodiment, a waveform generator drives a current through the primary coil of a step-up transformer. The secondary coil is connected on one end to metal ring 485 and on the other to baseplates 477 and 478. The potential, $\Phi_o(t)$, produced across the secondary coil is divided among metal rings 485-503 by, for example, a capacitor divider as described above. In such a resonant LC circuit the waveform will be sinusoidal. The inductance of the secondary coil and the total capacitance of the divider and electrodes will determine the resonant frequency of the circuit. The capacitance and inductance of the system is therefore adjusted to achieve the desired frequency waveform as is well known in the prior art.

The potential, $\Phi_o(t)$, applied to abridged Paul trap 474 may be any of a wide variety of functions of time, however, as an example, it may be given by equation (11) where V is taken to be the zero-to-peak RF voltage applied between metal ring 485 and baseplates 477 and 478, f is the frequency of the waveform in Hertz, and U is a DC voltage applied between metal ring 485 and baseplates 477 and 478. In alternate embodiments, $\Phi_o(t)$ may be a triangle wave, square wave, or any other function of time.

In the present embodiment, adjacent electrodes are capacitively coupled via insulating plates 505-524. Insulating plates 505-524 are comprised of polyimide. In alternate embodiments insulating plates 505-524 may be comprised of any desired electrically insulating material. The capacitance between adjacent plates may be calculated as $C=\epsilon\epsilon_r A/d=8.85*10^{-12}\times3.5\times(7.8*10^{-4})/10^{-4}\sim241$ pF. In the present embodiment, the surface area between metal rings 485-503, the thickness of insulating plates 505-524, and the material composition of insulating plates 505-524 is the same from one plate to the next. Therefore, the capacitance between any one of metal rings 485-503 and adjacent rings is the same as that between any other. This results in the formation of a capacitive divider which divides the potential between ring 485 and baseplates 477 and 478 linearly as a function of position of metal rings 485-503 in accordance with equation (22). Notice in FIGS. 15A, 15B that in order to keep the area of metal rings 485-503 the same, the outer diameter of the rings is larger for rings having larger inner diameters (i.e. area=constant=$\pi(r^2_{outer}-r^2_{inner})$).

As discussed above it is preferred to use a resistor divider in conjunction with the capacitor divider. In the present embodiment, resistors are connected, one each between adjacent metal rings 485-503, one between metal ring 486 and baseplate 477, and one between metal ring 503 and baseplate 478. In alternate embodiments, plates 505-524 may be comprised of resistive material such as graphite doped polypropylene. In such alternate embodiments, plates 505-524 all have the same area and resistance. Adjacent metal rings 485-503 are thus both capacitively and resistively coupled via plates 505-524 and the potential applied between ring 485 and baseplates 477 and 478 is linearly divided in accordance with equation (22).

Given an RC divider that linearly divides the potentials amongst rings 485-503, one can produce a homogeneous dipole field by applying a potential between baseplate 477 and baseplate 478. Of course, in such a situation, ring 485 must be allowed to float or it must be held at a potential which is the midpoint between the potentials applied to baseplates 477 and 478. Mathematically, the dipole field can be represented as a potential that varies linearly along the z axis. Adding a dipole field component to the quadrupolar field of equation (22) results in:

$$\Phi(t) = \Phi_o(t)\frac{r_o^2 - |2\sqrt{2}\, r_o z|}{2r_o^2} + E_z(t)\cdot z + c \tag{23}$$

where $E_z(t)$ is the dipole electric field strength along the z-axis, and c, the reference potential by which abridged Paul trap 474 is offset from ground, is added simply for completeness.

The voltage dividers used to produce the homogeneous dipole field may be identical to those described above with reference to FIGS. 15A and 15B used to produce an abridged 3D quadrupolar field. That is, in both the case of the quadrupole field generation and the dipole field generation, potentials are linearly divided amongst the rings 485-503. This feature is represented in equations (22) and (23) wherein the quadrupole potential, $$\Phi(t) = \Phi_o(t)\frac{r_o^2 - |2\sqrt{2}\, r_o z|}{2r_o^2},$$

is a linear function of r and z and the dipole potential, $E_z(t)z$, is also a linear function of z. Thus, using a single divider network, a field having both a quadrupolar component and a homogeneous dipolar component can be generated.

It should be noted that $E_z(t)$ may be any function of time from DC to complex waveforms, however, as an example, $E_z(t)$ may be given by:

$$E_z(t)=A_z\cos(2\pi f_2 t), \tag{24}$$

where $A_z$ and $f_z$ are the amplitude and frequency of the electric dipole waveform along the z-axis. The amplitude and frequency of this waveform may be any desired amplitude and frequency.

Such a dipole field may be used, for example, to excite ions into motion along the z-axis of abridged Paul trap 474. Assuming, for example, a quadrupolar potential according to equations (11) and (23), wherein, V is 400V, and f is 1 MHz, is produced in abridged trap 474, then ions entering the trap will tend to be focused to its geometric center. If U is 0V, then ions in abridged trap 474 will oscillate about its center at a resonant frequency (also known as the ions' secular frequency) related to the ions' mass. If a dipole field as described above is applied to the trap, at a frequency, $f_z$, which is equal to the secular frequency of ions of a selected mass, then ions of that mass will be excited into linear motion along the traps' z-axis. If the amplitude, $A_x$, is high enough and the time that the ions are exposed to the dipole field is long enough, then the extent of the ions' motion will be large enough to eject the ions from abridged trap 474 via apertures 475 and 476. Alternatively, ions excited into motion along the z-axis may have energetic collisions with gas molecules and consequently dissociate to form fragment ion.

In alternate embodiments, $E_z(t)$ is a complex waveform that may be represented as being comprised of many sine waves of a multitude of frequencies. Such a complex waveform may therefore be used to simultaneously excite ions of a multitude of secular frequencies. As in the case of the prior art method known as SWIFT, complex waveforms may be built and applied so as to excite all ions except those in selected secular frequency ranges. Such SWIFT waveforms applied via the dipole electric field may be used to eliminate ions of all but selected ranges of masses from abridged Paul trap 474. In alternate embodiments, V and $A_z$ may be scanned to excite and eject ions as a function of time according to ion mass. In further alternate embodiments, any prior art method of injecting, exciting, fragmenting, reacting, analyzing, or ejecting ions from a Paul trap may be used in conjunction with the abridged Paul trap according to the present invention.

In alternate embodiments a multiple frequency multipole field may be formed in abridged Paul trap 474. In such an embodiment, the potentials applied to metal rings 485-503 take the form:

$$\Phi(z,t)=\sum_{i=1}^{j} g_i(z)h_i(t); \tag{25}$$

where the functions $g_i(z)$ may be any function of position along the z-axis and the function $h_i(t)$ may be any function of time. As an example, equation (25) may take the form:

$$\Phi(z,t)= \tag{26}$$
$$\Phi_o(t)\frac{r_o^2-\left|2\sqrt{2}\,r_o z\right|}{2r_o^2}+A_z\sin(2\pi f_z t)z+c+B_z\sin(2\pi f_2 t)\cos(2\pi z/a_z),$$

where $f_1$ and $f_2$ are the oscillation frequencies of quadrupolar and heterogeneous dipolar fields respectively. $B_z$ and $a_z$ are constants relating to the amplitude and spatial repetition of the heterogeneous dipolar field. In a manner similar to the embodiment of FIGS. 4A and 4B, the constant $a_z$ is selected to be small so that the heterogeneous dipole field is kept spatially near the inner surface of rings 485-503, whereas the quadrupolar field component extends throughout abridged trap 474. Further, frequency $f_2$ is selected to be significantly lower than frequency $f_1$—for example, $f_1$=1 MHz and $f_2$=0.5 MHz—so that low mass ions, responsive to the high frequency quadrupolar field component, are trapped near the center of abridged trap 474 and do not experience the low frequency heterogeneous dipole field component. High mass ions, being unresponsive to the quadrupole field component, approach the inner surface of rings 485-503, experience and respond to the low frequency heterogeneous dipole field, and are thereby reflected back toward the center of the trap.

Figure 16B:
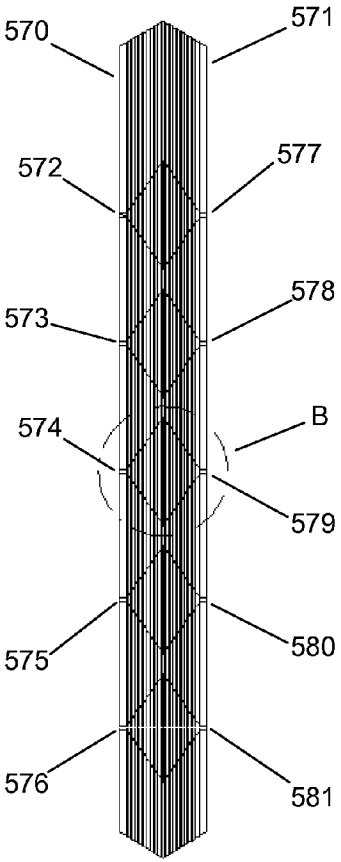
FIG. 16B shows a cross-sectional view of abridged trap 549 taken at line A-A in FIG. 16A.
Figure 16A:
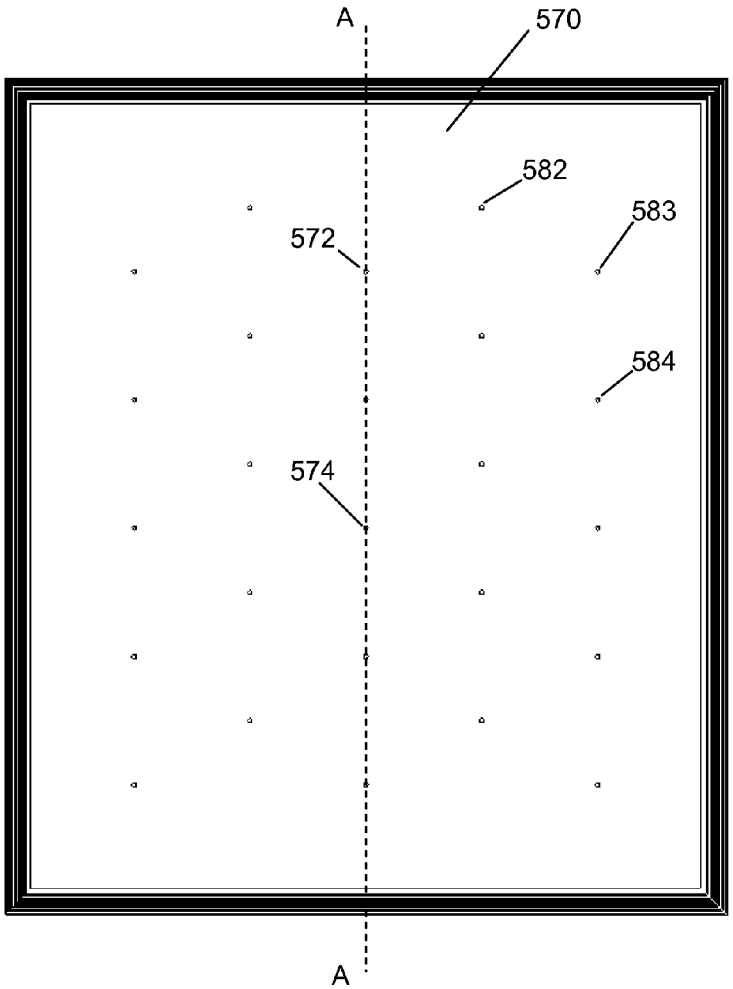
FIG. 16A depicts an end view of the complete abridged Paul trap array 549.
Figure 16C:
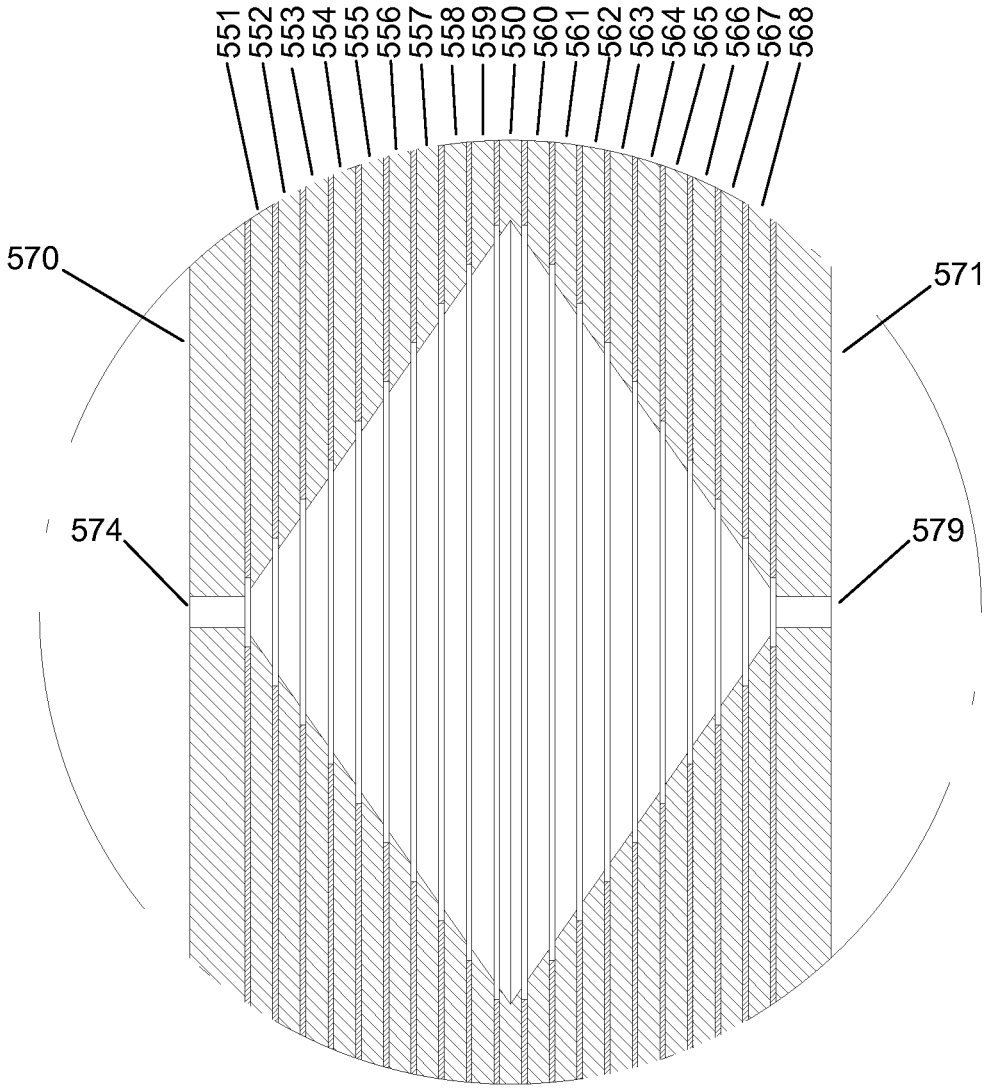
FIG. 16C is an expanded view of detail B in FIG. 16B.

Turning next to FIGS. 16A, 16B and 16C, shown is an abridged Paul trap array. Abridged Paul trap array 549 is constructed in precisely the same manner as abridged Paul trap 474 depicted in FIGS. 15A and 15B except that abridged trap array 549 of FIGS. 16A, 16B and 16C is comprised of metal plates 550-568 instead of the metal rings 485-503 in trap 474. Each of plates 550-568 have a multitude of holes in them—one for each abridged trap in the array. Similarly, insulating plates between metal plates 550-568 have a multitude of holes in them.

FIG. 16A depicts an end view of the complete abridged Paul trap array 549. FIG. 16B shows a cross sectional view of abridged trap 549 taken at line A-A in FIG. 16A. FIG. 16C is an expanded view of detail B in FIG. 16B. As shown in FIGS. 16B and 16C the holes in adjacent plates 550-568 are aligned in abridged trap array 549 so as to form a multitude of abridged Paul traps in one contiguous structure. In the end view of trap array 549 depicted in FIG. 16A, only baseplate 570 is visible. Each of the apertures, for example 572-584, in baseplates 570 and 571 are entrance and exit orifices into the abridged traps with which they are aligned. Each of the apertures on baseplate 570 in FIG. 16A is adjacent to an abridged Paul trap in trap array 549. In alternate embodiments, any number of abridged traps may be included in a trap array, however, as an example, trap array 549 includes 25 abridged Paul traps. Only five of these traps are visible in FIG. 16B. As discussed above with reference to abridged trap 474 and FIGS. 15A and 15B, the capacitance between adjacent metal plates 550-568 is the same for every pair of adjacent plates. This results in a linear capacitor divider that divides the potentials applied to baseplates 570 and 571 and plate 550 linearly among metal plates 550-568, consistent with equation (23). To keep the capacitance constant while varying the diameter of the holes in metal plates 550-568, the area between adjacent plates is held constant by varying the outer dimension of the plates as shown in FIG. 16B.

Metal plates 550-568 are electrically connected in precisely the same manner as metal rings 485-503 in abridged trap 474. Under a given set of applied potentials, the same electric fields are formed in each of the abridged Paul traps in array 549 as is formed in abridged Paul trap 474 under the same conditions. Also, the same methods of operation may be used with abridged trap array 549 as with abridged trap 474.

In the embodiment of FIGS. 16A, 16B and 16C all the traps comprising abridged trap array 549 have the same $r_o$. In alternate embodiments, the radius, $r_o$, may vary from one trap to the next within an array. As a result, given a uniform applied potential, the field strength in such alternate embodiments vary with $r_o$ from one abridged trap to the next within the array. The response of ions—i.e. the ions' resonant frequency and stability—to the field will therefore also vary from one abridged trap to the next within the array. Thus, under a given set of conditions, ions of differing mass ranges would be trapped, excited, or ejected from one abridged trap to the next within the array.

Any of the above described methods may be used in conjunction with any of the above described abridged Paul traps or trap arrays. Furthermore, any prior art method of injecting, exciting, fragmenting, reacting, analyzing, or ejecting ions from a Paul trap may be used in conjunction with the abridged Paul traps or trap arrays according to the present invention.

In accordance with a further embodiment of the invention, an apparatus and method are provided for an abridged linear ion trap time of flight (LIT TOF) mass spectrometer comprised of at least an abridged linear ion trap, a drift region, and an ion detector. According to one method of operation, ions are injected into the abridged trap along a central axis. An RF potential applied to the abridged trap produces an RF multipole field therein which radially confines the ions while DC potentials applied to elements at either end of the trap prevent the ions from escaping along the central axis. A time-of-flight mass analysis is initiated by discontinuing the RF and applying a pulsed DC potential to the abridged trap so as to produce a homogeneous dipolar accelerating field which ejects the ions in a direction orthogonal to the central axis. The ions move through the drift region with kinetic energies as imparted on the ions by the dipolar accelerating field. At the end of the drift region the ions strike the detector inducing a signal. Using a digitizer or other similar recording device, the signals can be recorded as a function of time so as to produce a TOF mass spectrum.

Figure 17:
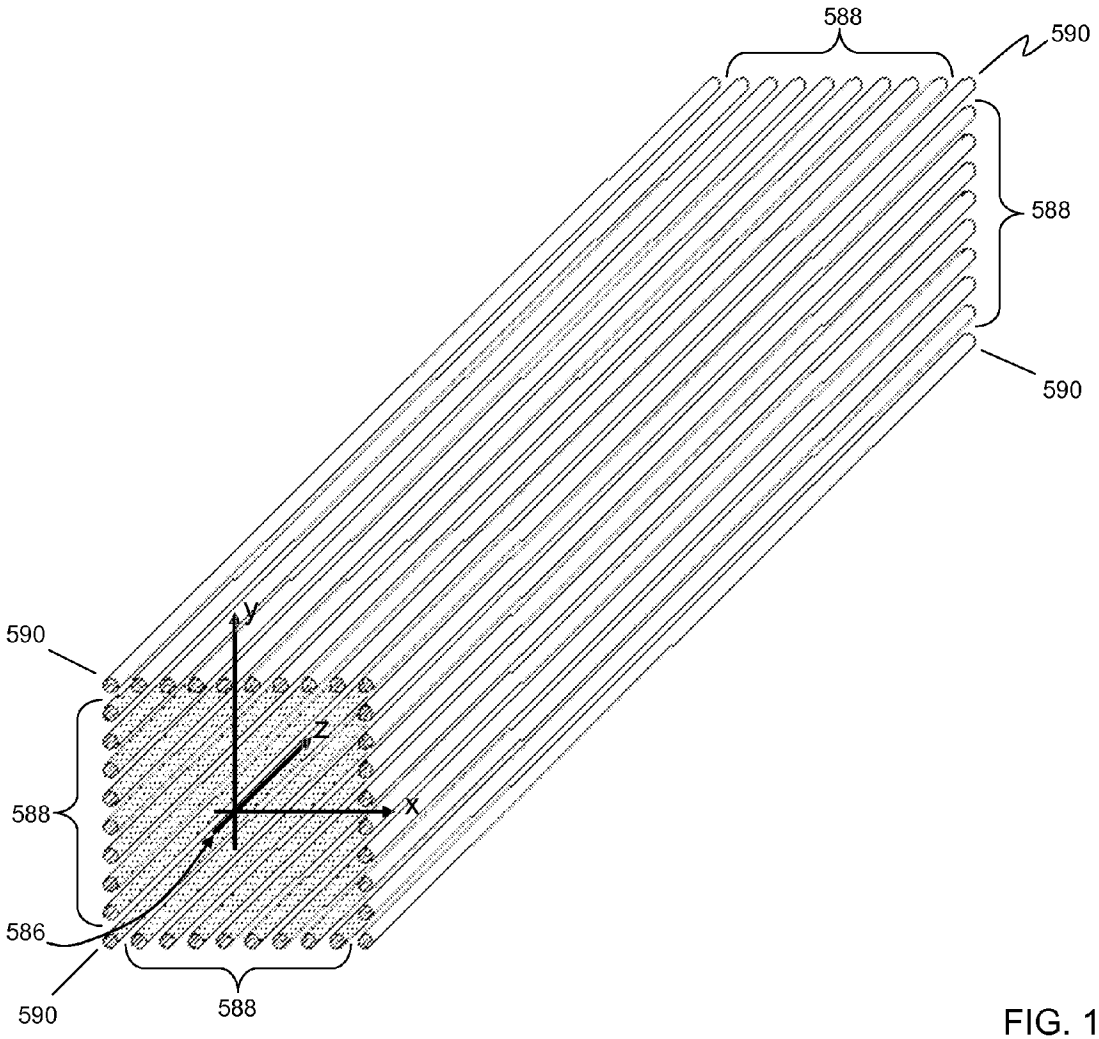
FIG. 17 depicts an abridged quadrupole linear ion trap comprised of a set of rods arranged in a square pattern about a central axis.

FIG. 17 depicts abridged linear ion trap 585 which consists of four sets of closely spaced, electrically conducting rods positioned symmetrically about central axis 586—i.e. the z-axis. Abridged trap 585 may be any desired length, however, as an example, it is 29 mm long—i.e. along the z-axis. Trap 585 is 9 by 9 mm in the x-y plane. Ions are received on a central axis 586 and may be ejected in any direction which is orthogonal to the axis. The design of abridged trap 585 is similar to abridged multipole 1 depicted in FIG. 1, however, importantly, rods 588 and 590 of abridged linear ion trap 585 are spaced apart such that ions may readily pass between them. In alternate embodiments, the gap between rods may be any desired gap, however, in the present embodiment, the gap between adjacent rods in abridged LIT 585 is 0.5 mm. The rods themselves are 0.5 mm in diameter, thus the full assembly of rods 588 and 590 comprising abridged trap 585 has an optical transmission efficiency of 50%.

Resistors and/or capacitors (not shown) electrically connect all of rods 588 and 590 together in a manner as described with respect to FIG. 1. Thus, potentials applied at rods 590 positioned in the corners of assembly 585 are divided amongst remaining rods 588. Applying potentials to rods 590 will produce a field consistent with equation (12). Thus, a quadrupolar RF field of amplitude, V, and frequency, f,—with U set to zero—may be produced so as to radially confine ions along axis 586. Subsequently, the RF field is turned off—i.e. V=0—and a homogeneous dipole field of strength $E_x$ and $E_y$ along the x and y-axes respectively is produced to accelerate ions out of abridged trap 585 in a direction orthogonal to axis 586. Assuming $E_y$ is zero, the ions will be accelerated along the x-axis. By placing a detector on the x-axis, one can measure the flight time of ions from axis 586 to the detector. Signals from the detector (not shown) may be used to produce time of flight mass spectra and to determine the mass of ions trapped and then accelerated by abridged LIT 585.

Figure 18C:
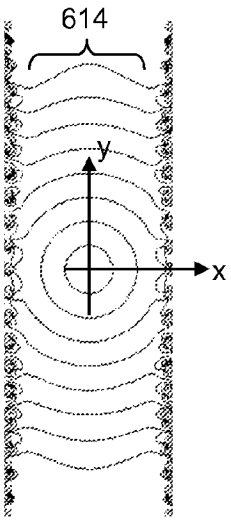
FIG. 18C depicts the abridged linear ion trap of FIG. 18A including equigradient lines representative of the electric field during injection and trapping of ions.
Figure 18B:
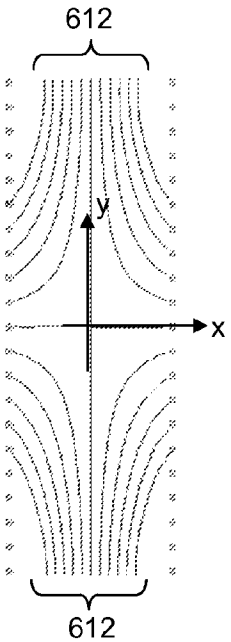
FIG. 18B depicts the abridged linear ion trap of FIG. 18A including equipotential lines representative of the electric field during injection and trapping of ions.
Figure 18A:
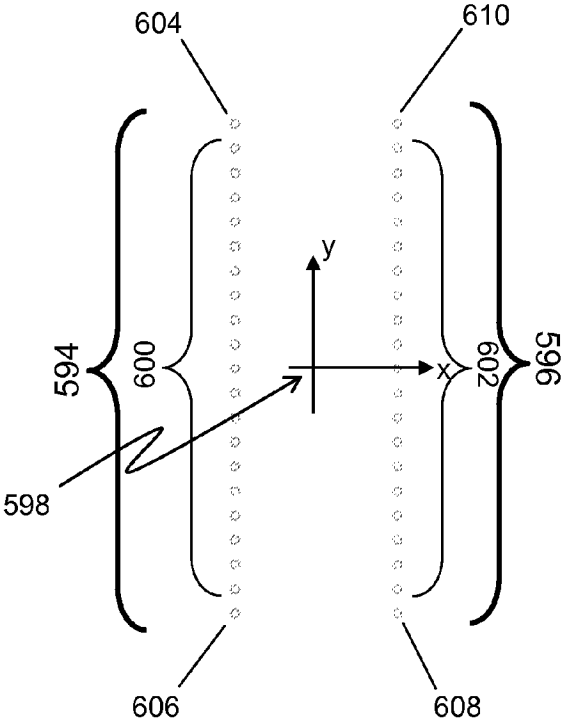
FIG. 18A is a cross-sectional view of an abridged quadrupole linear ion trap comprised of two sets of rods arranged in lines on opposite sides of a central axis.

Turning next to FIG. 18A, shown is a cross-sectional view of alternate embodiment abridged quadrupole linear ion trap 592 comprised of two sets of electrically conducting rods 594 and 596 arranged in lines on opposite sides of central axis 598—i.e. the z-axis. The rods comprising sets 594 and 596 may be composed of any electrically conducting material, however, as an example, they are comprised of steel. Conceptually, abridged quadrupole trap 592 is similar to abridged LIT 470 depicted in FIG. 13, however, importantly, the rods of sets 594 and 596 of abridged linear ion trap 592 are spaced apart such that ions may readily pass between them. In alternate embodiments, the gap between adjacent rods in sets 594 and 596 may be any desired gap, however, in the present embodiment, the gap between adjacent rods in abridged LIT 592 is 300 μm. The rods themselves are 100 μm in diameter, thus rod sets 594 and 596 have an optical transmission efficiency of 67%. Abridged LIT 592 and therefore the rods of sets 594 and 596 may be any length, however, as an example, it is 29 mm long along the z-axis—i.e. into the page. The width and height of LIT 592 may be any desired dimension, however, as an example, sets 594 and 596 are separated by 2 mm—i.e. along the x-axis—and are 6 mm "high"—i.e. along the y-axis.

Rods 600 and 602 internal to sets 594 and 596 respectively as well as rods 604-610 bounding the rod sets may be electrically connected to each other, for example, as described above with respect to FIG. 1—i.e. via linear resistor and/or capacitor divider chains. Whether via such an RC network or otherwise, potentials are applied to rods 600-610 as a function of rod position in accordance with equation (12). Thus, a quadrupolar RF field of amplitude, V, and frequency, f,—with U set to zero—may be produced so as to radially confine ions along axis 598.

FIG. 18B depicts the abridged linear ion trap 592 including equipotential lines 612 representative of the electric field during injection and trapping of ions. In calculating equipotential lines 612, it was assumed that $r_o$=1 mm, and V=67 volts. Potentials are applied to rods 600-610 accordingly. Equipotential lines 612 appear at 10 V intervals. As expected, equipotential lines 612 have a form indicative of a quadrupolar field. Similarly, FIG. 18C depicts abridged linear ion trap 592 including equigradient lines 614 representative of the electric field during injection and trapping of ions. Equigradient lines 614 were calculated under the same conditions as equipotential lines 612. The cylindrically symmetric nature of equigradient lines 614 is again consistent with a quadrupolar field. Distortions in equigradient lines 614 are seen only near rods 600-610 or at large distances from axis 598.

Abridged LIT 592 receives ions on central axis 598. These ions are focused about axis 598 by the abridged quadrupolar RF field as described with reference to FIGS. 18B and 18C. Ions are retained axially via DC trapping electrodes (not shown) in a manner similar to that described with respect to FIGS. 12 and 13. Alternatively, RF and/or DC potentials may be applied to the axial trapping electrodes. Ions injected into abridged trap 592 are "cooled" via collisions with gas molecules, become trapped, and form a line of charge on axis 598.

Figure 19B:
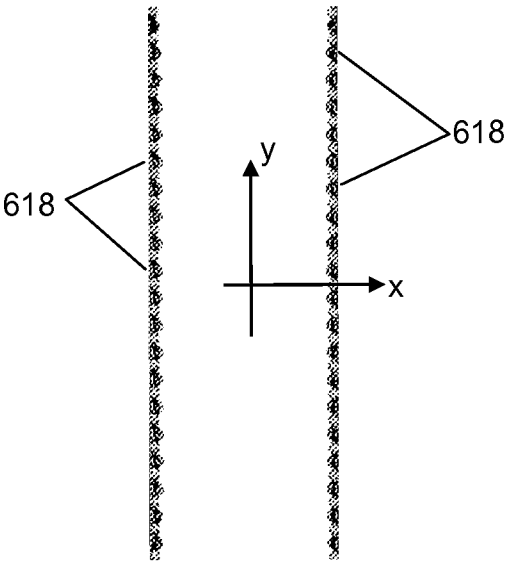
FIG. 19B depicts the abridged linear ion trap of FIG. 18A including equigradient lines representative of the electric field during the acceleration of ions out of the trap into the TOF analyzer.
Figure 19A:
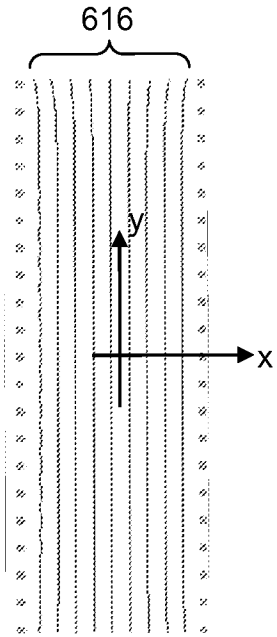
FIG. 19A depicts the abridged linear ion trap of FIG. 18A including equipotential lines representative of the electric field during the acceleration of ions out of the trap into the TOF analyzer.

Subsequently, the RF field is turned off—i.e. V=0—and a homogeneous dipole field of strength $E_x$ and $E_y$ along the x and y-axes respectively is produced to accelerate ions out of abridged trap 592 in a direction orthogonal to axis 598. Assuming $E_y$ is zero, the ions will be accelerated along the x-axis. FIG. 19A depicts the abridged linear ion trap of FIG. 18A including equipotential lines 616 representative of the electric field during the acceleration of ions out of abridged trap 592 into the drift region of the TOF analyzer. The geometry of abridged trap 592 is advantageous because a relatively small dimension on the x-axis results in a lower RF potential in accordance with equation (12), less penetration of stray fields into abridged trap 592 along y-axis, simplified construction (two sets of electrodes instead of four), and high field strength when accelerating ions into the drift region. This high accelerating field strength results in relatively small so-called "turn-around" time and therefore relatively high TOF mass resolution.

The fact that equipotential lines 616 are straight and parallel to one another implies the accelerating field is highly homogeneous. This is further illustrated in FIG. 19B which depicts abridged linear ion trap 592 including equigradient lines 618 representative of the electric field during the acceleration of ions out of the trap into the TOF analyzer (not shown). Notice in FIG. 19B that the equigradient lines appear only near rods 600-610. This is, of course, because the field strength—i.e. the field gradient—is constant throughout abridged trap 592 and varies only near rods 600-610.

A homogeneous accelerating field is highly desirable in that heterogeneities in such a field lead to distortions in ion flight times and divergence of ion trajectories through the TOF analyzer. Keeping in mind that the TOF analysis occurs along the x-axis and that the ions are being accelerated out of abridged trap 592 along the x-axis, if the accelerating field is heterogeneous, then, for example, ions having the same initial x-position but different y-positions will start at different potentials in the accelerating field and will therefore have different final velocities after acceleration. As a result, their drift times to the detector will differ. In contrast, as represented in FIG. 19A, if the accelerating field is homogeneous, then ions having the same initial x-position but different y-positions will nonetheless start at the same potential in the accelerating field and will therefore have the same final velocity after acceleration and the same drift time to the detector.

Furthermore, a heterogeneous accelerating field will accelerate ions in different directions depending on the ions initial position. In a heterogeneous accelerating field, the electric field lines will point in different directions as a function of position within the field. Two ions starting at the same x-position but different y-positions would be accelerated along the electric field lines—i.e. in different directions. Thus, the trajectories of the ions would diverge from one another. If sufficiently divergent, some ions may follow trajectories that miss the ion detector altogether—resulting in a loss of sensitivity. One may attempt to correct for such divergence by using an ion lens, however, such lenses typically result in distortions in ion drift times and therefore may result in loss of mass resolution. In contrast, a homogeneous accelerating field as depicted in FIG. 19 will result in all ions being accelerated in the same direction. In such a case, the only divergence in the ions' trajectories will be the result of the ions' initial kinetic energies.

Thus, an abridged trap TOF according to the present invention has the advantages over prior art trap TOFs of a high strength, highly homogeneous accelerating field resulting in low distortions in ion flight times and low divergence in ion trajectories. As will be discussed in more detail below, on leaving the LIT, ions may be further accelerated, focused via ion lenses, deflected by a deflector, drift through a field free region, reflected by one or more reflectrons, and detected by an ion detector.

By placing a detector on the x-axis, one can measure the flight time of ions from axis 598 to the detector. Signals from the detector (not shown) may be used to produce time of flight mass spectra and to determine the mass of ions trapped and then accelerated by abridged LIT 592. In alternate methods, one may accelerate the ions out of abridged trap 592 (and subsequently perform a TOF mass analysis) in any direction orthogonal to axis 598—including the y-axis.

As is well known from the prior art, ions having an initial position "s" mm from the end of a homogeneous acceleration field will be temporally focused at a point "2 s" mm after the end of the accelerator. Placing an ion detector at this point will result in the best mass resolution possible in such a simple analyzer. Thus, for simple, low resolution, detection of the contents of abridged trap 592, one might place a detector 2 mm from rods set 596 along the x-axis. In alternate embodiments, however, one may place an additional stage of acceleration after abridged trap 592.

Figure 20:
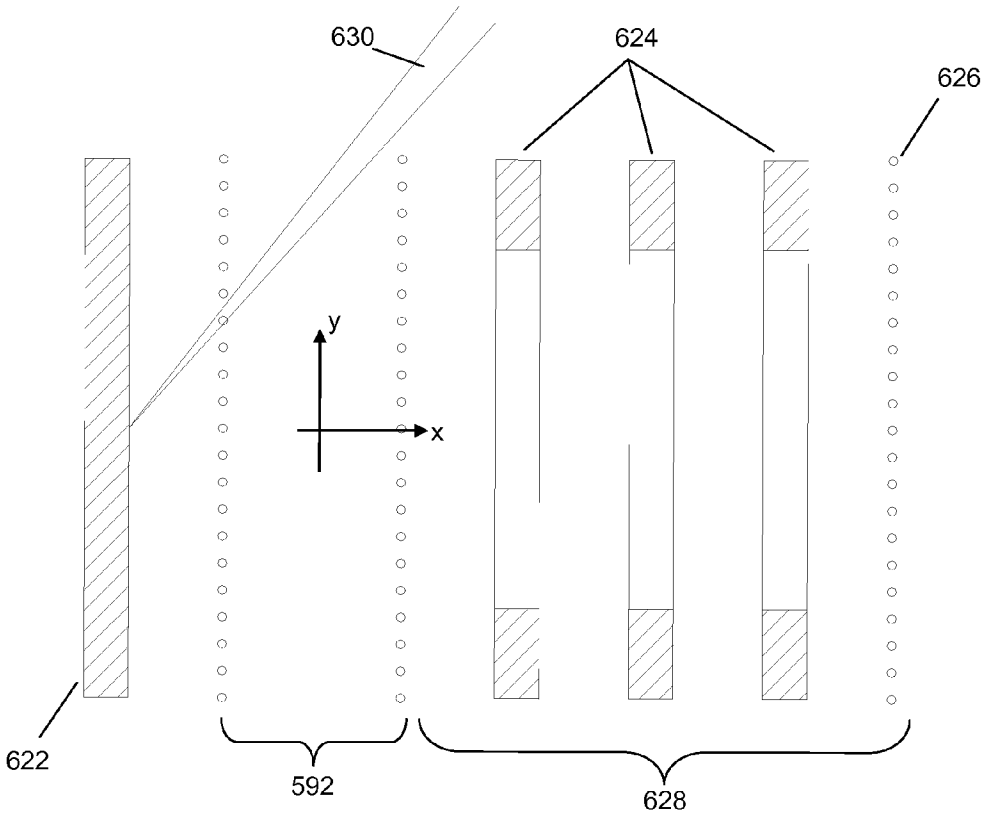
FIG. 20 is a cross-sectional view of an accelerator including a sample plate, an abridged linear ion trap and acceleration electrodes.

Turning next to FIG. 20 shown is a cross-sectional view of accelerator 620 including sample plate 622, abridged linear ion trap 592, acceleration electrodes 624, and grid 626. Acceleration electrodes 624 are rectangular apertured, electrically conducting plates. Grid 626 is comprised of a set of electrically conducting wires arranged parallel to one another in a plane normal to the x-axis. Accelerating electrodes 624 and grid 626 may be comprised of any electrically conducting material; however, as an example, electrodes 624 and grid 626 are comprised of steel. Together, electrodes 624 and grid 626 form second accelerator stage 628. Sample plate 622 is a flat electrically conducting, semiconducting, or resistive plate arranged parallel to abridged trap 592. Sample plate 622 may be comprised of a wide range of materials, however, as an example, is comprised of steel.

In operation, analyte ions are accelerated and subsequently TOF mass analyzed along the x-axis. Accelerating electrodes 624 and grid 626 are used to establish a homogeneous accelerating field along the x-axis adjacent to abridged trap 592. As shown in FIG. 20 accelerating electrodes 624 and grid 626 are spaced at regular intervals along the x-axis. To establish the homogeneous accelerating field, potentials are applied to the electrodes 624 and grid 626, these potentials being linearly related to the x-position of the electrodes and grid. Elements furthest along the x-axis—i.e. further away from abridged trap 592—are held at more attractive potentials. That is, grid 626 is held at the potential most attractive to the ions whereas accelerating electrodes 624 are held at successively less attractive potentials as they are positioned closer to trap 592.

As discussed above, in a first method of operation, ions enter abridged trap 592 along axis 598. Ions in trap 592 are focused about axis 598 by a quadrupolar RF field established in the trap via potentials applied to rods 600-610. As previously discussed, the rods in set 594 may be electrically connected to each other, for example, as described above with respect to FIG. 1—i.e. via a linear resistor and/or capacitor divider chain. The rods in set 596 may be similarly electrically connected. Potentials may then be applied at rods 604 and 606 to set the potentials on the rods in set 594 and at rods 608 and 610 to set the potentials on the rods in set 596. At a predetermined time, the quadrupolar trapping field is turned off and replaced with a homogeneous dipole accelerating field which accelerates the ions out of abridged trap 592 along the x-axis. Immediately on exiting abridged trap 592, the analyte ions encounter the accelerating field established in second accelerator stage 628. Ions are further accelerated through this second homogeneous accelerating field.

Abridged trap 592 and second accelerator stage 628 thus form a two stage accelerator. If the strength of the accelerating field in the two stages—i.e. in trap 592 and stage 629—is the same, then first order space focusing will be achieved at the first image plane. However, as is well know in the prior art, second order space focusing at the first image plane can be achieved by establishing a second stage of acceleration of the appropriate length and field strength.

In an alternate method of operation, analyte (not shown) is deposited on the surface sample plate 622. The analyte deposited on plate 622 may be of any composition—i.e. plant or animal tissue, drugs, biological compounds, synthetic polymers, etc. Further, the analyte may be dissolved in a solid or liquid solvent—i.e. a matrix—especially when performing MALDI. A potential is applied to sample plate 622 to establish a field between plate 622 and rod set 594 of abridged trap 592. A homogeneous dipole field is also established in abridged trap 592. In the present method of operation, no RF potential is applied, rather, only a DC accelerating field is established in trap 592. In alternate methods an RF potential may be applied so as to trap ions produced from the analyte on sample plate 622. As described above, an accelerating field is also established in second stage accelerator 628. In alternate methods, second stage accelerator 628 may be kept field free. According to the present method, all the fields established between plate 622 and abridged trap 592, within trap 592, and in second accelerator stage 628, accelerate ions away from plate 622 along the x-axis.

Pulsed laser light 630 is used to induce desorption and ionization of analyte from sample plate 622. Ions thus produced are accelerated by the accelerating fields to initiate the TOF mass analysis. Following second accelerator stage 628—i.e. to the right on the x-axis—is at least a field free drift region and an ion detector (not shown). Fully accelerated ions drift through the field free region and strike the detector at flight times related to the ions' mass. Recording the detector signals as a function of time thus produces a time of flight mass spectrum. In alternate methods ions may be focused via ion lenses, deflected by one or more deflectors, and/or reflected by one or more reflectrons before being detected by the ion detector.

In further alternate methods, the onset of ion acceleration may be delayed relative to the laser pulse. As is well known in the prior art, such a "delayed extraction" (aka "space-velocity correlated focusing") results in an improved mass resolution. In such an alternate method, the field between plate 622 and rod set 594 is set to zero before and during the laser pulse. At a predetermined time after the laser pulse, the potential(s) on either or both plate 622 and rod set 594 are pulsed to a new value so as to rapidly establish the desired accelerating field between the plate and rod set. As is well known from the prior art, the predetermined time and the strength of the accelerating fields can be chosen to optimize the mass resolution at an ion mass of interest. In further alternate methods, the field between plate 622 and rod set 594 established during the time before the laser pulse until the time of "extraction"—i.e. acceleration to initiate the TOFMS analysis—may be decelerating. That is, between the time of the laser pulse and extraction pulse, the field accelerates desorbed ions towards plate 622. In prior art instruments, such deceleration has also been shown, in some cases, to improve mass resolution. In yet further alternate methods, the field between plate 622 and rod set 594 is established after a time delay from the laser pulse; however, thereafter the field strength in this region is a function of time—this function including an exponential term. Similar to the method detailed by Franzen in U.S. Pat. No. 5,969,348, the potential difference, U', between plate 622 and rod set should take the form $U'=V'+W'(1-\exp(\tau-t)/t_1)$, where V' is the potential applied between the plate and rods at time $\tau$, (V'+W') is the final potential difference, t is time, and $t_1$ is a time constant. According to Franzen, varying the field strength with time in such a manner can result in at "least first order . . . [focusing] . . . simultaneously for all ions." Thus, in such an alternate method, the mass resolution is improved over a broader mass range as compared to methods that do not vary field strength as an exponential function of time.

Accelerator 620, according to the present invention, thus has an advantage of flexibility over prior art designs. Unlike prior art designs, the present invention can be used to perform conventional "axial" TOF—e.g. axial MALDI—experiments as well as trap-TOF experiments—i.e. wherein ions are introduced along axis 598, trapped in abridged trap 592, and then accelerated into the drift region of the TOF—in the same instrument.

As is well known from prior art time-of-flight mass spectrometers, the starting conditions of the ions are important in determining the outcome of the analysis. For example, the spatial distribution and velocity distribution of the ions at the time acceleration is initiated are important to determining the resolution and sensitivity of the instrument. Smaller initial space and velocity distributions generally produce higher resolution and sensitivity results. As is also well known in the prior art, ions in an RF multipole can be "cooled" by the introduction of a collision gas. That is, the velocity distribution of ions is reduced via collisions with gas molecules. Furthermore, the pseudopotential field of the RF multipole will tend to focus the ions spatial distribution toward the axis of the multipole such that, in general, as an ion is cooled it will also have a smaller spatial distribution about the multipole axis.

Figure 21A:
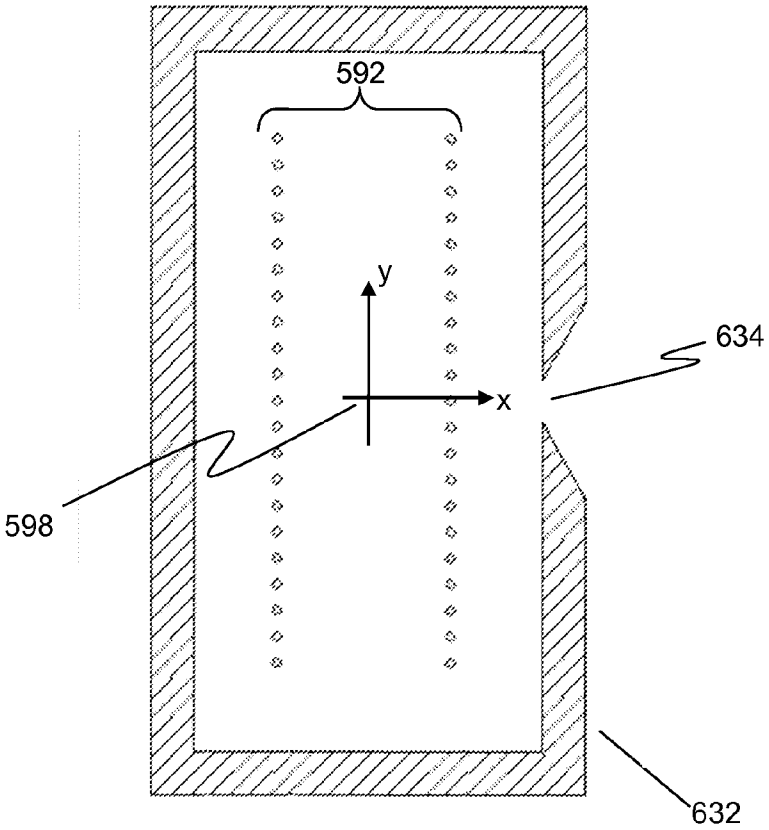
FIG. 21A is a cross-sectional view of an abridged linear ion trap enclosed in a housing including an slit through which ions can be accelerated.

FIG. 21A is a cross-sectional view of abridged linear ion trap 592 enclosed in housing 632 including slit 634 through which ions can be accelerated. Enclosure 632 acts as a pumping restriction such that the pressure inside the enclosure and, importantly, inside abridged trap 592 can be maintained at an elevated pressure relative to the vacuum system outside the enclosure. This is advantageous in that it is desirable to maintain trap 592 at a relatively high pressure (typically, but not limited to pressures above $10^{-4}$ mbar) for collisional cooling of the ions, whereas the pressure in the acceleration and drift regions of the TOF should be maintained with vacuum pumps at relatively low pressures (preferably, but not limited to, pressure below $10^{-6}$ mbar) in order to avoid ion-molecule collisions. Ion-molecule collisions in the TOF accelerator or drift regions lead to broadening in the velocity of the ions and thereby tend to reduce resolution and sensitivity. Abridged trap 592 is therefore fully enclosed by enclosure 632 such that gas can escape into the TOF drift region only through slit 634. Notice that enclosure 632 is extended along the z-axis in the same manner that trap 592 is extended. Enclosure 632 is preferably made of electrically conducting material such as steel.

In operation, collision gas is introduced into enclosure 632 to induce collisional cooling. The pressure of the collision gas is optimized to provide the best cooling possible while at the same time inducing as few ion-molecule collisions as possible in the acceleration and drift regions of the TOF analyzer. In practice the optimum pressure is determined experimentally by observing the mass resolution and sensitivity of the instrument as a function of collision gas pressure. Any type of gas may be used as the collision gas, however, the gas is preferably, inexpensive, inert, is a good collision partner—i.e. cools the ions quickly without fragmentation—and is readily pumped away. Examples of collision gases include argon and nitrogen.

As the ions are cooled via collisions, they also become focused into a thin line at or near central axis 598 due to the abridged RF multipole field. This smaller spatial distribution results in an improved TOF resolution. The focusing action of the abridged quadrupole field is m/z dependent. That is, under a given set of conditions, ions of a first m/z will have a different spatial distribution than ions of a second m/z. As a general trend, under a given set of conditions, ions of higher m/z will be less strongly focused.

The frequency and amplitude of the RF waveform applied to abridged trap 592 may be selected to optimize the TOF resolution achieved for ions of a specific mass or mass range. A lower frequency or higher RF amplitude will tend to more strongly focus ions of higher mass toward axis 598 resulting in a narrower spatial distribution and higher TOF resolution at these masses. However, a higher RF amplitude or a lower RF frequency will also result in more micromotion. This will tend to increase the initial velocity distribution of the ions and thus lower the TOF mass resolution. There will therefore be an optimum frequency, f, and amplitude, V, which results in the best TOF mass resolution. These optimum conditions may be readily determined by observing the TOF mass resolution while varying the frequency and amplitude of the RF waveform.

Figure 21B:
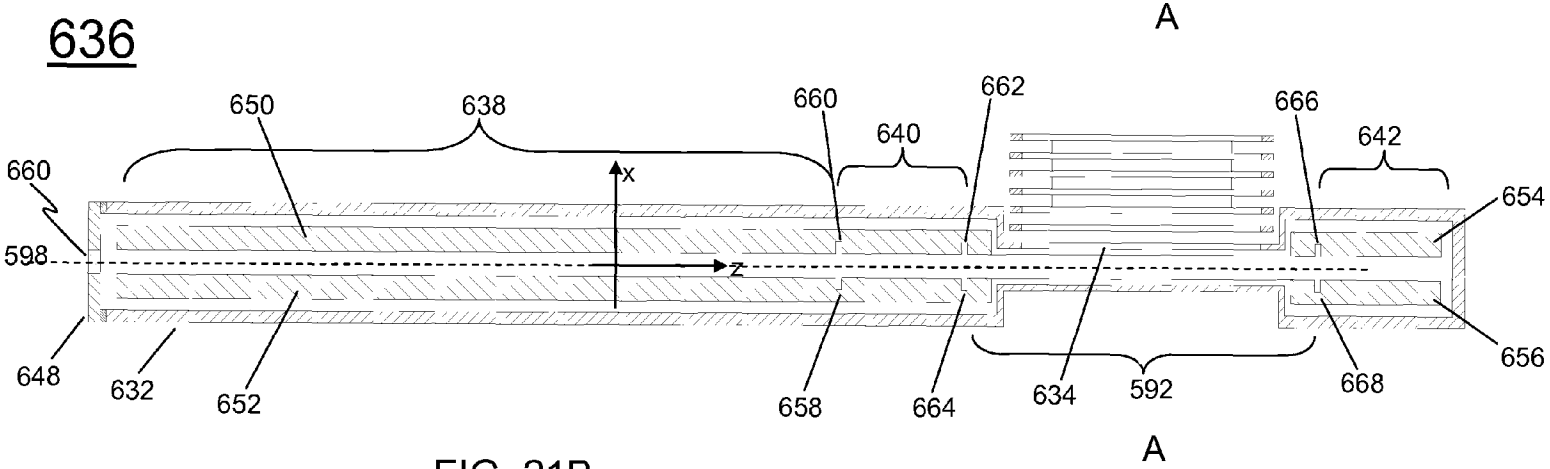
FIG. 21B shows a cross-sectional view of an abridged linear ion trap assembly for trapping and accelerating ions.

In alternate embodiments, collisional cooling of the ions may be induced upstream from abridged trap 592. FIG. 21B depicts a cross-sectional view of abridged quadrupole linear ion trap assembly 636 including abridged quadrupolar linear ion trap 638, front section 640, abridged linear ion trap 592 for trapping and accelerating ions, back section 642, second stage accelerator 644, entrance lens 648, and housing 632. Housing 632 encloses abridged trap 638, front section 640, abridged trap 592, back section 642, and supports 650-656 on which they are mounted. Housing 632 is preferably made of electrically conducting material such as steel. In addition to slit 634 in housing 632, lens element 648 includes aperture 660 through which ions enter linear ion trap 638 along axis 598.

Abridged traps 638 and 592 and front and back sections 640 and 642 are constructed on supports 650-656 in a manner similar to that described with respect to trap 470 depicted in FIG. 13. Supports 650-656 are electrically insulating plates constructed of, for example, ceramic. Although the dimensions of supports 650-656 may vary widely, in the present embodiment the supports are 2 mm thick—i.e. along the x-axis—and 6 mm high—i.e. along the y-axis. Supports 650 and 652 are 73 mm long—i.e. along the z-axis. Supports 654 and 656 are 12.5 mm long along the z-axis. The surfaces of supports 650-656 facing the interior of assembly 636 are coated with a resistive film. Electrically conducting rods are fixed to the surfaces of supports 650-656 which are then placed on opposite sides of axis 598 to produce a geometry identical to that of abridged trap 592. Grooves 658-668 are cut into the supports to separate the various sections—i.e. front and back sections 640 and 642 and traps 638 and 592—from one another. The electrically conducting rods of sections 638, 640, 642 and 592 are electrically isolated from one another via grooves 658-668 such that each section can be electrically driven independently from the other sections.

Figure 21C:
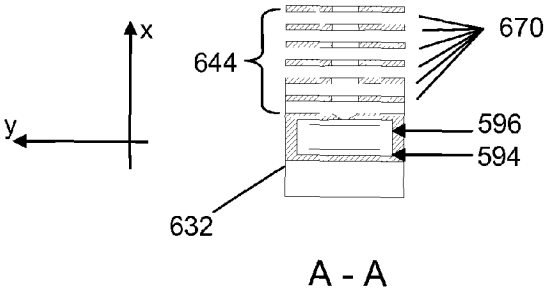
FIG. 21C shows a cross-sectional view, taken at line "A-A" in FIG. 21B of an abridged linear ion trap assembly for trapping and accelerating ions.

FIG. 21C shows a cross-sectional view, taken at line "A-A" in FIG. 21B of abridged linear ion trap assembly 636. Here, rod sets 594 and 596 are depicted as two lines. Second stage accelerator 644 consists of a set of electrically conducting plates 670 which include rectangular slits. As shown, the slits in plates 670 are aligned with slit 634 in housing 632 such that analyte ions can be accelerated from axis 598 through slit 634 and through the slits in plates 670. As discussed above, during operation, potentials applied to plates 670 produce a homogeneous accelerating field which accelerates ions along the x-axis into the drift region of the TOF analyzer.

FIG. 22 depicts the potentials applied to abridged trap assembly 636 as a function of position along the z-axis during operation according to a preferred method. Notice that the potentials plotted in FIG. 22 are not to scale. According to this preferred method, U and $E_y$ of equation (12) are set to zero throughout the experiment. During operation, the same RF potential, V, is initially applied to all sections 592, 638, 640, and 642 of abridged trap assembly 636. The amplitude, V, and frequency, f, of the applied waveform may vary widely, however, as an example, the V may be 300 Vpp and f may be 1 MHz. As discussed above collision gas is introduced into housing 632 near abridged trap 638 via a gas tight fitting (not shown). In alternate embodiments the collision gas is introduced via aperture 660 in lens element 648.

Figures 22A, 22B, 22C, 22D:
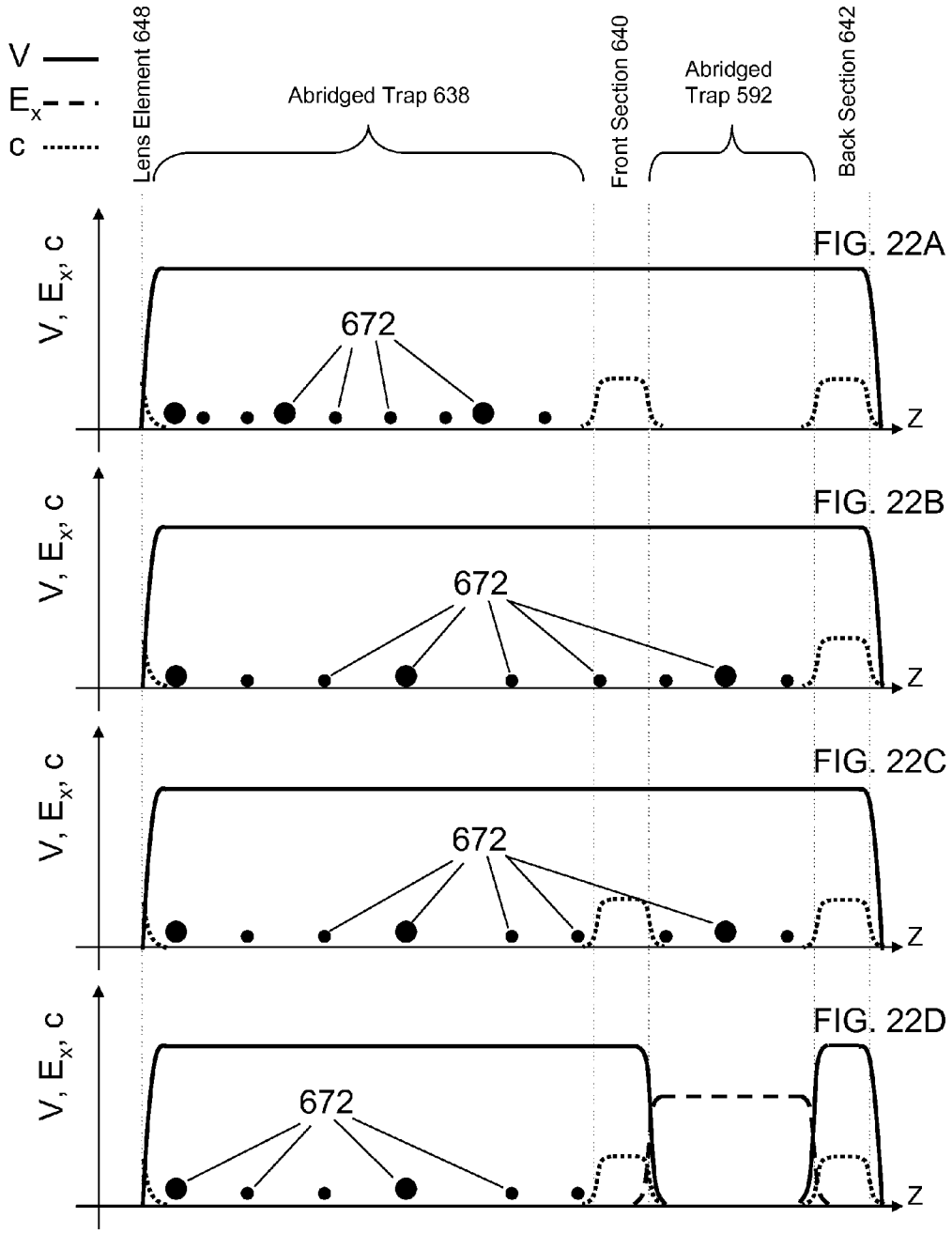
FIG. 22A depicts the potentials applied to the abridged trap assembly of FIG. 21 as a function of position along the z-axis during a first step of a preferred method of operation.
FIG. 22B depicts the potentials applied to the abridged trap assembly of FIG. 21 as a function of position along the z-axis during a second step of a preferred method of operation.
FIG. 22C depicts the potentials applied to the abridged trap assembly of FIG. 21 as a function of position along the z-axis during a third step of a preferred method of operation.
FIG. 22D depicts the potentials applied to the abridged trap assembly of FIG. 21 as a function of position along the z-axis during a fourth step of a preferred method of operation.

Potentials V, $E_x$, and c (see equation (12)) applied in a first step of the preferred method are plotted as a function of z in FIG. 22A. As shown the DC offsets—"c" in equation (12)—of abridged traps 638 and 592 are set to ground whereas front and back sections 640 and 642 respectively are set to a higher potential—i.e. more repulsive to the analyte ions. The DC offsets on front and back sections 640 and 642 may vary widely, however, as an example, the DC offset applied to front and back sections is 5 V assuming positively charged ions are being analyzed. In alternate embodiments the DC offset of abridged traps 638 and 592 are set to some potential other than ground. In such a case, the offsets of front and back sections 640 and 642 are set relative to traps 638 and 592. Ions here represented as dots 672 are introduced via aperture 660 and move along axis 598 toward front section 640. Collisions between the ions and molecules of the collision gas cools the ions while the RF waveform on abridged trap 638 causes the ions to be focused toward axis 598. The DC offset on front section 640 prevents the ions from moving downstream while a similarly repulsive DC potential on lens element 648 prevents the ions from returning upstream. Thus, the combination of DC potentials between lens element 640, abridged trap 638, and front section 640, and the radial focusing due to RF potential, V, causes the ions to become trapped in abridged trap 638.

Potentials V, $E_x$, and c (see equation (12)) applied to trap assembly 636 in a second step of the preferred method are plotted as a function of z in FIG. 22B. As shown, the DC potential on front section 640 is reduced to zero so that ions may diffuse freely back and forth between abridged traps 638 and 592. Ions are prevented from progressing further downstream by the DC offset on back section 642. Ideally, the ions are not accelerated or heated while passing into abridged trap 592. Potentials V, $E_x$, and c (see equation (12)) applied to trap assembly 636 in a third step of the preferred method are plotted as a function of z in FIG. 22C. As shown, the DC offset on front section 640 is returned to a repulsive potential so that no additional ions may enter trap 592. Finally, potentials V, $E_x$, and c (see equation (12)) applied to trap assembly 636 in a fourth step of the preferred method are plotted as a function of z in FIG. 22D. Here the TOF mass analysis is initiated by turning off the RF waveform on abridged trap 592—i.e. V is set to zero—and establishing a homogeneous dipole accelerating field, $E_x$, in order to accelerate the ions out of trap 592 along the x-axis as described above with reference to FIG. 20. The accelerating field strength may vary widely, however, as an example, $E_x$ may be 1 kV/mm.

Notice that the RF waveform on abridged trap 638, front section 640, and back section 642 is not turned off at any time during operation. Rather, abridged trap 638 may continuously accumulate analyte ions and subsequently transfer them to trap 592 for acceleration into the drift region. As a result, the abridged trap-TOF according to the present invention has the advantage over prior art trap-TOF and orthogonal TOF instruments of high efficiency of transfer of ions into the TOF analyzer.

The time allowed for each of the steps described above with respect to the preferred method may vary widely. In contrast to prior art orthogonal TOF instruments, the "transfer time"—i.e. the second step described above—may be as long as desired. Because the ions have time to be redistributed between traps 638 and 592 without the possibility of being lost during the transfer, there is no mass depend discrimination as is frequently observed in prior art orthogonal TOF analyzers.

When incorporated as part of an abridged trap-TOF instrument, the method described above will ultimately result in ions striking a detector at times related to the ions' mass. Recording the detector signals a function of time thus results in a TOF mass spectrum. However, as is well known from prior art TOF instruments, the signal resulting from performing the above described method a single time may be noisy or statistically insignificant. To produce a statistically significant spectrum the above method may be performed repeatedly, each time measuring the detector signal as a function of time and then adding the measured traces together to produce a spectrum. The number of times per second which the above method is repeated—i.e. the repetition rate—may also be selected from a wide range, however, is preferably optimized based on the current of analyte ions available at lens element 648. Experimentally, the repetition rate is optimized by observing the ion signal intensity and resolution in the TOF mass spectrum as a function of repetition rate. If the repetition rate is too low (or equivalently the ion current too high), coulombic effects will tend to reduce the TOF resolution and sensitivity. A repetition rate that is too high may result in a reduced sensitivity due to excessive electronic noise. More importantly, a high repetition rate will limit the time available for the TOF mass analysis and thereby the measurable mass range. As an example, the repetition rate may be set to 5 kHz—i.e. 5,000 repetitions of the above method per second. The time allowed for the second step in each repetition of the method may be selected to be 185 μs while 5 μs is allowed for each of the other steps.

In alternate methods, additional steps of ion manipulation may be performed in abridged quadrupolar linear ion trap 638. As described above with reference to abridged trap 174 and FIG. 13, such manipulations may include the application of a SWIFT waveform for ion excitation or isolation, ion selection by mass selective stability, fragmentation of selected ions via collision induced dissociation, electron capture dissociation, electron transfer dissociation, photodissociation, metastable activated dissociation, or any other known prior art dissociation method. Alternatively, selected ions may be reacted with reagent ions or molecules. Following such manipulations, product ions, fragment ions, and remaining precursor ions may be transferred to abridged trap 592 and mass analyzed by TOF. In alternate methods, $MS^n$ experiments may be performed by repeatedly performing the steps of selecting ions of interest from a group of fragment ions and then dissociating the selected ions to produce a next generation of fragment ions. The ions produced from the final dissociation step are then transferred to abridged trap 592 and TOF mass analyzed to produce an $MS^n$ mass spectrum.

In alternate embodiments, front section 640 is eliminated and ions flow continuously from trap 638 into abridged trap 592. In alternate embodiments, back section 642 is replaced by a DC electrode. In operation, this DC electrode is continuously held at a DC potential which is more repulsive to the ions than the DC offset on abridged trap 592. In alternate embodiments abridged trap 638 may be replaced by a conventional multipole trap. In further alternate embodiments abridged trap 638 may be replaced by a conventional quadrupole trap. The axes of the rods of such a conventional quadrupole linear ion trap would be parallel to the z-axis but would intersect the x' and y' axes as implied by equation (1). The inscribed radius, $r_o'$, of the conventional quadrupole trap may be any radius, however, as an example, $r_o'$ equals $\sqrt{2}r_o$. Such a conventional quadrupole trap would preferably be driven by a waveform which results in an RF quadrupole field of the same strength, frequency, and phase as the RF field in abridged trap 592. In alternate embodiments, the conventional quadrupole or multipole trap may be driven by an RF waveform of any frequency, amplitude, and phase.

Figures 23A, 23B:
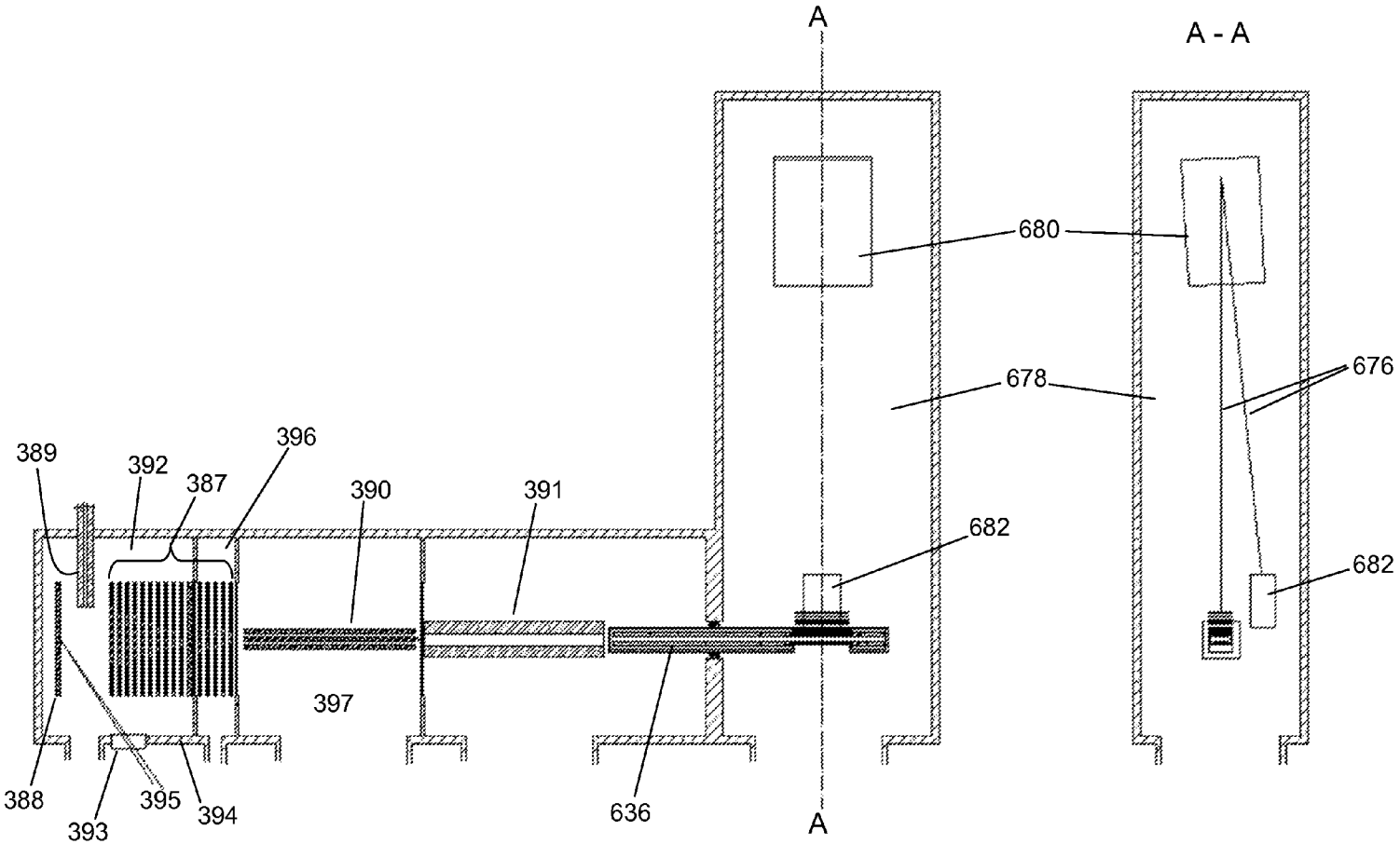
FIG. 23A depicts a mass spectrometer including an abridged linear ion trap for trapping and accelerating ions.
FIG. 23B shows a cross-sectional view, taken at line "A-A" in FIG. 23A, of a mass spectrometer including an abridged linear ion trap for trapping and accelerating ions.

As shown in FIG. 23A, abridged trap assembly 636 is incorporated into mass spectrometry system 674, including ion guide 387, MALDI target 388, orthogonal glass capillary 389 by which ESI ions may be introduced, multipole ion guide 390, and abridged quadrupole 391. Either MALDI or ESI may be used to produce ions simultaneously, in close succession, or independently. Of course, any other prior art ionization means may be used to produce ions in conjunction with the present embodiment.

As discussed above with respect to mass spectrometer system 385, gas and ions are introduced from, for example, an elevated pressure ion production means (such as electrospray ionization) into chamber 392 via capillary 389. After exiting capillary 389 the directional flow of the ions and gas will tend to continue in the direction of the capillary axis. Deflection electrode 388 is preferably a planar, electrically conducting electrode oriented perpendicular to the axis of ion guide 387 and parallel to the axis of capillary 389. A repulsive potential is applied to electrode 388 so that ions exiting capillary 389 are directed toward and into the inlet of ion guide 387. Through a combination of DC and RF potentials and the flow of gas—by methods well known in the prior art—ions are passed through ion guide 387 and into downstream optics.

Alternatively, ions may be produced by Matrix-Assisted Laser Desorption/Ionization (MALDI). To produce MALDI ions, samples are prepared and deposited onto electrode 388. Window 393 is incorporated into the wall of chamber 394 such that laser beam 395 from a laser positioned outside the vacuum system may be focused onto the surface of electrode 388 such that the sample thereon is desorbed and ionized. Again, a repulsive potential on electrode 388 directs the MALDI ions into ion guide 387.

As known from the prior art, two stage ion guide 387 (a.k.a. an ion funnel) is capable of accepting and focusing ions even at a relatively high pressure (i.e., ~1 mbar in first pumping chamber 392) and can efficiently transmit them through a second, relatively low pressure differential pumping stage (i.e., $\sim 5\times10^{-2}$ mbar in second pumping chamber 396) and into a third pumping chamber 397. Once in chamber 397 ions pass into and through RF multipole ion guide 390. RF multipole ion guide 390 is constructed and operated by methods known in the prior art. Ion guide 390 may be a quadrupole, hexapole, octapole, or other higher order multipole. In alternate embodiments, ion guide 390 may be an abridged multipole—for example, an abridged quadrupole. While in ion guide 390, ions undergo collisions with gas molecules and are thereby cooled towards the axis of the ion guide. After passing through ion guides 387 and 390, the ions are mass analyzed by abridged quadrupole 391. That is, ions of a selected mass-to-charge ratio are passed from ion guide 390 to abridged linear ion trap assembly 636 via abridged quadrupole 391 while rejecting substantially all other ions. In order to avoid collisions with gas interfering with the mass analysis, the pressure in abridged quadrupole 391 should be maintained at $10^{-5}$ mbar or less. In the present embodiment, a DC potential is applied between all adjacent elements so as to force the ions through the system from upstream elements (e.g., funnel 387) toward downstream elements (e.g., abridged trap assembly 636)—that is, from left to right in FIG. 23A.

The gas pressure in abridged quadrupole assembly 636 is preferably $10^{-4}$ mbar or greater. Typically the gas is inert (e.g., Nitrogen or Argon), however, reactive species might also be introduced into the assembly. When ions are injected into abridged quadrupole 638 with a low kinetic energy, for example 5 eV, the ions are simply cooled and trapped as described above with reference to FIGS. 21 and 22. That is, the energy of collisions between the ions and the gas in abridged quadrupole 638 is too low to cause the ions to fragment. However, if, for example, the potential difference between multipole 390 and abridged quadrupole linear ion trap 638 is high, for example 100 V, the ions will enter trap 638 with a high kinetic energy and collisions between the ions and gas may cause the ions to fragment. As mentioned above, this may be useful when performing tandem MS experiments. Also, as discussed above with reference to FIG. 22, many other ion manipulations may be performed in abridged trap 638 before product and remaining precursor ions are transferred to abridged quadrupole trap 592.

From abridged trap 638, ions are transferred into abridged quadrupole trap 592 where the TOF mass analysis of the precursor and fragment ions is initiated. Ions are trapped in and accelerated out of abridged quadrupole linear ion trap 592 as described above with respect to FIGS. 21 and 22. FIG. 23B shows a cross-sectional view of mass spectrometer system 674, taken at line "A-A" in FIG. 23A. As shown, once accelerated out of abridged trap assembly 636, ions follow a trajectory, roughly represented by lines 676, through TOF drift region 678 and reflectron 680 to ion detector 682. The motion of the ions, and methods of lateral and temporal focusing of the ions is well known from the prior art. As an example, reflectron 680 is positioned 0.2 m from abridged trap assembly 636. Reflectron 680 is a single stage reflectron tilted at an angle of 3° from the line between the reflectron and assembly 636. As is well known from the prior art, during operation, potentials are applied to reflectron 680 so as to produce an electric field therein. The reflectron electric field can be used to temporally focus ions from a first image plane near abridged trap 592 to a second image plane at detector 682. In alternate embodiments, the distance between reflectron 680 and assembly 636 may be any distance. In alternate embodiments, reflectron 680 is a two stage reflectron. As is known from the prior art, a single stage reflectron can produce at best first order temporal focusing whereas a two stage reflectron can produce second order focusing. In alternate embodiments reflectron 680 is not tilted. Rather, reflected ions travel back towards trap 592 and the system may be used as a coaxial multiple reflection TOF analyzer. Alternate embodiment abridged trap TOF spectrometers may include additional lenses—for example Einsel lenses—for lateral focusing. Alternate embodiment abridged trap TOF spectrometers may include deflection plates for steering the ions.

In alternate embodiments, abridged quadrupole 391 may be replaced by a conventional quadrupole. In alternate embodiments, quadrupole 391 and/or multipole 390 and the vacuum stages in which they reside may be eliminated. In alternate embodiments, a multitude of reflectrons are used to create a multiple reflection TOF analyzer. In alternate embodiments, reflectron 680 is eliminated and detector 682 is placed at the first image plane—i.e. the point at which the ions come into temporal focus. In alternate embodiments, any number of abridged multipoles arranged in parallel or in series may be used in conjunction with any prior art ion production means, any combination of other types of mass analyzers, collision cells, ion detectors, digitizers, and computer and software systems.

It should also be noted that abridged quadrupole 391 may be operated in any manner consistent with equations (8) through (14). Such operation may include, for example, transmission over a broad mass range by applying an RF-only potential, transmission over a narrow mass range by applying RF and DC potentials, or transmission of notched mass ranges by applying an RF-only potential to radially confine ions and an AC potential for resonant excitation of ions at specific frequencies to eliminate unwanted mass ranges.

As discussed with reference to FIG. 22, the TOF mass analysis of analyte ions includes the steps of confining the ions in abridged trap 592 and then accelerating the ions out of the trap under the influence of a homogeneous electric field. The conditions under which the confining RF is turned off and the accelerating field is turned on can have a substantial influence on the mass resolution and sensitivity achieved with a given abridged trap-TOF instrument. As previously discussed, the rods of set 594 may be electrically connected to each other, for example, as described above with respect to FIG. 1—i.e. via a linear resistor/capacitor divider chain. The rods of set 596 may be similarly electrically connected. Potentials may then be applied at rods 604 and 606 to set the potentials on the rods of set 594 and at rods 608 and 610 to set the potentials on the rods of set 596.

Figure 24:
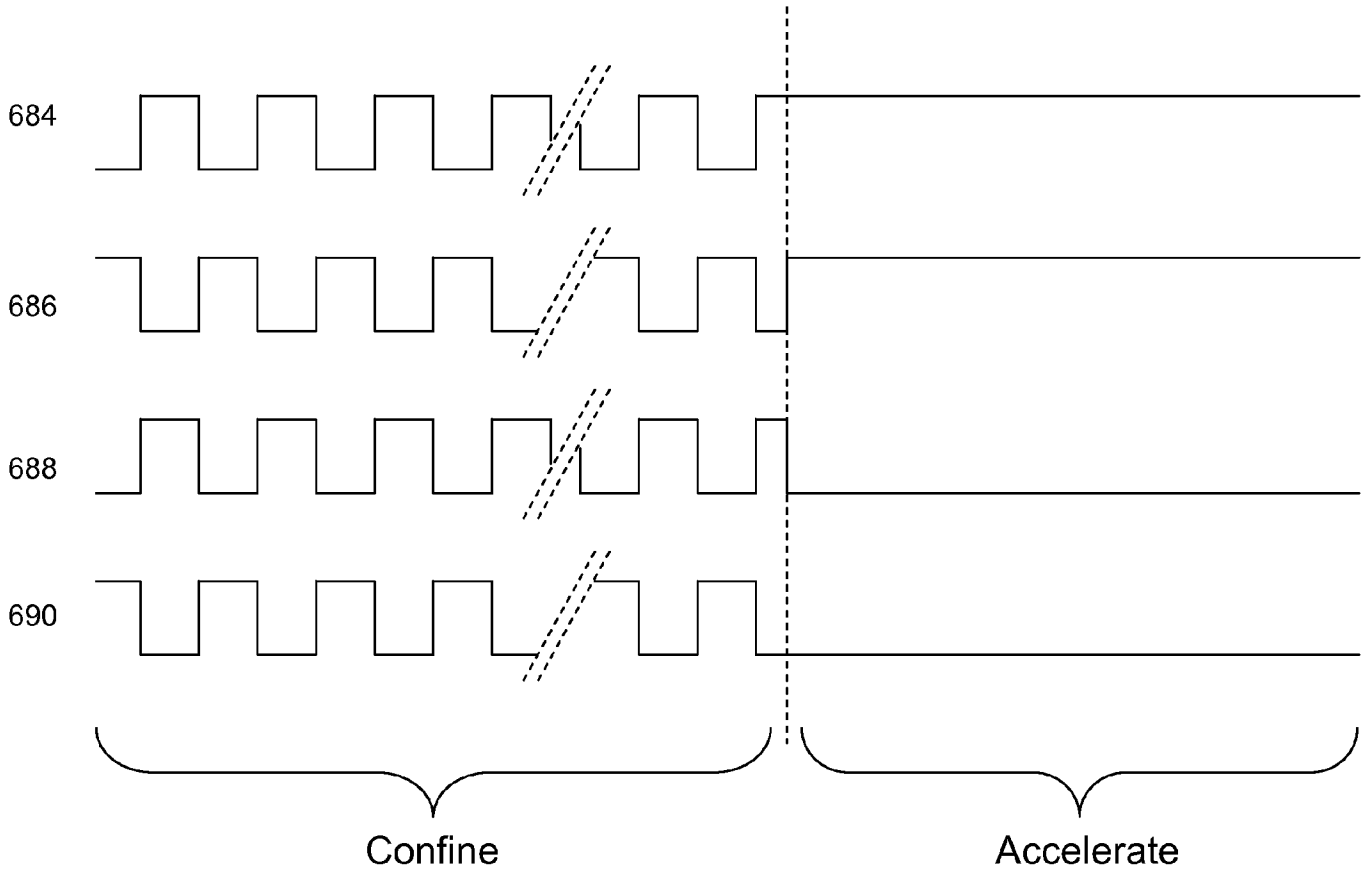
FIG. 24 depicts the waveforms applied at rods 604, 606, 608 and 610 of the abridged trap depicted in FIG. 18A according to a preferred method of the present invention.

Also, as previously mentioned with reference to equations (11) and (12), the RF potential applied to the abridged trap may follow any of a wide variety of periodic functions of time. For example the RF waveform may be a sine wave, triangle wave, or square wave. Shown in FIG. 24 are the waveforms 684, 686, 688, and 690 applied to rods 604, 606, 608, and 610 respectively to drive rod sets 594 and 596 of abridged trap 592 during a trap-TOF experiment. According to the present embodiment, the waveforms are square waves during ion confinement, however, in alternate embodiments the waveforms may be any periodic function of time during ion confinement.

As described with reference to FIG. 22, the applied waveforms 684-690 are periodic during ion confinement whereas during ion acceleration rods sets 594 and 596 are set to DC potentials. The frequency and amplitude of waveforms 684-690 during ion confinement may vary widely, however, as an example, the frequency and amplitude of the waveforms are 1 MHz and 1 $kV_{0p}$ respectively. The frequency and amplitude of the waveforms applied during ion confinement may be optimized for a given mass or mass range. Higher frequencies are typically advantageous for lower masses whereas higher amplitudes are advantageous for higher masses. In the present embodiment, the amplitude of the waveforms is 1 kV and the potentials applied during acceleration are +/−1 kV. This has the advantage of a simplified transition from confinement to acceleration. In order to transition from confinement to acceleration, the waveforms 684 and 690 applied to rods 604 and 610 respectively simply remain at the last value of the RF waveform. Waveforms 686 and 688 applied to rods 606 and 608 respectively reverse polarity at the time acceleration is to begin.

The phase in the RF cycle at the time that the application of the RF potential is discontinued is selected to minimize the ion's kinetic energy due to micromotion. Experimentally, this may be done by observing the mass resolution in the spectra produced by the abridged trap-TOF as a function of phase. The best mass resolution should correspond to the optimum phase and minimum micromotion. As detailed in "Quadrupole Mass Spectrometry and its Applications" (P. H. Dawson ed, AIP Press, 1995), " . . . the displacement due to the micromotion is out of phase with the rf potential by π . . . ". Naturally, this implies that the theoretical minimum in micromotion occurs at a phase of nπ. Thus, in the present embodiment—i.e. the method represented in FIG. 24—the phase at which the RF is discontinued is selected to be a multiple of π—i.e. that time at which the RF waveform is at its maximum.

Figure 25:
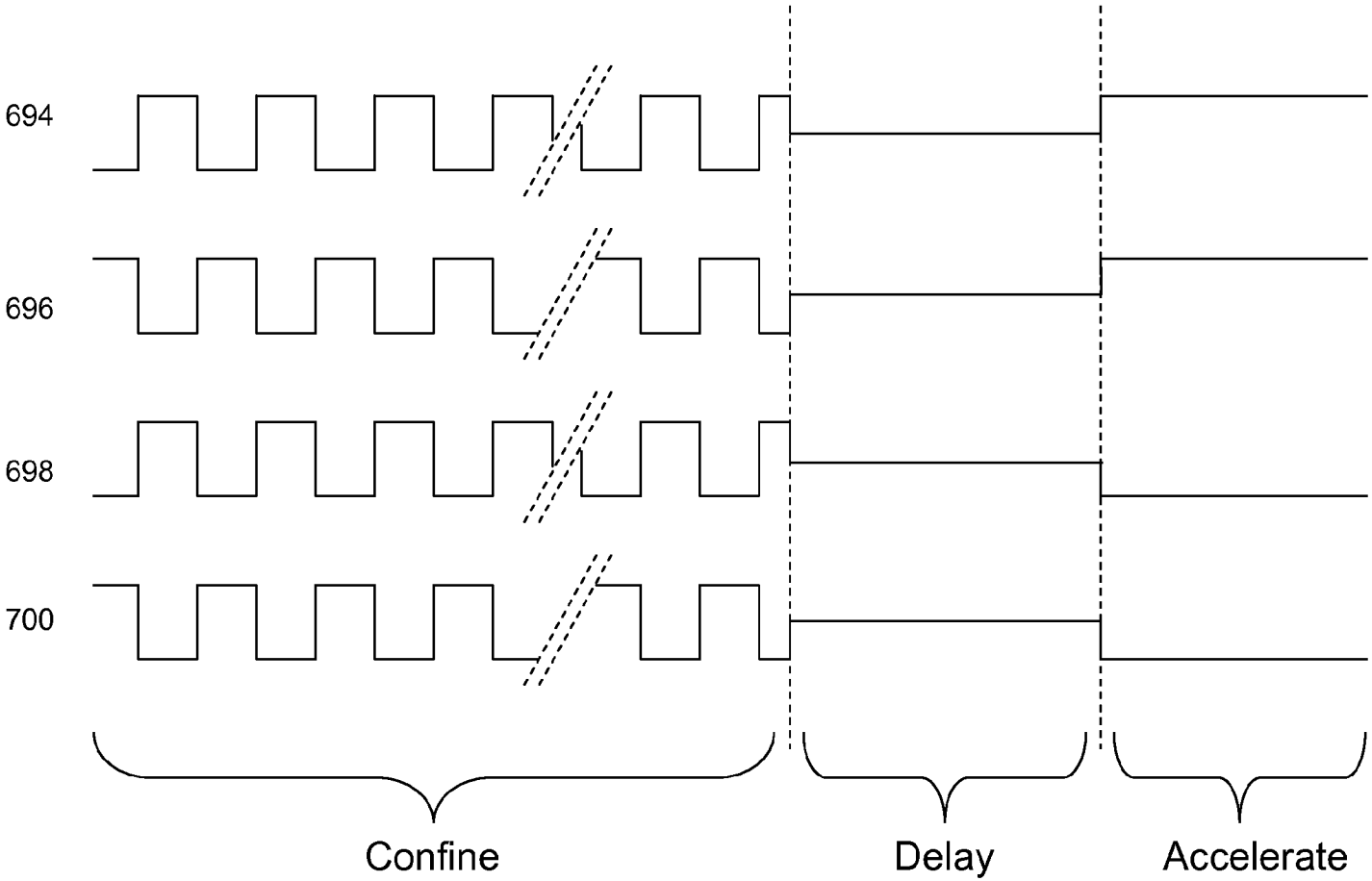
FIG. 25 depicts the waveforms applied at rods 604, 606, 608 and 610 of the abridged trap depicted in FIG. 18A according to an alternate method of the present invention.

In a further alternate embodiment depicted in FIG. 25, a delay is introduced between the discontinuance of the RF quadrupole field and the application of the accelerating dipole field. As depicted in FIG. 25, waveforms 694, 696, 698, and 700—applied to rods 604, 606, 608, and 610 respectively—are identical to waveforms 684—690 respectively during ion confinement. Also, the phase at which the RF is discontinued—i.e. to minimize the kinetic energy of the ions due to micromotion—is the same as described with respect to waveforms 684-690. However, instead of transitioning directly to an accelerating field, the potential on all rods 604-610 (and through the RC network rods 600 and 602) are set to zero for the duration of a delay period. After the delay, the potentials on rods 604-610 are set to accelerate the ions—i.e. to +/−1 kV. The introduced delay establishes a correlation between the ions' initial velocity and its initial position—i.e. the ions' velocity and position at the onset of acceleration. During the delay, when no field is present, the ions drift away from axis 598 according to their initial velocities. Thus, during the delay, ions of high initial velocities will move further from axis 598 than ions of low initial velocities. At the time the accelerating potentials are applied the position, $x(\tau)$, of the ions in abridged trap 592, will be related to the ions' initial velocity by $v\tau$, where v is initial velocity and τ is the duration of the delay. Establishing such a correlation allows one to achieve an improved TOF mass resolution.

Figure 26:
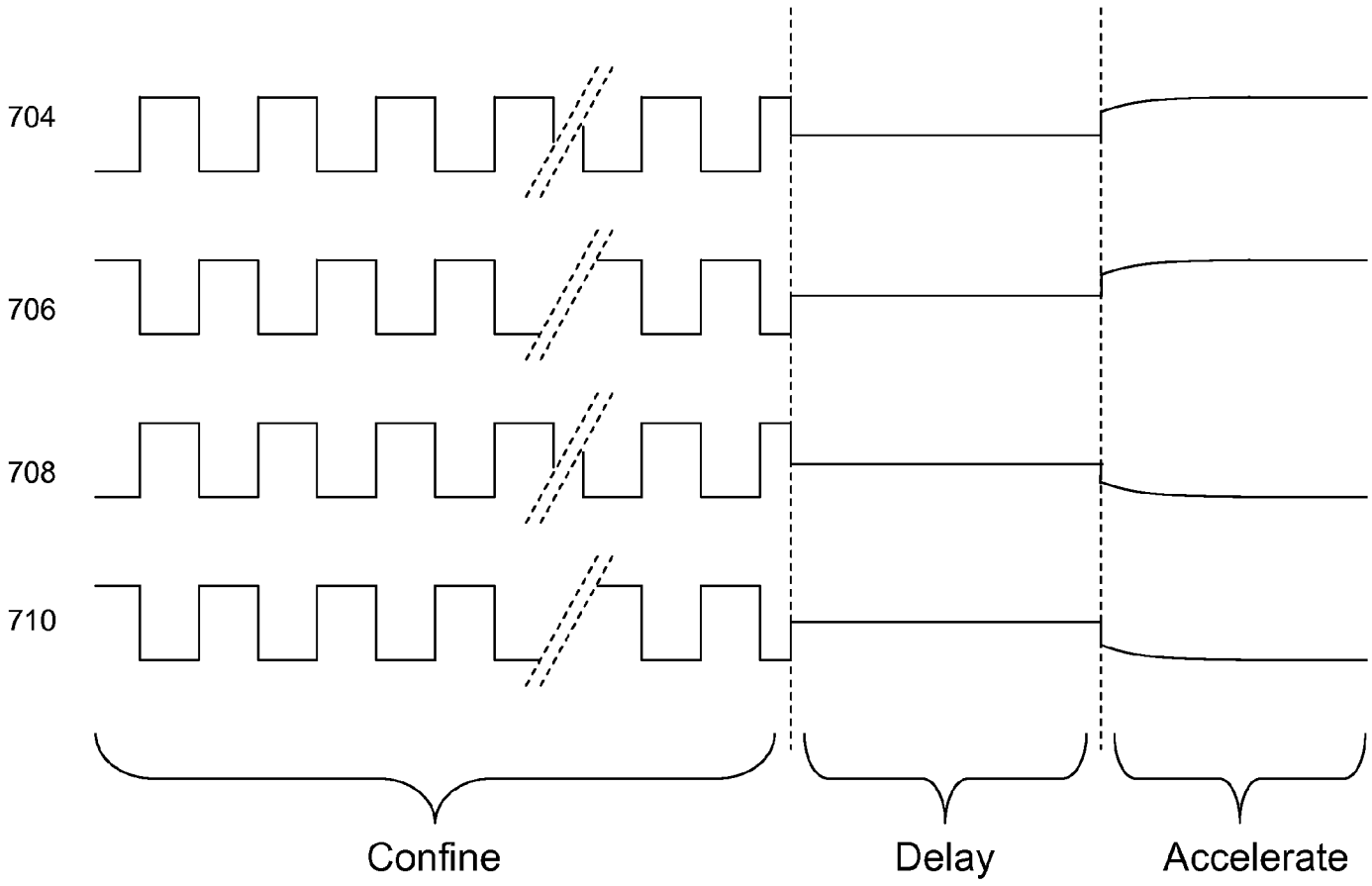
FIG. 26 depicts the waveforms applied at rods 604, 606, 608 and 610 of the abridged trap depicted in FIG. 18A according to an alternate method of the present invention.

In yet a further alternate embodiment depicted in FIG. 26, the potential applied after delay time, τ, is an exponential function of time. As depicted in FIG. 26, waveforms 704, 706, 708, and 710—applied to rods 604, 606, 608, and 610 respectively—are identical to waveforms 694, 696, 698, 700 during ion confinement. Also, the phase at which the RF is discontinued—i.e. to minimize the kinetic energy of the ions due to micromotion—is the same as described with respect to waveforms 684-690. Finally, the accelerating potentials are applied after a delay, τ, however, unlike the method of FIG. 25, the accelerating potentials are exponential functions of time. Similar to the method detailed by Franzen in U.S. Pat. No. 5,969,348, potentials applied at rods 604-610 at times greater than or equal to τ, take the form $U'=V'+W'(1-\exp((\tau-t)/t_1))$, where V' is the potential applied at time τ, (V'+W') is the final potential difference, t is time, and $t_1$ is a time constant. The values of V', W', τ, and $t_1$ may vary widely, however, as an example, for the potential applied at rods 604 and 606, V' is 600V, W' is 400V, τ is 200 μs, and $t_1$ is 1.5 μs when analyzing positively charged ions, whereas for the potential applied at rods 608 and 610, V' is −600V, W' is −400V, τ is 200 μs, and $t_1$ is 1.5 μs. As known from the prior art, varying the field strength with time in such a manner can result in better than first order focusing simultaneously for all ions. Thus, the mass resolution is improved over a broader mass range as compared to methods that do not vary field strength as an exponential function of time. In further alternate embodiments, the potentials applied after delay time t may be any function of time—not limited to an exponential.

In alternate embodiments, an abridged LIT such as abridged trap 592 may be used to confine and then accelerate ions not into a TOF mass analyzer as discussed above but rather into the drift region of an ion mobility analyzer. In such an embodiment, the instrument may be substantially the same as TOF mass spectrometry system 674 depicted in FIG. 23, but with the TOF mass analyzer (i.e. the field free drift region, reflectron 680, and detector 682) removed and replaced with a conventional ion mobility drift cell and detector.

In alternate embodiments an abridged Paul trap similar to trap 474 may be used instead of trap 592 in an abridged trap-TOF mass spectrometer according to the present invention. In such alternate embodiments, ions are injected via aperture 475 cooled via collisions with gas molecules in the trap and focused to the center of the trap via an RF quadrupole field. Once enough ions have been accumulated, the RF quadrupole field is turned off and the TOF mass analysis is initiated by using electrodes 477, 478, and 486-503 to establish a homogeneous dipole field in abridged trap 474. The homogeneous dipole field accelerates the ions along the z-axis and out of trap 474 via aperture 476. Obviously, at least part of the TOF mass analysis is performed along the z-axis. Ion pass through a field free drift region and strike an ion detector. The flight times of the ions from the center of abridged trap 474 to the detector is measured in order to determine the mass of the ions.

It should be recognized that any of the above embodiments may be fabricated by any known prior art methods—for example, electrical discharge machining or micromachining. In further alternate embodiments, miniaturized abridged quadrupoles or Paul traps, may be fabricated by micromachining methods—masking, etching, thin layer depositions, etc.—used in the semiconductor or microfluidics industries.

The abridged multipole, abridged linear ion trap, abridged Paul trap, and abridged trap-TOF according to the present invention overcome many of the limitations of prior art multipoles and traps discussed above. The RF and trap-TOF devices disclosed herein provide a unique combination of attributes making them especially suitable for ion transport and for use in the mass analysis of a wide variety of samples.

While the present invention has been described with reference to one or more preferred and alternate embodiments, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention. It should be appreciated that the present invention is capable of being embodied in other forms without departing from its essential characteristics.

What is claimed is:

1. An abridged trap-TOF mass analyzer comprising:

an abridged linear ion trap with a plurality of rectilinear electrode structures each comprising a plurality of electrodes arranged along a line, each structure having a substantially planar face with a first dimension and a second dimension perpendicular to the first dimension and being constructed so that a voltage applied across the second dimension produces at the planar face an electrical potential whose amplitude is a linear function of position along the second dimension, a mechanism that positions the plurality of rectilinear electrode structures so that, for each electrode structure, the first dimension extends along the central axis and the planar faces of the electrode structures are parallel and positioned about the central axis, a source that applies an RF potential across the second dimension of each of the electrode structures to produce a multipole field to focus analyte ions toward the central axis, and one or more trapping electrode assemblies that produce axially confining fields before and after the plurality of electrode structures along the central axis;

a drift region; and an ion detector.

2. The abridged trap-TOF mass analyzer according to claim 1 wherein at least one of the electrode structures includes a gap through which ions may pass.

3. The abridged trap-TOF mass analyzer according to claim 1 wherein the electrode structures are positioned around the central axis so as to leave gaps between the electrode structures through which ions may pass.

4. The abridged trap-TOF mass analyzer according to claim 1 comprising four electrode structures.

5. The abridged trap-TOF mass analyzer according to claim 1 comprising two electrode structures positioned on opposite sides of the central axis.

6. The abridged trap-TOF mass analyzer according to claim 1 further comprising a second accelerator stage having a plurality of apertured electrically conducting accelerator electrodes positioned along an axis orthogonal to the central axis such that the application of potentials to the accelerator electrodes produces an electric field.

7. The abridged trap-TOF mass analyzer according to claim 6 wherein the second accelerator stage comprises an electrically conducting grid positioned along the orthogonal axis adjacent to the accelerator electrodes such that the application of potentials to the grid and accelerator electrodes produces a substantially homogeneous electric field.

8. The abridged trap-TOF mass analyzer according to claim 1 further comprising a housing that encloses the abridged linear ion trap and restricts a flow of gas between the abridged linear ion trap and the drift region and has a slit through which ions may pass from the abridged linear ion trap into the drift region.

9. The abridged trap-TOF mass analyzer according to claim 8 further comprising a mechanism for introducing a controlled flow of collision gas into the housing.

10. The abridged trap-TOF mass analyzer according to claim 1 wherein the trapping electrode assemblies comprise a pair of trapping electrodes extending perpendicularly to the central axis and positioned before and after the plurality of electrode structures along the central axis.

11. The abridged trap-TOF mass analyzer according to claim 1 wherein at least one abridged ion trap is positioned on the central axis upstream from the abridged linear ion trap.

12. The abridged trap-TOF mass analyzer according to claim 11 wherein ions are cooled by collisions with gas molecules in the at least one abridged ion trap.

13. The abridged trap-TOF mass analyzer according to claim 1 further comprising at least one reflectron device.

14. The abridged trap-TOF mass analyzer according to claim 1 wherein the ion detector is positioned at a first TOF image plane at which ions come into temporal focus after passing through the drift region.

15. The abridged trap-TOF mass analyzer according to claim 1 wherein the ion detector is positioned at a second TOF image plane at which ions come into second-order temporal focus after passing through the drift region.

16. A method of mass analyzing ions comprising:

(a) providing an abridged trap-TOF mass analyzer comprising a first abridged linear ion trap with a plurality of rectilinear electrode structures each comprising a plurality of electrodes arranges along a line, each structure having a substantially planar face with a first dimension and a second dimension perpendicular to the first dimension and being constructed so that a voltage applied across the second dimension produces an electrical potential at the planar face whose amplitude is a linear function of position along the second dimension; a mechanism that positions the plurality of rectilinear electrode structures so that, for each electrode structure, the first dimension extends along the central axis and the planar faces of the electrode structures are parallel and positioned about the central axis; and one or more trapping electrode assemblies which can be used to produce axially confining fields before and after the plurality of electrode structures along the central axis, a drift region and an ion detector;

(b) injecting analyte ions into the first abridged linear ion trap along the central axis;

(c) applying an RF potential across the second dimension of each of the electrode structures so as to produce a multipole field to focus the analyte ions toward the central axis;

(d) discontinuing the RF potential;

(e) applying a DC potential to one of (i) between the plurality of electrode structures and (ii) across the second dimensions of the electrode structures so that a first substantially homogeneous dipole field is established to accelerate the analyte ions out of the first abridged linear ion trap and into the drift region; and (f) detecting the ions.

17. The method of mass analyzing ions according to claim 16 further comprising applying one of a repulsive DC potential and a repulsive RF potential to at least one of the trapping electrode assemblies so as to restrict the motion of the ions along the central axis.

18. The method of mass analyzing ions according to claim 16 further comprising providing a collision gas in the first abridged linear ion trap and cooling the analyte ions via collisions with molecules of the collision gas.

19. The method of mass analyzing ions according to claim 16 wherein step (a) comprises placing the ion detector at a first TOF image plane at which ions come into temporal focus after passing through the drift region.

20. The method of mass analyzing ions according to claim 19 further comprising providing a second stage accelerator that comprises a plurality of apertured electrically conducting accelerator electrodes positioned along an axis orthogonal to the central axis and applying potentials to the accelerator electrodes so as to produce a second substantially homogeneous dipole field.

21. The method of mass analyzing ions according to claim 20 further comprising adjusting the DC potential and the potentials so that the strength of the first and second substantially homogeneous dipole fields are substantially the same in order to produce first order focusing at the first TOF image plane.

22. The method of mass analyzing ions according to claim 16 further comprising introducing a time delay between steps (d) and (e) and selecting a duration of the time delay in order to improve the mass resolution of the analyzer in a range of mass values.

23. The method of mass analyzing ions according to claim 22 wherein step (e) comprises manipulating the DC potential so that a strength of the first substantially homogeneous dipole field is a function of time defined by the equation $U'=V'+W'(1-\exp((\tau-t)/t_1))$, where $\tau$ is the duration of the time delay, V' is a DC potential difference applied at time $\tau$, (V'+W') is a final DC potential difference, t is time, and $t_1$ is a time constant.

24. The method of mass analyzing ions according to claim 16 further comprising providing upstream from the first abridged linear ion trap a second abridged linear ion trap with a plurality of rectilinear electrode structures, each structure having a substantially planar face with a first dimension and a second dimension perpendicular to the first dimension and being constructed so that a voltage applied across the second dimension produces an electrical potential at the planar face whose amplitude is a linear function of position along the second dimension; a mechanism that positions the plurality of rectilinear electrode structures so that, for each electrode structure, the first dimension extends along the central axis and the planar faces of the electrode structures are parallel and positioned symmetrically about the central axis; and one or more trapping electrode assemblies which can be used to produce axially confining fields before and after the plurality of electrode structures along the central axis and applying an RF waveform to the second abridged linear ion trap.

25. The method of mass analyzing ions according to claim 24 further comprising providing a collision gas in the second abridged linear ion trap.

26. The method of mass analyzing ions according to claim 24 further comprising forming fragment ions from analyte ions in the second abridged linear ion trap via one of collision induced dissociation, electron transfer dissociation, electron capture dissociation, photodissociation, metastable activated dissociation and a combination of these methods.

27. A method of mass analyzing ions comprising:

providing an abridged trap-TOF mass analyzer comprising a first abridged linear ion trap with a plurality of rectilinear electrode structures, each structure having a substantially planar face with a first dimension and a second dimension perpendicular to the first dimension and being constructed so that a voltage applied across the second dimension produces an electrical potential at the planar face whose amplitude is a linear function of position along the second dimension; a mechanism that positions the plurality of rectilinear electrode structures so that, for each electrode structure, the first dimension extends along the central axis and the planar faces of the electrode structures are parallel and positioned symmetrically about the central axis; and one or more trapping electrode assemblies which can be used to produce axially confining fields before and after the plurality of electrode structures along the central axis, a drift region and an ion detector;

receiving analyte ions into the first abridged linear ion trap along the central axis;

applying an RF potential across the second dimension of each of the electrode structures so as to produce a multipole field to focus the analyte ions toward the central axis;

discontinuing the RF potential;

applying a DC potential to one of (i) between the plurality of electrode structures and (ii) across the second dimensions of the electrode structures so that a first substantially homogeneous dipole field is established to accelerate the analyte ions out of the first abridged linear ion trap and into the drift region; and detecting the ions, where the step of discontinuing comprises discontinuing the RF potential at a phase that is an integer multiple of $\pi$ in order to reduce the effect of ion micromotion on the TOF mass analysis.

* * * * *